US010759628B2

(12) United States Patent
Sun

(10) Patent No.: US 10,759,628 B2
(45) Date of Patent: Sep. 1, 2020

(54) LINK COUPLER, CHAINWHEEL, AND ASSEMBLY THEREOF FOR COUPLING AND MOVING CHAINS OF DIFFERENT SIZES

(71) Applicant: Kanghua Sun, Ventura, CA (US)

(72) Inventor: Kanghua Sun, Ventura, CA (US)

(73) Assignee: Bardex Corporation, Goleta, CA (US)

( * ) Notice: Subject to any disclaimer, the term of this patent is extended or adjusted under 35 U.S.C. 154(b) by 0 days.

(21) Appl. No.: 16/125,095

(22) Filed: Sep. 7, 2018

(65) Prior Publication Data

US 2019/0092599 A1 Mar. 28, 2019

Related U.S. Application Data

(63) Continuation-in-part of application No. 15/431,145, filed on Feb. 13, 2017.

(Continued)

(51) Int. Cl.

*B63B 21/50* (2006.01)
*B65H 51/08* (2006.01)

(Continued)

(52) U.S. Cl.

CPC ..... *B65H 51/08* (2013.01); *B63B 21/22* (2013.01); *B63B 21/50* (2013.01); *B65H 51/06* (2013.01); *B65H 2701/3911* (2013.01)

(58) Field of Classification Search

CPC ..... F16G 15/04; F16G 15/00; B65H 51/08; B65H 51/06; B63B 21/50; B63B 21/22

See application file for complete search history.

(56) References Cited

U.S. PATENT DOCUMENTS 17,228 A 5/1857 Osgood
1,458,354 A 6/1923 Neller (Continued)

FOREIGN PATENT DOCUMENTS

CA 1253749 A 5/1989
DE 2204818 A1 8/1973

(Continued)

OTHER PUBLICATIONS

International Search Report dated Nov. 28, 2018, during the prosecution of International Application No. PCT/US2018/050002. [3 pages].

(Continued)

*Primary Examiner* — S. Joseph Morano
*Assistant Examiner* — Jovon E Hayes
(74) *Attorney, Agent, or Firm* — Michael S. McCoy; Amatong McCoy LLC

(57) ABSTRACT

A link coupler for coupling two lengths of different sized chain together and facilitating movement of the two lengths of different sized chain is provided. Also provided is an assembly of the link coupler with a dual chainwheel, a small chain, and a large chain. The link coupler includes a body, a small-chain link coupler coupled with the body at a first end of the body, and a large-chain link coupler coupled with the body at a second end of the body. The dual chainwheel includes a small wildcat profile and a large wildcat profile. The small chain is coupled with the small-chain link coupler, and the large chain is coupled with the large-chain link coupler.

27 Claims, 34 Drawing Sheets

Related U.S. Application Data

(60) Provisional application No. 62/555,408, filed on Sep. 7, 2017, provisional application No. 62/294,759, filed on Feb. 12, 2016.

(51) Int. Cl.
*B63B 21/22* (2006.01)
*B65H 51/06* (2006.01)

(56) References Cited

U.S. PATENT DOCUMENTS

| | | | |
|---|---|---|---|
| 1,836,169 | A | 12/1931 | Humphreys et al. |
| 2,362,531 | A | 11/1944 | Berger |
| 2,608,174 | A | 8/1952 | Sponenburg |
| 2,877,621 | A | 3/1959 | Robbins |
| 3,282,045 | A | 11/1966 | Thelan |
| 3,566,667 | A | 3/1971 | Hagerty |
| 3,620,181 | A | 11/1971 | Naczkowski |
| 3,638,599 | A | 2/1972 | Nilsen |
| 3,754,432 | A | 8/1973 | Hagerty |
| 3,805,728 | A | 4/1974 | Abraham |
| 3,842,776 | A | 10/1974 | Wudtke |
| 3,912,228 | A | 10/1975 | Petty et al. |
| 3,967,572 | A | 7/1976 | Lea |
| 3,985,093 | A | 10/1976 | Eidem |
| 4,020,779 | A | 5/1977 | Kitt |
| 4,068,467 | A | 1/1978 | Schreyer et al. |
| 4,078,768 | A | 3/1978 | Krogstad et al. |
| 4,094,141 | A | 6/1978 | Rehbein |
| 4,186,464 | A | 2/1980 | Sandoy |
| 4,241,575 | A | 12/1980 | St. Germain |
| 4,423,697 | A | 1/1984 | Royset |
| 4,430,023 | A | 2/1984 | Hayes et al. |
| 4,476,801 | A | 10/1984 | Foster et al. |
| 4,497,471 | A | 2/1985 | Longberg et al. |
| 4,513,681 | A | 4/1985 | Crook |
| 4,556,246 | A | 12/1985 | Millington |
| 4,722,293 | A | 2/1988 | Foster et al. |
| 4,724,789 | A | 2/1988 | van den Haak |
| 4,742,993 | A | 5/1988 | Montgomery et al. |
| 4,841,898 | A | 6/1989 | Ballantyne |
| 4,862,821 | A | 9/1989 | Ballantyne |
| 4,941,776 | A | 7/1990 | Bosgiraud et al. |
| 4,958,805 | A | 9/1990 | Willamsson |
| 5,097,788 | A | 3/1992 | Castel |
| 5,146,775 | A | 9/1992 | Ballard et al. |
| 5,149,059 | A | 9/1992 | Monahan |
| 5,178,087 | A | 1/1993 | O'Nion et al. |
| 5,275,379 | A | 1/1994 | McAleer |
| 5,364,075 | A | 11/1994 | Montgomery |
| 5,390,618 | A | 2/1995 | Wolff et al. |
| 5,441,008 | A | 8/1995 | Lange |
| 5,476,059 | A | 12/1995 | Pollack |
| 5,730,425 | A | 3/1998 | Brooks |
| 5,829,810 | A | 11/1998 | Fredriksson |
| 5,845,893 | A | 12/1998 | Groves |
| 6,435,121 | B2 | 8/2002 | Siring |
| 6,439,146 | B2 | 8/2002 | Seaman et al. |
| 6,817,595 | B1 | 11/2004 | Jenkins et al. |
| 7,059,262 | B2 | 6/2006 | Dove et al. |
| 7,104,214 | B2 | 9/2006 | Niebur |
| 7,240,633 | B2 | 7/2007 | Barlow et al. |
| 7,284,496 | B1 | 10/2007 | Douceur |
| 7,392,757 | B2 | 7/2008 | Niebur |
| 7,926,436 | B2 | 4/2011 | Boatman et al. |
| 8,069,805 | B2 | 12/2011 | De Baan et al. |
| 8,915,205 | B2 | 12/2014 | Miller et al. |
| 9,126,659 | B2 | 9/2015 | Miller et al. |
| 9,127,747 | B2 * | 9/2015 | Sun ..... F16G 15/04 |
| 2005/0022712 | A1 | 2/2005 | Gundersen |
| 2005/0072347 | A1 | 4/2005 | Niebur |
| 2008/0190344 | A1 | 8/2008 | Hystad |
| 2013/0116075 | A1 | 5/2013 | Miller et al. |
| 2013/0298521 | A1 * | 11/2013 | Sun ..... F16G 15/04 59/85 |
| 2013/0312649 | A1 | 11/2013 | Tomas |
| 2014/0026796 | A1 | 1/2014 | Leverette et al. |
| 2015/0014614 | A1 | 1/2015 | Lisland et al. |
| 2015/0090171 | A1 | 4/2015 | Dang |
| 2017/0259886 | A1 | 9/2017 | O'Rourke et al. |
| 2017/0334525 | A1 | 11/2017 | O'Rourke |
| 2017/0370455 | A1 | 12/2017 | Lyons et al. |
| 2018/0086421 | A1 | 3/2018 | O'Rourke et al. |
| 2019/0092599 | A1 * | 3/2019 | Sun ..... B65H 51/08 |

FOREIGN PATENT DOCUMENTS

| | | | |
|---|---|---|---|
| GB | 1441971 | A | 7/1976 |
| GB | 1522648 | A | 8/1978 |
| WO | 2004065203 | A1 | 8/2004 |
| WO | 2010085156 | A1 | 7/2010 |
| WO | 2016075291 | A1 | 5/2016 |

OTHER PUBLICATIONS

Written Opinion dated Nov. 28, 2018, during the prosecution of International Application No. PCT/US2018/050002. [5 pages].

* cited by examiner

FIG.2A
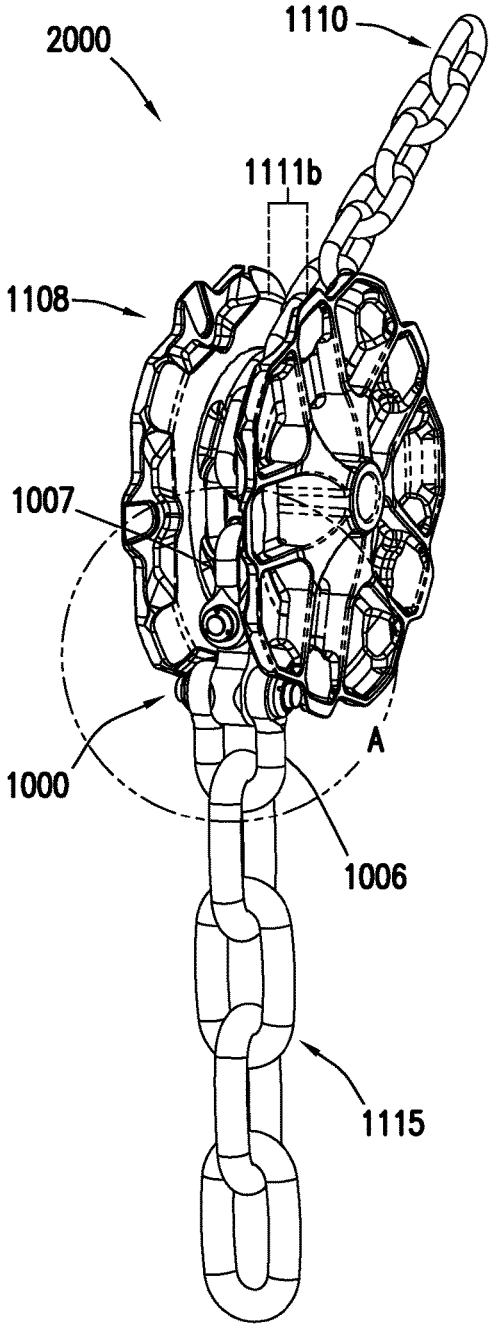
FIG.2C
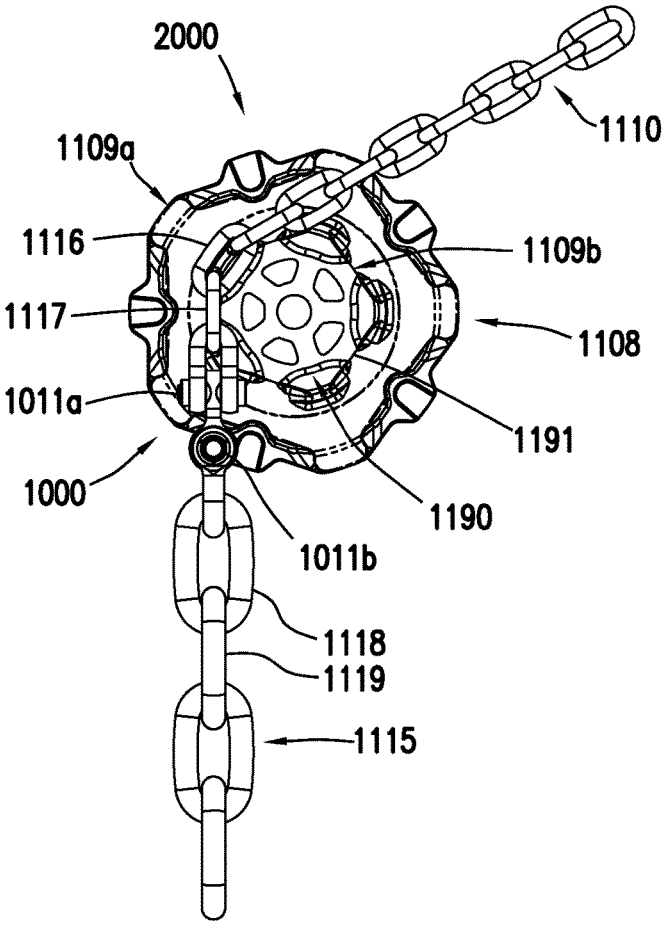
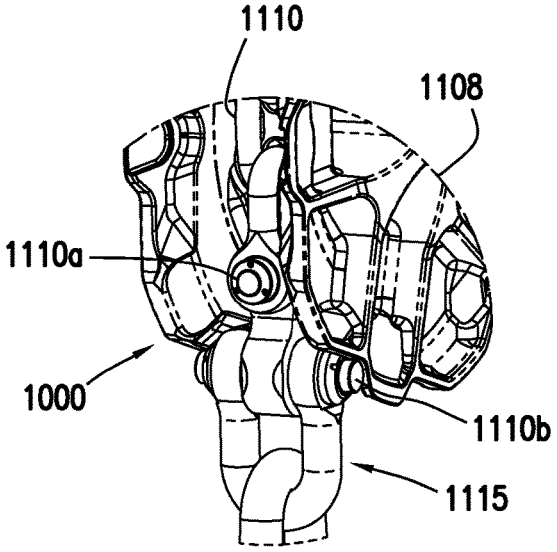
DETAIL A
FIG.2B

FIG.4A
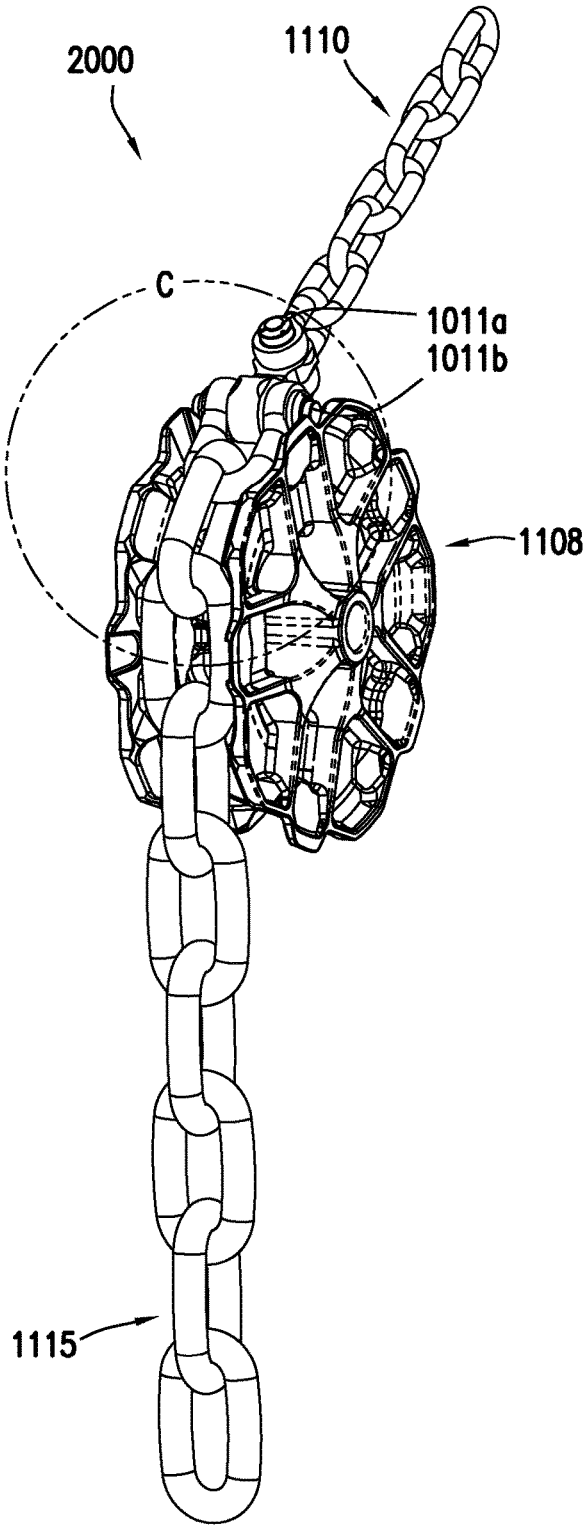
FIG.4C
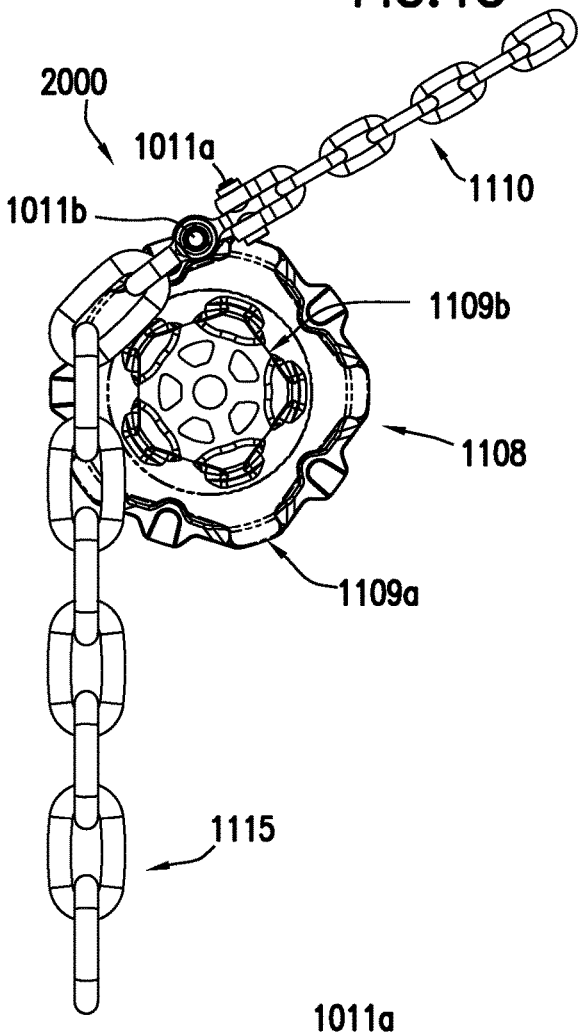
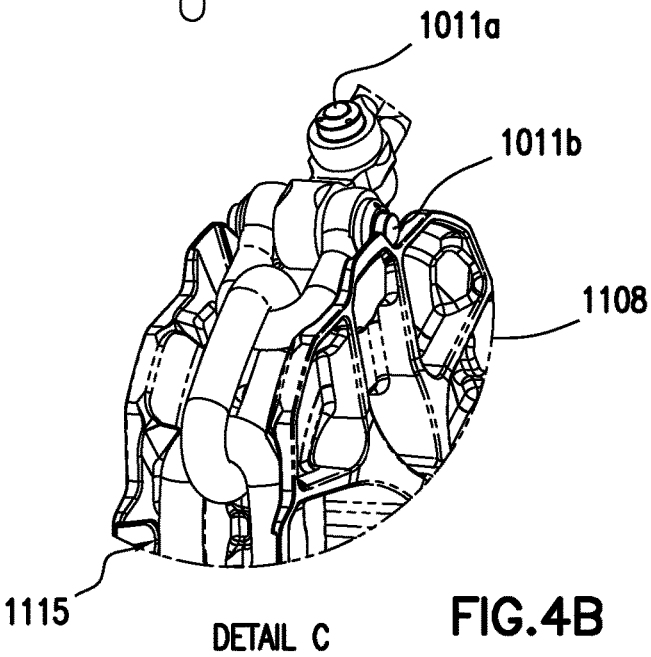
FIG.4B

LINK COUPLER, CHAINWHEEL, AND ASSEMBLY THEREOF FOR COUPLING AND MOVING CHAINS OF DIFFERENT SIZES

CROSS-REFERENCE TO RELATED APPLICATIONS

The present application claims the benefit of U.S. Provisional Patent Application No. 62/555,408, filed on Sep. 7, 2017, the entirety of which is incorporated herein by reference. This application also claims priority to, as a Continuation-in-part (CIP) of, U.S. patent application Ser. No. 15/431,145 (pending), filed on Feb. 13, 2017, the entirety of which is incorporated herein by reference, which itself claims the benefit of U.S. Provisional Patent Application No. 62/294,759, filed on Feb. 12, 2016, the entirety of which is incorporated herein by reference.

FIELD

The present disclosure relates to a link coupler for coupling two lengths of chain, a chainwheel for engaging and moving chain, and to an assembly thereof for coupling and moving chain, as well as to methods of making and using the same.

BACKGROUND

There are many situations in which relatively long lengths of chains are required. A common situation arises in marine applications, particularly in the mooring or anchoring of vessels in deep water, which is often required in the off-shore drilling and production of hydrocarbons. In off-shore drilling operations, platforms or spar buoys (e.g., for floating production, drilling or construction operations) are typically moored at a desired location using chains that are secured between the platform or spar buoys and anchors that are positioned on the ocean floor. In such installations, the anchor lines are installed by passing a messenger chain or rope from the deck, through a chainwheel, and out to a pre-installed anchor or mooring on the ocean floor. A connecting link secures the messenger chain to the anchor chain. The messenger chain is then hauled back to the platform; thereby, pulling the anchor chain towards the platform as well. Both the messenger chain and anchor chain pass through the same chainwheel. As the messenger chain has a lower capacity, it is usually smaller than the anchor chain.

BRIEF SUMMARY

An embodiment of the present disclosure includes an assembly for coupling two lengths of different sized chain together and moving the two lengths of different sized chain together. The assembly includes a dual chainwheel, which includes a small wildcat profile and a large wildcat profile. The assembly includes a link coupler. The link coupler includes a body, a small-chain link coupler coupled with the body at a first end of the body, and a large-chain link coupler coupled with the body at a second end of the body. The assembly includes a small chain coupled with the small-chain link coupler, and a large chain coupled with the large-chain link coupler. Engagement of the link coupler with the large wildcat profile positions the large chain along a path defined by the large wildcat profile.

Another embodiment of the present disclosure includes a method for coupling two lengths of different sized chain together and moving the two lengths of different sized chain together. The method includes providing a link coupler. The link coupler includes a body, a small-chain link coupler coupled with the body at a first end of the body, and a large-chain link coupler coupled with the body at a second end of the body. The method includes coupling a small chain with the small-chain link coupler, and coupling a large chain with the large-chain link coupler. The link coupler coupled with the small chain and the large chain forms a chain assembly. The method includes engaging the chain assembly with a dual chainwheel. The dual chainwheel includes a small wildcat profile and a large wildcat profile. The method includes hauling-in or paying-out the chain assembly.

Another embodiment of the present disclosure includes a link coupler for coupling two lengths of different sized chain together and facilitating movement of the two lengths of different sized chain. The link coupler includes a body, a small-chain link coupler coupled with the body at a first end of the body, and a large-chain link coupler coupled with the body at a second end of the body. The small-chain link coupler is sized to couple with a small chain and the large-chain link coupler is sized to couple with a large chain.

BRIEF DESCRIPTION OF THE DRAWINGS

So that the manner in which the features and advantages of the system, products, apparatus, and/or methods of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

FIG. 2A is a perspective view of an assembly that includes a link coupler engaged with a dual chainwheel, with the link coupler coupled with a small chain that is engaged with the dual chainwheel and a large chain that is disengaged from the dual chainwheel.

FIG. 2B is a detail view of section A of FIG. 2A.

FIG. 2C is a side, cross-sectional view of the assembly of FIG. 2A.

FIG. 4A is a perspective view of the same assembly of FIG. 2A, but with the link coupler and the large chain each engaged with the dual chainwheel, and the small chain disengaged from the dual chainwheel.

FIG. 4B is a detail view of section C of FIG. 4A.

FIG. 4C is a side, cross-sectional view of the assembly of FIG. 4A.

Figure 1C:
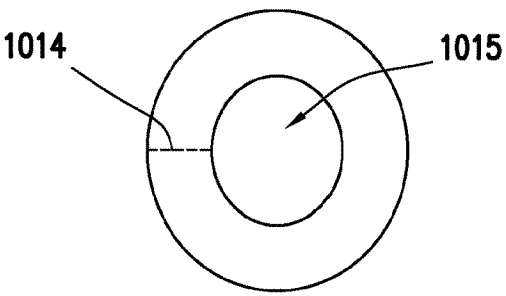
FIG. 1C is a side view of a chain link.
Figure 1E:
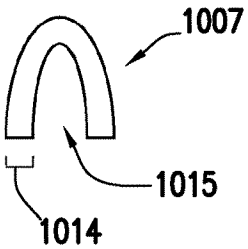
FIG. 1E is a simplified, side view of a portion of a small-chain link coupler.
Figure 1D:
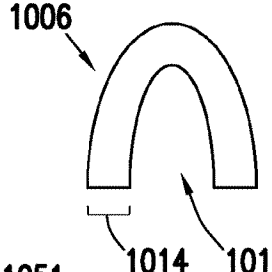
FIG. 1D is a simplified, side view of a portion of a large-chain link coupler.
Figure 1G:
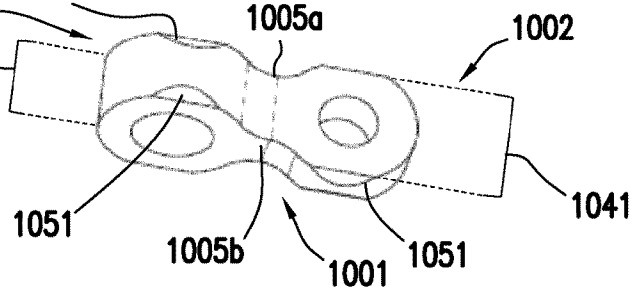
FIG. 1G is another perspective view of a portion (body) of the link coupler of FIG. 1A.
Figure 1B:
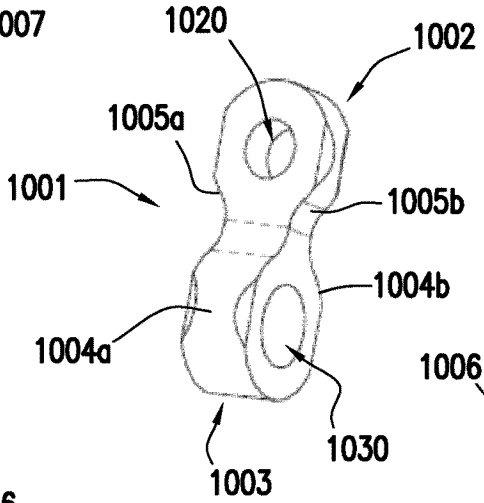
FIG. 1B is a perspective view of a portion (body) of the link coupler of FIG. 1A.
Figure 1F:
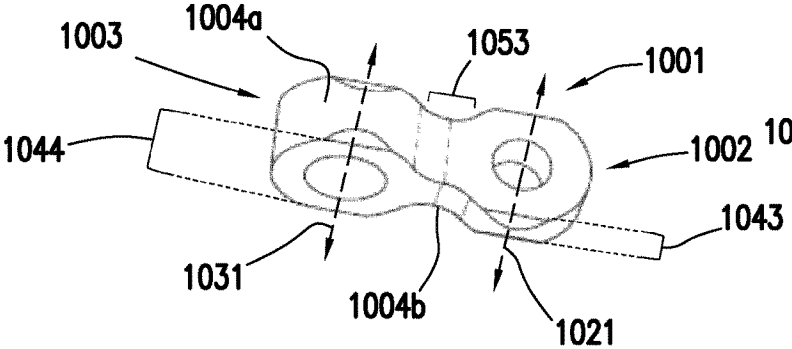
FIG. 1F is another perspective view of a portion (body) of the link coupler of FIG. 1A.
Figure 1A:
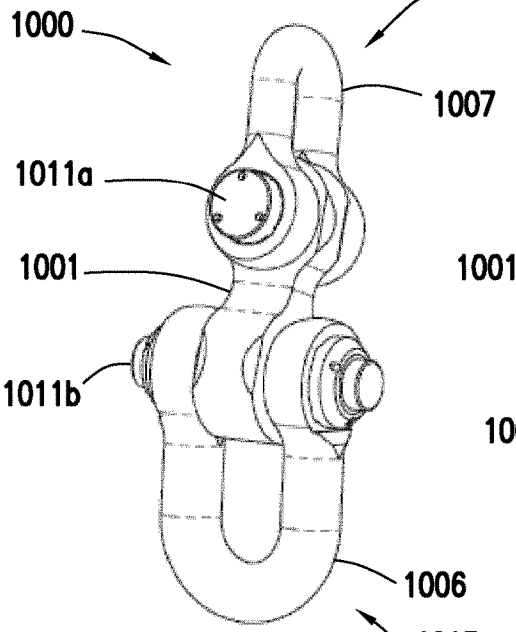
FIG. 1A is a perspective view of a link coupler.
Figure 1H:
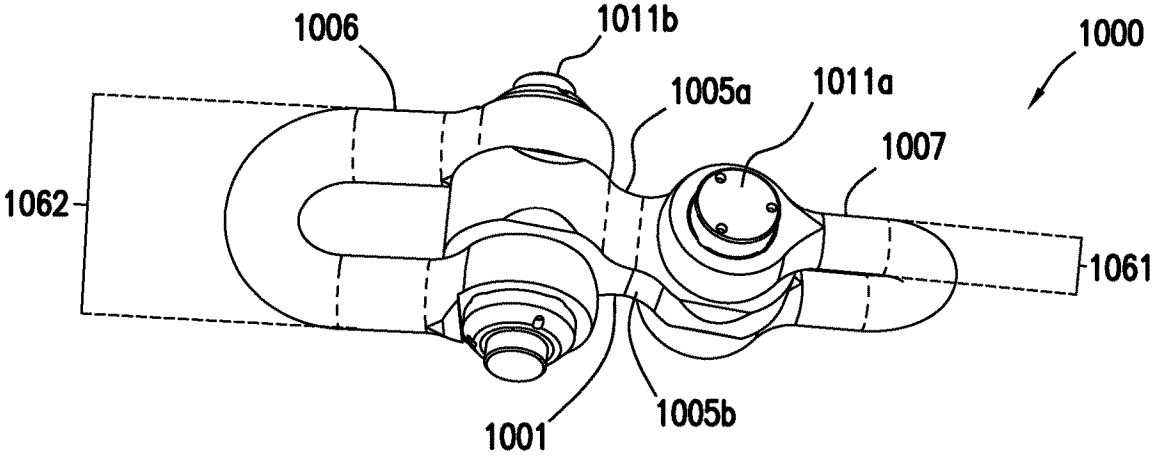
FIG. 1H is another perspective view of the link coupler of FIG. 1A.
Figure 1I:
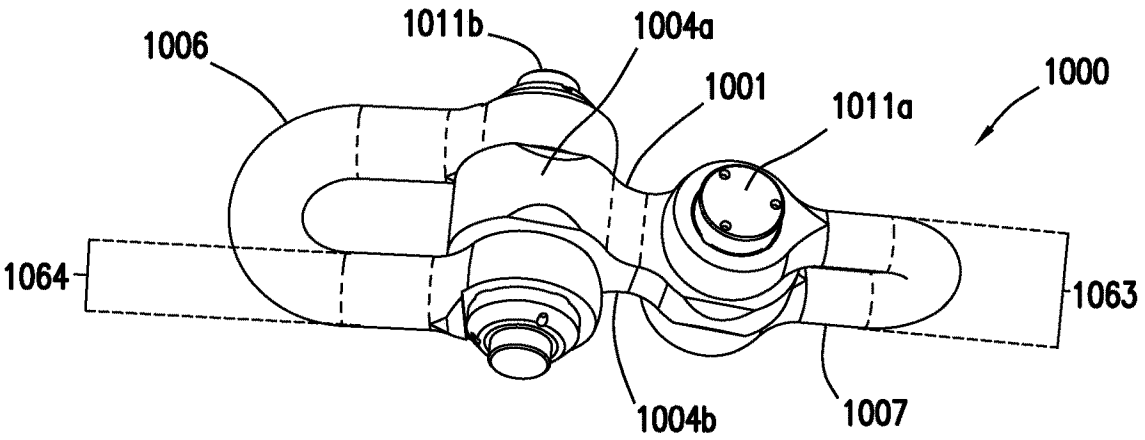
FIG. 1I is another perspective view of the link coupler of FIG. 1A.
Figure 1M:
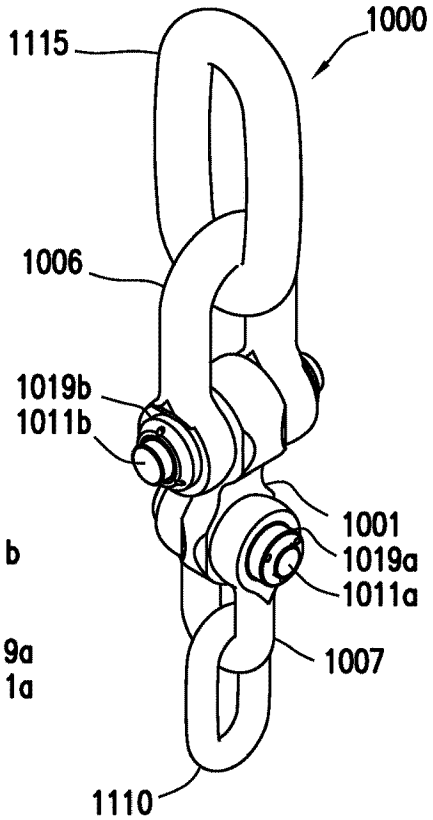
FIGS. 1J-1M depict a link coupler coupled with both a small and large chain.
Figure 1L:
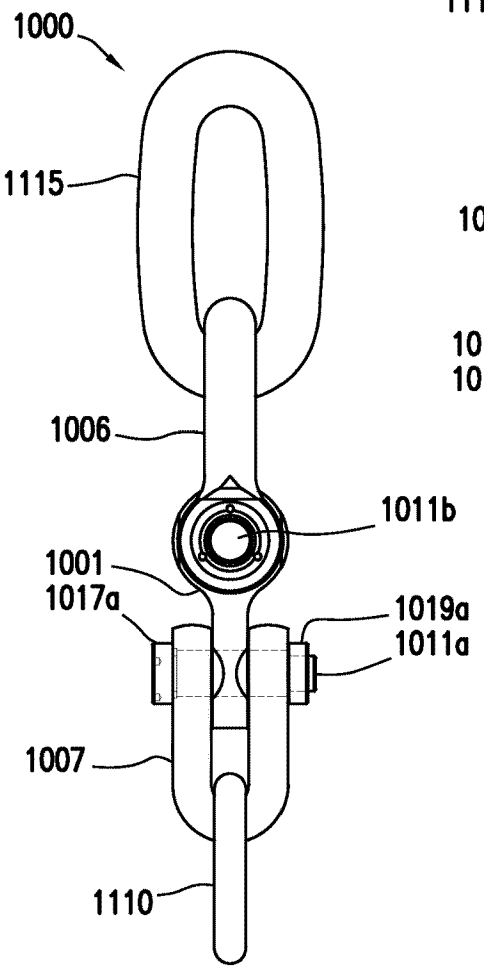
Figure 1K:
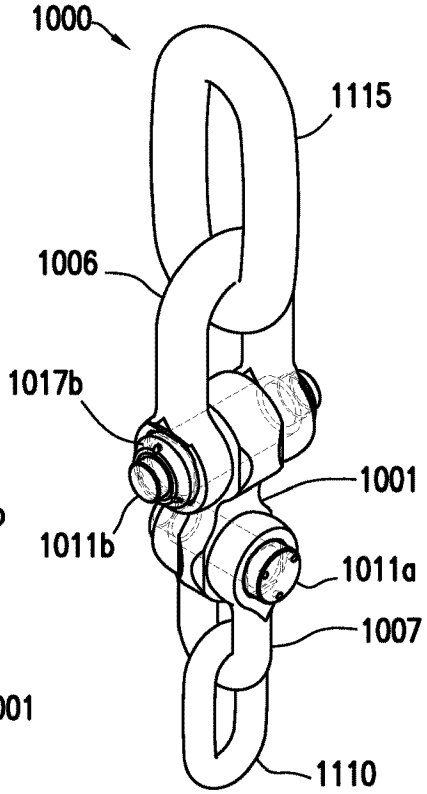
Figure 1J:
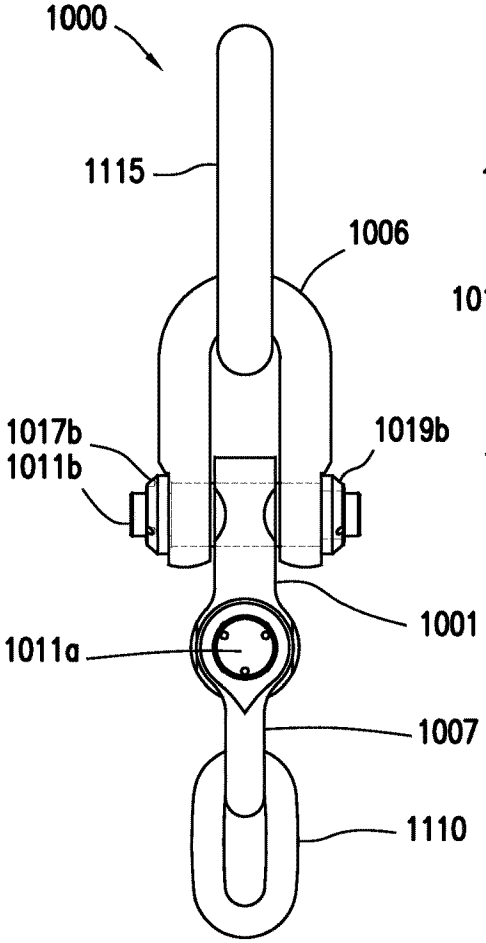

Products, systems, apparats, and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

The present disclosure provides for a link coupler for coupling two lengths of different sized chain together, to a chainwheel for engaging and facilitating movement of multiple, different sized chains, and to an assembly of the link coupler and chainwheel for coupling and facilitating movement of multiple, different sized chains. The present disclosure also provides methods of making and using the link coupler, the chainwheel, and the assemblies thereof.

Link Coupler

Certain embodiments of the present disclosure include a link coupler, also referred to as a connecting link assembly, for coupling multiple links of different sized chains together, and for facilitating movement thereof. With reference to FIGS. 1A-1I, link coupler 1000 and portions thereof are depicted. Link coupler 1000 has first end 1012 and second end 1013. At first end 1012, link coupler 1000 includes small-chain link coupler 1007 and, at second end 1013, link coupler 1000 includes large-chain link coupler 1006. One skilled in the art would understand that the small-chain and small-chain link coupler are defined relative to the large-chain and large-chain link coupler, such that the small-chain is smaller relative to the large-chain and the small-chain link coupler is smaller relative to the large-chain link coupler, and that the absolute sizes of the small-chain, large-chain, small-chain link coupler and large-chain link coupler may vary depending on the particular application at hand.

As would be understood by one skilled in the art, chains are sized according to diameter 1014 (i.e., thickness of chain link), coil 1015 (i.e., link opening size), or combinations thereof. Small-chain link coupler 1007 is configured (i.e., sized, shaped, and arranged) to couple with a small-chain. That is, small-chain link coupler 1007 may have a diameter 1014, coil 1015, or combinations thereof sized, shaped, and arranged to engage (i.e., link) with a link of a small-chain, such as a messenger chain used in the mooring of floating vessels or platforms. For example, small-chain link coupler 1007 may have the same or substantially the same diameter, coil, or combinations thereof as a link of the small-chain engaged therewith.

Large-chain link coupler 1006 is configured (i.e., sized, shaped, and arranged) to couple with a large-chain. That is, large-chain link coupler 1006 may have a diameter 1014, coil 1015, or combinations thereof sized, shaped, and arranged to engage (i.e., link) with a link of a large-chain, such as an anchor chain used in the mooring of floating vessels or platforms. For example, large-chain link coupler 1006 may have the same or substantially the same diameter, coil, or combinations thereof as a link of the large-chain engaged therewith.

While both small-chain link coupler 1007 and large-chain link coupler 1006 are shown as having the form of a link of a chain, or a partial link of a chain (D-link), one skilled in the art would understand that the small and large chain link couplers disclosed herein are not limited to these particular structures, and that the small and large chain link couplers may have any structure capable of engaging (e.g., securely engaging) a chain. In operation, when two chains are engaged with link coupler 1000 (i.e., a small-chain at first end 1012 and a large-chain at second end 1013) the coupling between the small and large chains and link coupler 1000 may be sufficiently secure such that the chains remain coupled to link coupler 1000 while being moved (i.e., hauled-in and/or paid-out) under load.

Link coupler 1000 includes body 1001. Body 1001 has first end 1002, second end 1003, top 1004*a*, bottom 1004*b*, first side 1005*a*, and second side 1005*b*. First end 1002 is relatively smaller than second end 1003 and includes a through-hole 1020 for coupling with small-chain link coupler 1007. When body 1001 is coupled with small-chain link coupler 1007, pin 1011*a* (also referred to as a tab) is positioned within through-holes (not shown) on each end of small-chain link coupler 1007 and within through-hole 1020 at first end 1002 of body 1001. As such, small-chain link coupler 1007 is movably (e.g., pivotably) coupled with body 1001 via pin 1011*a*, such that small-chain link coupler 1007 pivots about pin 1011*a*.

Second end 1003 is relatively larger than first end 1002 and includes a through-hole 1030 for coupling with large-chain link coupler 1006. When body 1001 is coupled with large-chain link coupler 1006, pin 1011*b* (also referred to as a tab) is positioned within through-holes (not shown) on each end of large-chain link coupler 1006 and within through-hole 1030 at second end 1003 of body 1001. As such, large-chain link coupler 1006 is movably (e.g., pivotably) coupled with body 1001 via pin 1011*b*, such that large-chain link coupler 1006 pivots about pin 1011*b*. Thus, in some aspects, large-chain link coupler 1006 and small-chain link coupler 1007 are movable (e.g., pivotable) relative to body 1001 independent of one another. Large-chain link coupler 1006 pivots about an axis (defined by pin 1011*a*) that extends perpendicular to the axis (defined by pin 1011*b*) about which small-chain link coupler 1007 pivots. As will be more evident from the figures described below, pins 1011*a* and 1011*b* or other portions of link coupler 1000 operate to engage with dual chain wheels to facilitate or cause large chains to engage with the large wildcat profile, small chains to engage with the small wildcat profile, or combinations thereof.

While link coupler 1000 is shown as including two link couplers, small and large, independently coupled with a body positioned therebetween, the link coupler disclosed herein is not limited to this particular arrangement and structure, and may include other structures capable of concurrently linking with both small and large chains, and of engaging with a chainwheel.

Link Coupler—Engagement Features

A dual chainwheel includes two chainwheel profiles (also referred to as wildcat profiles), including one configured (i.e., sized, shaped, and/or arranged) to engage with a relatively small, messenger chain and another configured to engage with a relatively larger, anchor chain. For example, a dual chainwheel, such as is shown in FIGS. 2A-4C (discussed in more detail below), may include an inner chainwheel profile configured to engage with a relatively small messenger chain and an outer chainwheel profile configured to engage with a relatively larger anchor chain. Link coupler 1000 includes one or more features that provide for engagement of link coupler 1000 with a dual chainwheel, including the size, shape, profile, surface features, and arrangement of one or more of the components of link coupler 1000, such as the size, shape, profile, surface features, and arrangement of small-chain link coupler 1007, large-chain link coupler 1006, and body 1001, and including the relative arrangement of these components. In some aspects, link coupler 1000, or at least the body 1001 thereof, has the shape generally of a "dog-bone."

Dual chainwheel engagement features of body 1001 include the relative arrangement of first end 1002 and second end 1003. As shown, first end 1002 is arranged 180° relative to second end 1003, such that through-hole 1020 extends perpendicular to through-hole 1030. That is, an axis 1021 extending through and axially aligned with through-hole 1020 is perpendicular to an axis 1031 extending through and axially aligned with through-hole 1030. This provides for the perpendicular arrangement of small-chain link coupler 1007 relative to large-chain link coupler 1006. First end 1002 may have width 1041 that is wider than width 1042 of second end 1003 in the dimension of body 1001 defined from first side 1005*a* to second side 1005*b*. First end 1002 may have height 1043 that is shorter than height 1044 of second end 1003 in the dimension of body 1001 defined from top 1004*a* to bottom 1004*b*. Through-hole 1020 of first end 1002 may be sized to engaged with a relatively small messenger chain, and through-hole 1030 of second end 1003 may be sized to engaged with a relatively large anchor chain (i.e., through-hole 1020 may have a smaller diameter than through-hole 1030). Body 1001 may include one or more surface features, such as beveled edges 1051 on first end 1002, second end 1003, or combinations thereof. Between first end 1002 and second end 1003, body 1001 includes mid-section 1053, which is a narrow section of body 1001 relative to first end 1002 and second end 1003. Thus, these features of body 1001, including: (1) the perpendicular arrangement of small-chain link coupler 1007 relative to large-chain link coupler 1006; (2) the relative widths of first end 1002 and second end 1003; (3) the relative heights of first end 1002 and second end 1003; (4) the relative sizes and direction of extension of through-holes 1020 and 1030; (5) the surface profile of body 1001, including beveled edges 1051; and (6) the narrow mid-section 1053, separate or in combination, provide for selective engagement of body 1001, small-chain link coupler 1007, large-chain link coupler 1006, and any chains attached thereto with a dual chainwheel, such that small-chain link coupler 1007 and any chain attached thereto engages with a small wildcat profile of the dual chainwheel and large-chain link coupler 1006 and any chain attached thereto engages with a large wildcat profile of the dual chainwheel.

Dual chainwheel engagement features of the small and large chain link couplers include the relative, perpendicular arrangement of small-chain link coupler 1007 and large-chain link coupler 1006. As shown, small-chain link coupler 1007 is arranged 180° relative to large-chain link coupler 1006, such that the coil of small-chain link coupler 1007 opens perpendicular to the opening of the coil of large-chain link coupler 1006. Small-chain link coupler 1007 has width 1061 that is narrower than width 1062 of large-chain link coupler 1006 in the dimension corresponding with the dimension of body 1001 defined from first side 1005*a* to second side 1005*b*. Small-chain link coupler 1007 has height 1063 that is greater than height 1064 of large-chain link coupler 1006 in the dimension corresponding with the dimension of body 1001 defined from top 1004*a* to bottom 1004*b*. The coil of small-chain link coupler 1007 is sized to engaged with a relatively small messenger chain, and the coil of large-chain link coupler 1006 is sized to engaged with a relatively large anchor chain. Pin 1011*a* extends perpendicular to pin 1011*b*, and pin 1011*b* extend beyond width 1062, such that pins 1011*a* and 1011*b* are positioned to engage with surface features of the dual chainwheel, as described in more detail below, to facilitate transition between moving a small chain to moving a large chain. While pins are shown and described as forming the engagement feature that facilitates transition between moving a small chain to moving a large chain, the link coupler is not limited to this particular structure, and may include another structural engagement feature configured (position, sized, shaped, and/or arranged) to engage with the dual chain wheel in such a manner that small chains are positioned to engage with the small wildcat profile of the dual chain wheel and large chains are positioned to engage with the large wildcat profile of the dual chain wheel. Thus, these features of the small and large chain link couplers, including: (1) the perpendicular arrangement of small-chain link coupler 1007 and large-chain link coupler 1006; (2) the relative widths of small-chain link coupler 1007 and large-chain link coupler 1006; (3) the relative heights of small-chain link coupler 1007 and large-chain link coupler 1006; (4) the relative sizes of the coils of small-chain link coupler 1007 and large-chain link coupler 1006; and (5) the relative positioning and sizes of the pins 1011*a* and 1011*b*, separate or in combination, provide for selective engagement of small-chain link coupler 1007 and large-chain link coupler 1006, and any chains attached thereto, with a dual chainwheel, such that small-chain link coupler 1007 and any chain attached thereto engages with a small wildcat profile of the dual chainwheel and large-chain link coupler 1006 and any chain attached thereto engages with a large wildcat profile of the dual chainwheel. As such, small-chain link coupler 1007 engages with a portion of a dual chainwheel that is distinct from a portion of the dual chainwheel that engages with large-chain link coupler 1006.

Assembly of Link Coupler with Small and Large Chains

FIGS. 1J-1M depicts link coupler 1000 connected with small chain link 1110 and large chain link 1115. As shown, large-chain link coupler 1006 and small-chain link 1007 are each in the form of a D-link. Large-chain link coupler 1006 is coupled with body 1001 via pin 1011*b* having pin head 1017*b*. Pin 1011*b* is secured to large-chain link coupler 1006 and body 1001 via nut 1019*b*. Similarly, small-chain coupler 1007 is coupled with body 1001 via pin 1011*a* having pin head 1017*a*, and pin 1011*a* is secured to small-chain link coupler 1007 and body 1001 via nut 1019*a*.

Assembly of Dual Chainwheel and Link Coupler

Certain aspects of the present disclosure include a dual chainwheel configured (i.e., sized, shaped and/or arranged) to engage with a relatively small chain, such as a messenger chain, and a relatively large chain, such as an anchor chain. The dual chainwheel is also configured to engage with the link coupler disclosed herein. Some aspects of the present disclosure include an assembly of a dual chainwheel and a link coupler. With reference to FIGS. 2A-4C, an assembly of a dual chain wheel and a link coupler is depicted, in accordance with some aspects of the present disclosure, where a messenger chain and an anchor chain are sequentially shown being hauled-in.

FIGS. 2A-2C depict assembly 2000, including dual chainwheel 1108 engaged with messenger chain 1110 and link coupler 1000. Dual chainwheel 1108 includes first chainwheel profile 1109*a*, here shown as an outer chainwheel profile, and second chainwheel profile 1109*b*, here shown as an inner chainwheel profile. First chainwheel profile 1109*a* is configured (i.e., sized, shaped and/or arranged) to receive, engage, and move a relatively larger chain size, in comparison to the chain size that second chainwheel profile 1109*b* is configured to receive, engage, and move. Second chainwheel profile 1109*b* includes a series of surface features, such as peaks, ledges, undulations, valleys, grooves, pockets, grooves, wheel pockets, and surface contours configured for engagement with a small chain and optionally link coupler. Inner pocket flat beds 1191 are configured (i.e., sized, shaped and/or arranged) to engage within coils of vertical links of messenger chain 1110, and inner bottom grooves 1190 are configured (i.e., sized, shaped and/or arranged) to engage with horizontal links of messenger chain 1110. As used herein, "vertical links" and "horizontal links" of a chain refer to adjacent links of a chain that are oriented 90 degrees or substantially 90 degrees relative to one another. As shown in FIG. 2C, link 1116 of messenger chain 1110 is a vertical link and link 1117 of messenger chain 1110 is a horizontal link, and link 1118 of anchor chain 1115 is a vertical link and link 1119 of anchor chain 1115 is a horizontal link. In operation, inner bottom grooves 1190 engage with successive horizontal links 1117, while chainwheel 1108 rotates to progressively haul-in or pay-out messenger chain 1110, and inner pocket flat beds 1191 engage with successive vertical links 1116. Small-chain link coupler 1007 is configured (i.e., sized, shaped and/or arranged) to fit and engage with second chainwheel profile 1109*b*. As such, messenger chain 1110 is hauled-in or paid-out along a path defined by second chainwheel profile 1109*b*.

Figure 3A:
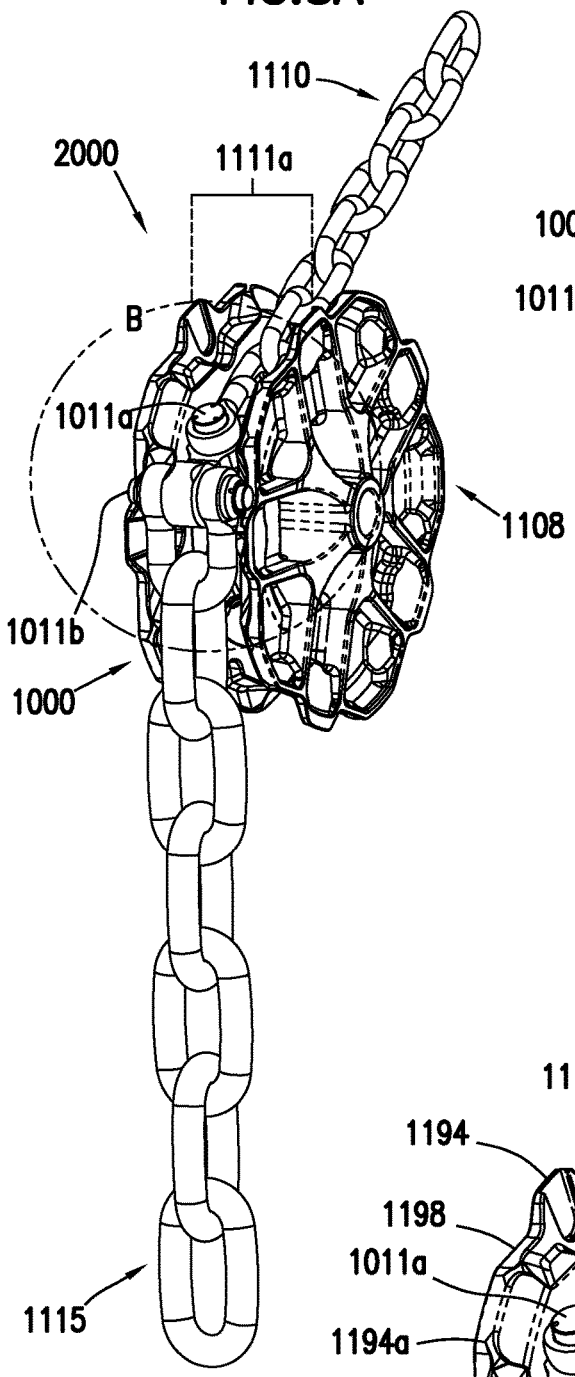
FIG. 3A is a perspective view of the same assembly of FIG. 2A, but with the link coupler, the small chain, and the large chain each engaged with the dual chainwheel.
Figure 3C:
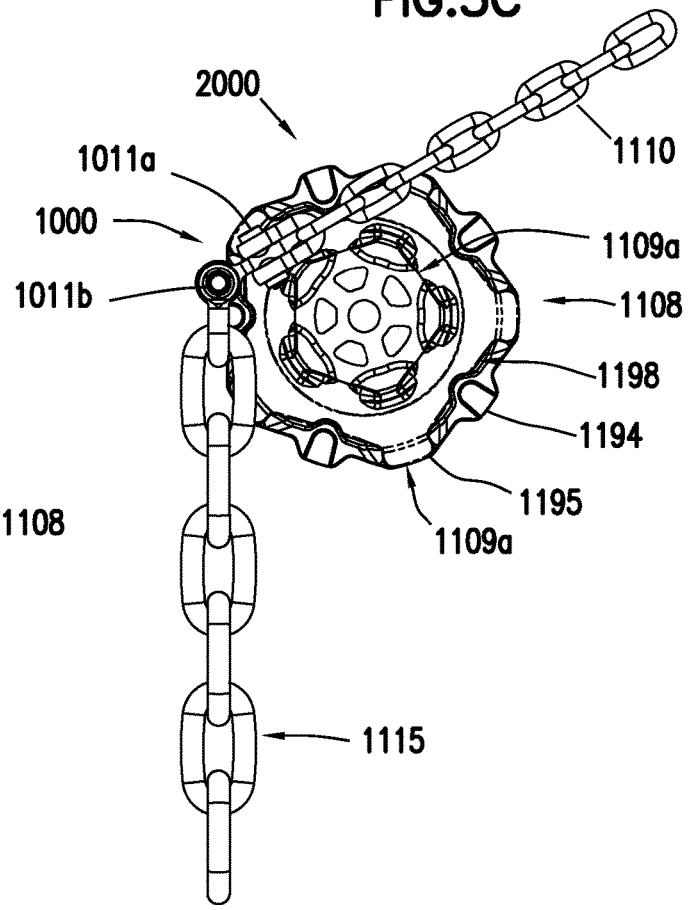
FIG. 3C is a side, cross-sectional view of the assembly of FIG. 3A.
Figure 3B:
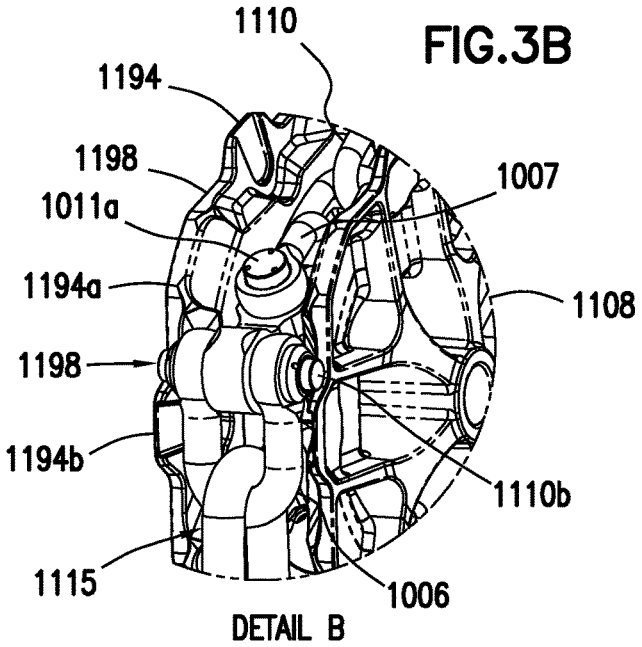
FIG. 3B is a detail view of section B of FIG. 3A.

FIGS. 3A-3C depict assembly 2000, including dual chainwheel 1108 in transition from engagement with messenger chain 1110 and link coupler 1000 to engagement with anchor chain 1115 and link coupler 1000. First chainwheel profile 1109*a* has a width 1111*a* that is greater than the width 1111*b* (shown in FIG. 2A) of second chainwheel profile 1109*b*. First chainwheel profile 1109*a* includes a series of surface features, such as peaks, ledges, undulations, valleys, grooves, pockets, grooves, wheel pockets, pits, and surface contours configured for engagement with a large chain and optionally link coupler. First chainwheel profile 1109*a* includes a series of peaks outer whelp tips 1194, outer teeth 1195, and outer link pocket flat beds 1198 that are configured (i.e., sized, shaped and/or arranged) to receive and mate with a portion of link coupler 1000 such that anchor chain 1115 engages with and is moved along first chainwheel profile 1109*a*. Link coupler 1000 includes one or more features that facilitate this transition of engagement of chainwheel 1108. Pin 1110*b* of link coupler 1000 is configured (i.e., sized, shaped and/or arranged) to engage within an outer link pocket flat beds 1198*a* of first chainwheel profile 1109*a*, against one of the outer whelp tips 1194 of first chainwheel profile 1109*a*. As such, large-chain link coupler 1006 is engaged with first chainwheel profile 1109*a*, and, in at least some embodiments, does not engage with second chainwheel profile 1109*b*. In operation, pin 1110*b* is engaged within an outer link pocket flat bed 1198, and chainwheel 1108 rotates to progressively haul-in or pay-out anchor chain 1115.

As shown in FIGS. 4A-4C, as anchor chain 1115 is further hauled-in, messenger chain 1110, and ultimately link coupler 1000, become disengaged from chainwheel 1108. Thus, pin 1110*b* and large wildcat profile surface features facilitate transition of engagement between second chainwheel profile 1109*b* and messenger chain 1110 to engagement between first chainwheel profile 1109*a* and anchor chain 1115, and facilitates movement of anchor chain 1115 along a patch defined by first chainwheel profile 1109*a*. As such, anchor chain 1115 is hauled-in or paid-out along a path defined by first chainwheel profile 1109*a*.

While the link coupler is shown and described as including a pin to facilitate transition to engagement with the anchor chain, the link couplers disclosed herein are not limited this particular structure, and may include other structures capable of causing a dual chainwheel engaged therewith to transition from engagement with a messenger chain to engagement with an anchor chain. Further, while the chainwheel profiles disclosed herein are shown as including peaks and valleys to facilitate engagement and transition between the chainwheel profiles and the messenger chain, link coupler, and anchor chain, the chainwheel profiles disclosed herein are not limited this particular structure, and may include other structures capable of facilitating engagement and transition between the chainwheel profiles and the messenger chain, link coupler, and anchor chain.

Thus, link coupler 1000 facilitates the interconnection of two different sized chains, and facilitates the transition of engagement between a dual chainwheel and the two different sized chains. Link coupler 1000 may have a length and/or pitch that allows a smaller link driving wheel of a dual chainwheel (i.e., second chainwheel profile) to engage the link coupler 1000. The pitch of the body 1001 may have dimensions sufficient to maintain engagement between second chainwheel profile 1109*b* and links of the small chain (i.e., messenger chain 1110), and to deliver the links of the larger chain (i.e., anchor chain 1115) to first chainwheel profile 1109*a* for engagement there-between. In some aspects, body 1001 is shaped, sized, and/or arranged to engage wheel pockets and/or wheel ledges of the dual chainwheel 1008 (i.e., inner bottom grooves 1190 and inner pocket flat beds 1191).

The link coupler 1000 disclosed herein may be coupled with many types of chain including, but not limited to, anchor chains and messenger chains. In some aspects, the link coupler 1000 connects with relatively heavy-duty chains, such as an anchor chain or haulage chain, including chains used in conjunction with chainwheels for transmitting tensional drives. Furthermore, the link coupler 1000 may be used with many types of chainwheels. In some aspects, the link coupler 1000 is used in conjunction with a dual chainwheel, as is disclosed in U.S. Provisional Application No. 61/555,350, filed on Nov. 3, 2011 (Expired), and U.S. patent application Ser. No. 13/669,310, filed on Nov. 5, 2012 (Abandoned), the disclosures of which are incorporated herein by reference in their entireties. In some aspects, the link coupler 1000 is used in conjunction with a dual chainwheel, as is disclosed in U.S. Pat. No. 9,127,747, issued on Sep. 5, 2015, the disclosure of which is incorporated herein by reference in its entirety.

Rotary Chain Jack Assembly

Figure 5:
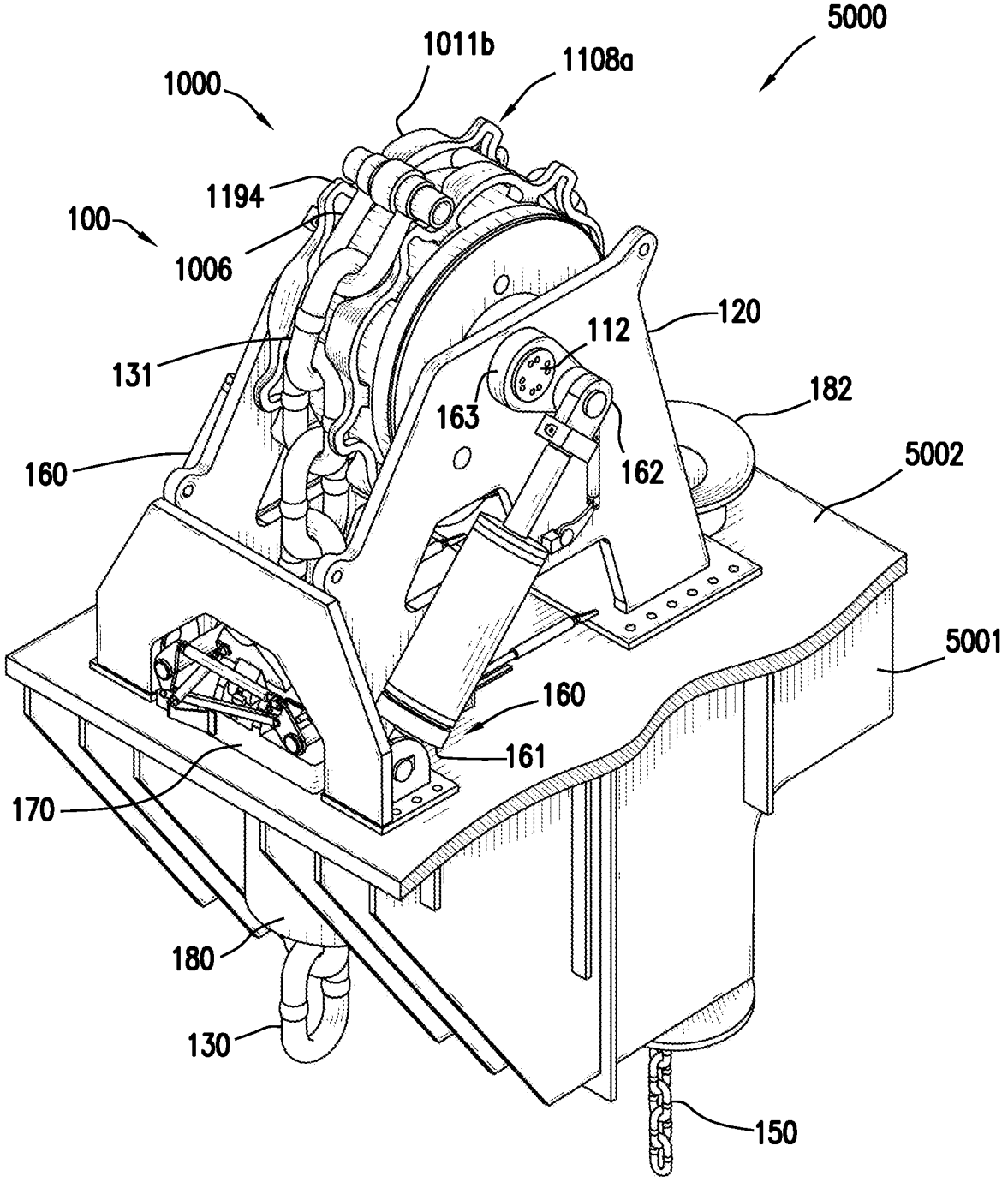
FIG. 5 is a perspective view of a rotary chain jack with a link coupler engaged with a chainwheel thereof.

FIG. 5 is a reproduction of FIG. 1 from incorporated U.S. patent application Ser. No. 15/431,145, with the exceptions that: the reference numerals for the dual chainwheel and components thereof have been changed; the reference numerals for the link coupler and components thereof have been changed; and the references numerals for the offshore structure and top surface thereof have been changed. Otherwise, all reference numerals refer to the element shown and described in the description of FIG. 1 of incorporated U.S. patent application Ser. No. 15/431,145.

FIG. 5 depicts rotary chain jack assembly 5000, including rotary chain jack 100. Rotary chain jack 100 includes dual chainwheel 1108*a* engaged with link coupler 1000, both of which are positioned on top surface 5002 of offshore structure 5001. Top chain link 131 of anchor chain 130 is coupled with link coupler 1000 (also referred to as a shackle or back-to-back shackle). In the position of the mooring line, as shown in FIG. 5, link coupler 1000 is coupled with dual chainwheel 1108*a*. As shown, pin 1011*b* is coupled with outer tip whelp 1194 of dual chainwheel 1108*a*. Link coupler 1000 is also coupled to messenger chain 150.

In assembly 5000, dual chainwheel 1108*a* is coupled to frame 120. Dual chainwheel 1108*a* includes axle 112 engaged within a through-hole (not shown) of frame 120. Frame 120 is coupled to a portion of offshore structure 5001, such as via bolting, welding, or any other such method well known to those of ordinary skill in the art. Offshore structure 5001 may be, for example and without limitation, an offshore floating platform, such as for offshore drilling and production of hydrocarbons or for construction, or a ship. In some embodiments, frame 120 retains dual chainwheel 1108*a* in a position that is raised above top surface 5002 of offshore structure 5001, allowing dual chainwheel 1108*a* to rotate relative to frame 120 without contacting top surface 5002 of offshore structure 5001. Offshore structure 5001 may include inboard hawse pipe 182 and outboard hawse pipe 180.

Assembly 5000 includes jack cylinders 160. At first end 161 of jack cylinders 160, jack cylinders 160 are coupled, such as via bolting, to frame 120. In other embodiments, first end 161 may be coupled to a portion of offshore structure 5001. Second end 162 of jack cylinders 160 are coupled, such as via bolting, to crank arm 163. Crank arm 163 is coupled with axle 112, such as via pinning, press fit, or any other manner well known to those of ordinary skill in the art. In operation, actuation of jack cylinders 160 rotates crank arm 163, rotation of crank arm 163 rotates axle 112, rotation of axle 112 rotates dual chainwheel 1108*a*, and rotation of dual chainwheel 1108*a* either deploys or hauls in chain anchor chain 130 depending upon the direction of rotation of dual chainwheel 1108*a*.

Assembly 5000 includes stopper assembly 170. Stopper assembly 170 is positioned on frame 120, such that stopper assembly 170 selectively engages anchor chain 130 for gripping of anchor chain 130, and selectively disengages from anchor chain 130 for allowing passage of anchor chain 130, such as during deployment of hauling-in of anchor chain 130. Stopper assembly 170 couples with frame 120 such that stopper assembly 170 is positioned to engage anchor chain 130 on an outboard side of dual chainwheel 1108*a*, intermediate of dual chainwheel 1108*a* and an anchor (not shown) engaged with anchor chain 130.

Figure 6B:
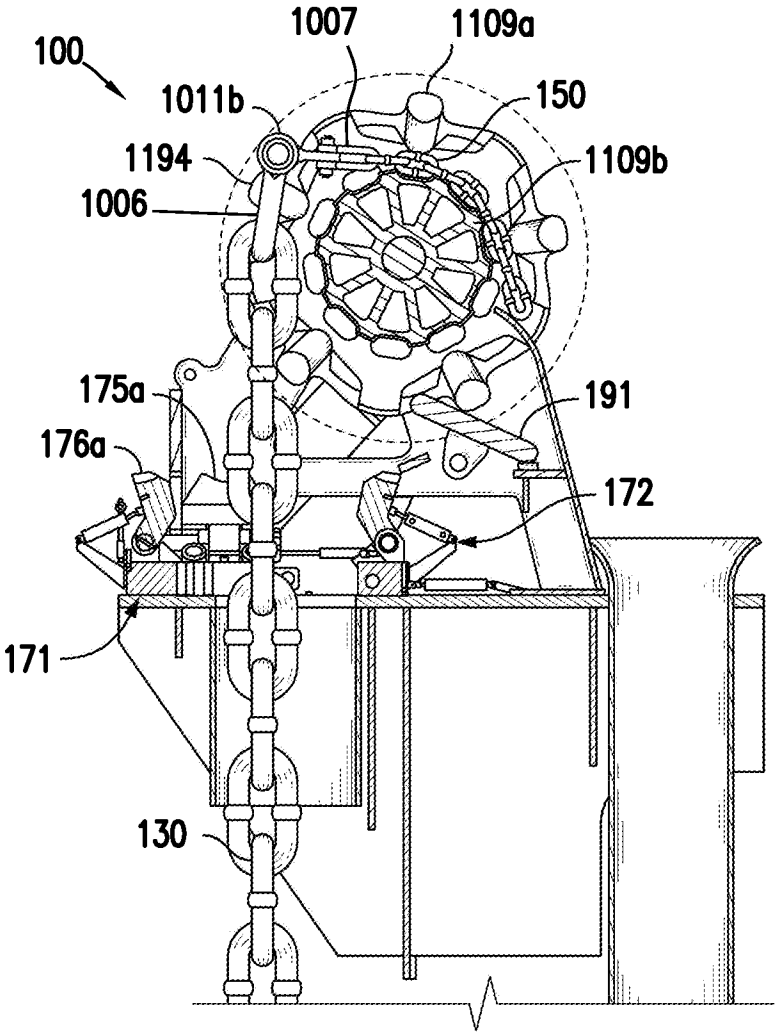
FIG. 6B is a sectional, side view of the rotary chain jack of FIG. 6A.
Figure 6A:
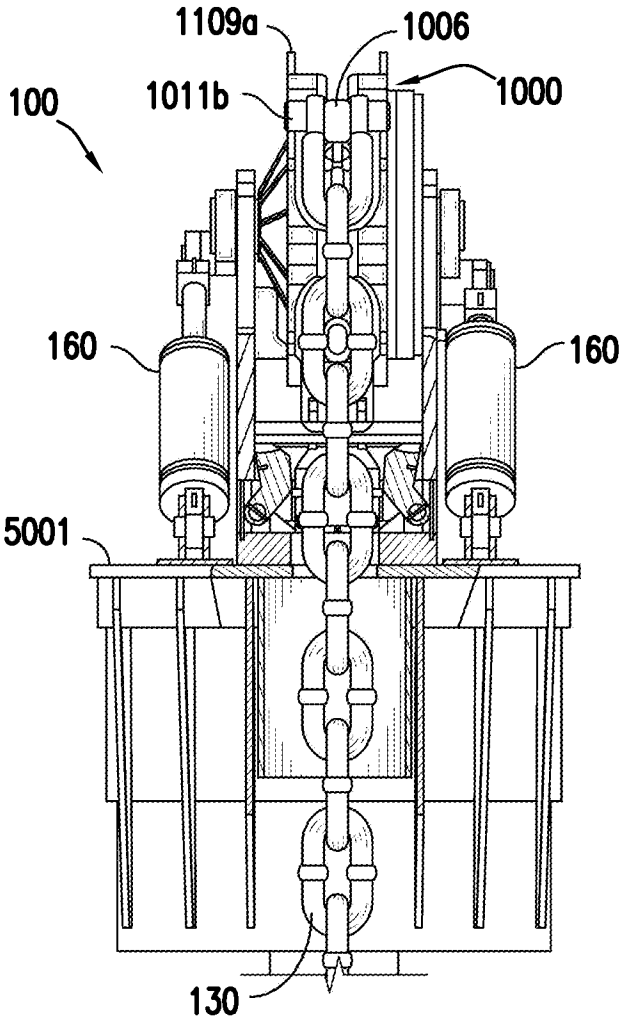
FIG. 6A is a sectional, front view of a rotary chain jack during haul-in, with the link coupler of the mooring line in transition.

With reference to FIGS. 6A and 6B, once messenger chain 150 is hauled-in, but still engaged with second chainwheel profile 1109*b*, link coupler 1000 becomes engaged with outer tip whelp 1194 of first chainwheel profile 1109*a*. After engagement of link coupler 1000 with outer tip whelp 1194, further rotation of dual chainwheel 1108*a* results in the passing of chain 130 over first chainwheel profile 1109*a*. Also shown in FIGS. 6A and 6B are inboard stopper assembly 172, outboard stopper assembly 171, chainwheel latch 191, main latch 175*a*, and auxiliary latches 176*a* and 176*b*, the operation of each of which is describe in more detail in incorporated U.S. patent application Ser. No. 15/431,145.

FIGS. 7-11 are reproductions of FIGS. 1, 3, 10, 14, and 15 from incorporated U.S. patent application Ser. No. 15/603,068, respectively, with the exception that the reference numerals for the dual chainwheel and the link coupler have been modified. Otherwise, all reference numerals refer to the element shown and described in the description of the relevant figure in U.S. patent application Ser. No. 15/603,068.

Figure 7:
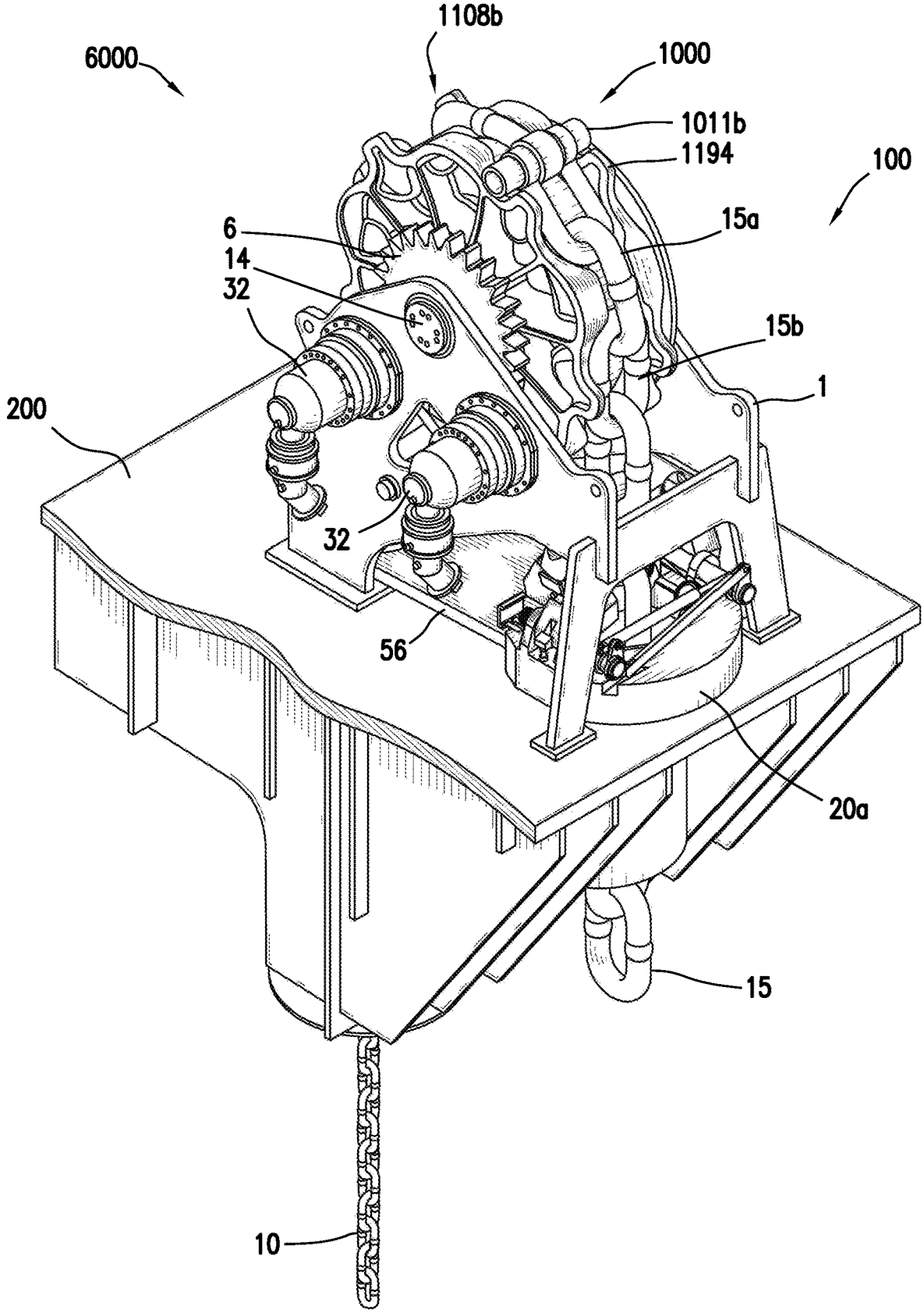
FIG. 7 is a perspective view of a rotary chain jack or windlass including a chain stopper and a link coupler engaged with a chainwheel thereof.
Figure 8:
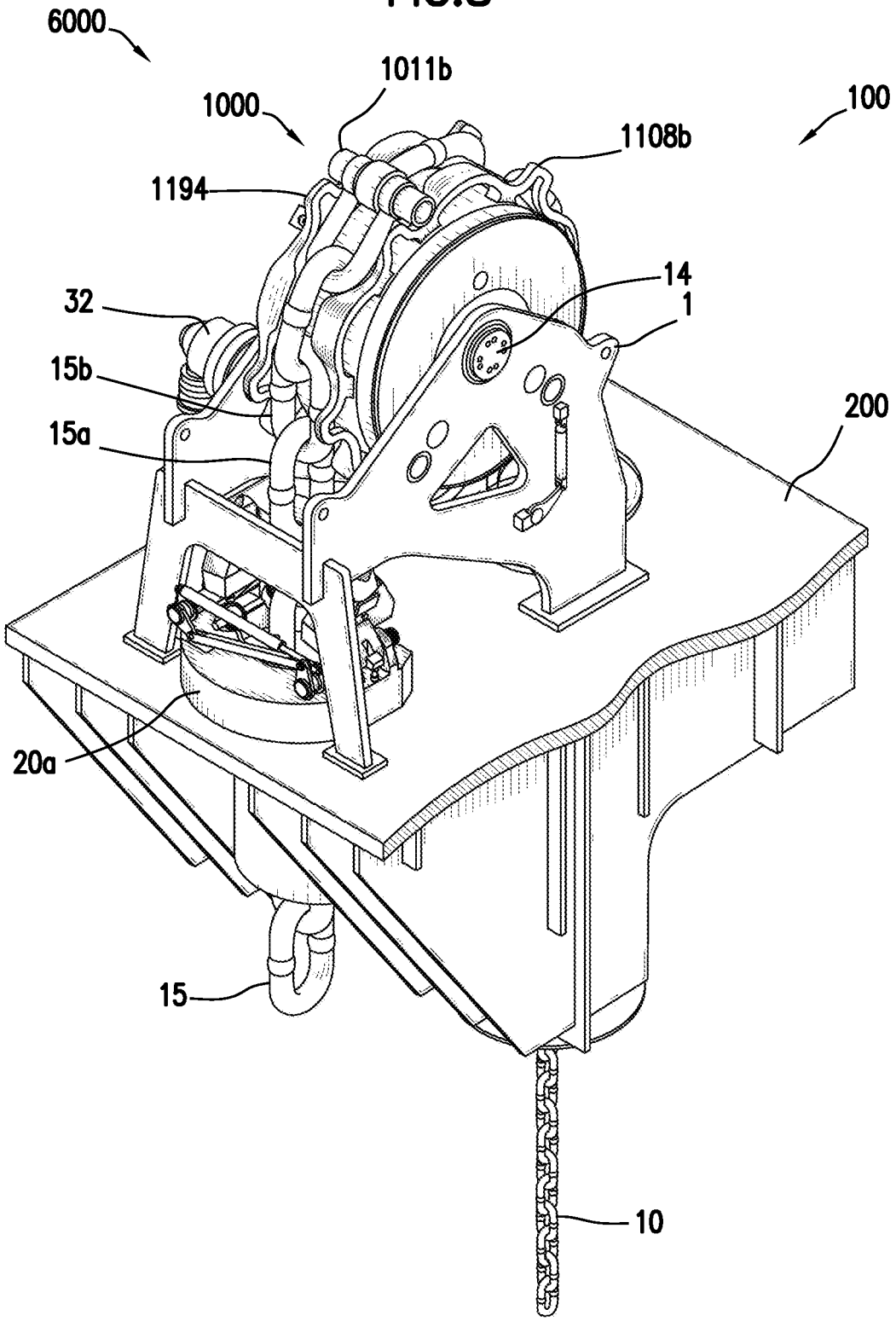
FIG. 8 is another perspective view of the rotary chain jack or windlass with the link coupler of FIG. 7.
Figure 9:
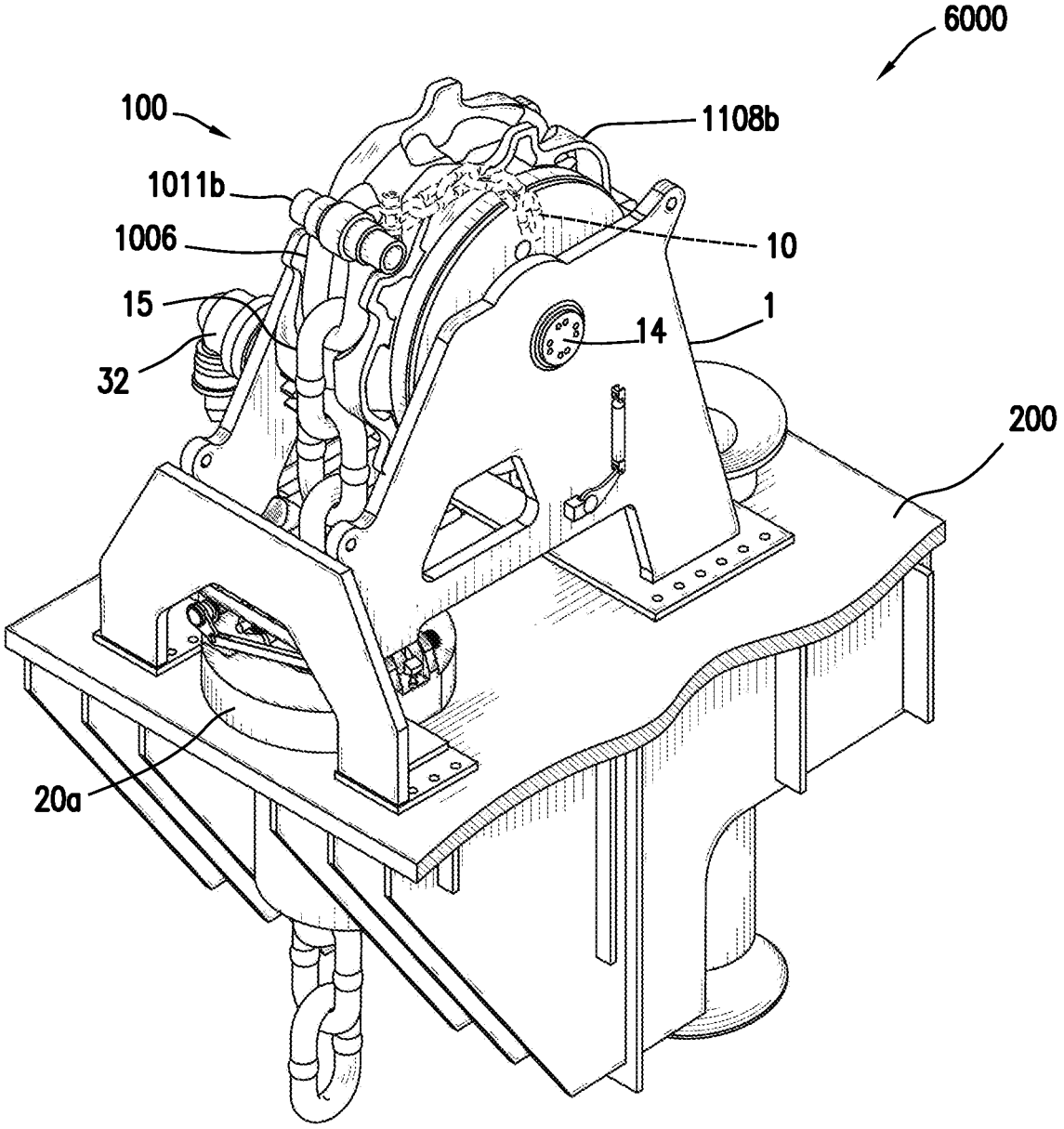
FIG. 9 is a perspective view of a dual chain mooring windlass with a link coupler engaged with a chainwheel thereof.

With reference to FIGS. 7-9, assembly 6000 is depicted, including a rotary chain jack 100 on vessel 200. Rotary chain jack 100 includes dual chainwheel 1108*b*. Assembly 6000 includes link coupler 1000 engaged with anchor chain 15 (including vertical link 15*a* and horizontal link 15*b*), messenger chain 10, and dual chainwheel 1108*b*. In this manner, a continuous chain of two different chain sizes is formed by coupling link coupler 1000 with both messenger chain 10 and anchor chain 15. In operation, pin 1011*b* of link coupler 1000 engages with teeth of dual chainwheel 1108*b*, such as outer tip whelp 1194, to facilitate transition from hauling-in messenger chain 10 to hauling-in anchor chain 15.

Dual chainwheel 1108*b* is rotatably coupled to frame 1 via axel 14. Frame 1 is coupled to a portion of offshore vessel 200, such as the deck. Frame 1 may be coupled to offshore vessel 200 via welding and/or bolting, for example. Drive assemblies 32, such as hydraulic or electric motors, are operatively coupled to gear assembly 6, and gear assembly 6 is operatively coupled to dual chainwheel 1108*b*. Drive assemblies 32 operate to drive gear assembly 6, gear assembly 6 operates to drive dual chainwheel 1108*b*, and dual chainwheel 1108*b* operates to pull-in or pay-out anchor chain 15 and/or messenger chain 10, depending upon the direction of rotation of dual chainwheel 1108*b*.

The rotary chain jack 100 includes rotatable chain stopper 20*a*. Rotatable chain stopper 20*a* rotates about an axis in response to actuator 56, such that actuator 56 initiates rotation of rotatable chain stopper 20*a*. Actuator 56 may be, for example and without limitation, a linear actuator, such as hydraulic or pneumatic cylinder. The operation of actuator 56 and rotatable chain stopper 20*a* are described in more detail in incorporated U.S. patent application Ser. No. 15/603,068.

Figure 11:
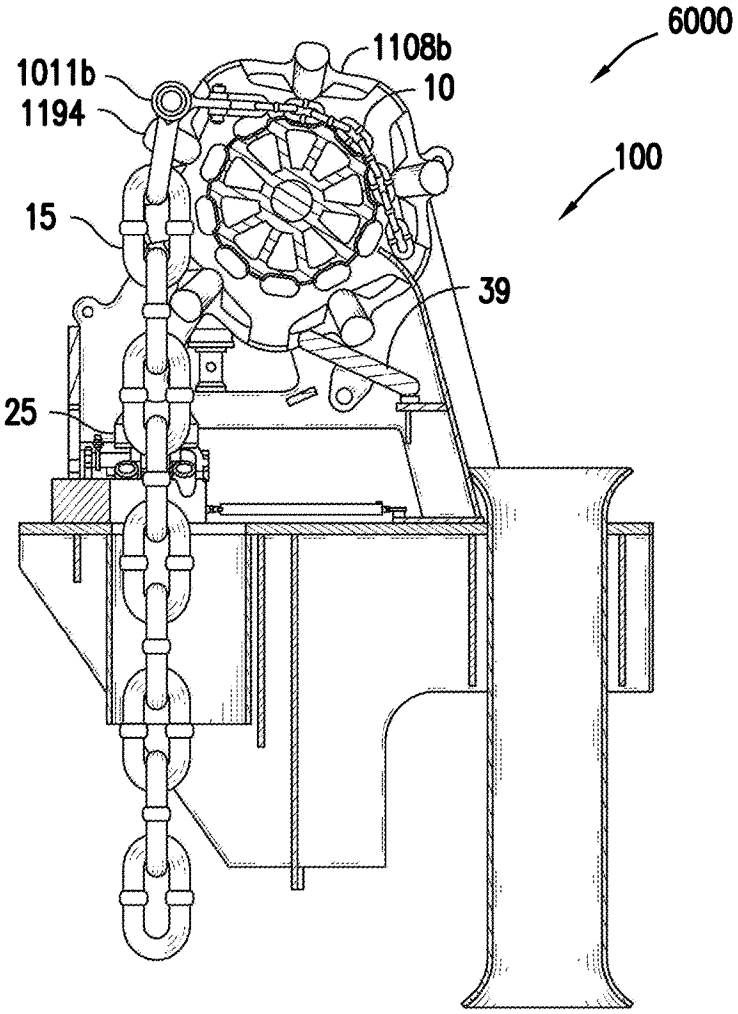
FIG. 11 is a sectional, side view of the dual chain mooring windlass during transition from hauling in the messenger chain to hauling in the mooring chain of FIG. 10.
Figure 10:
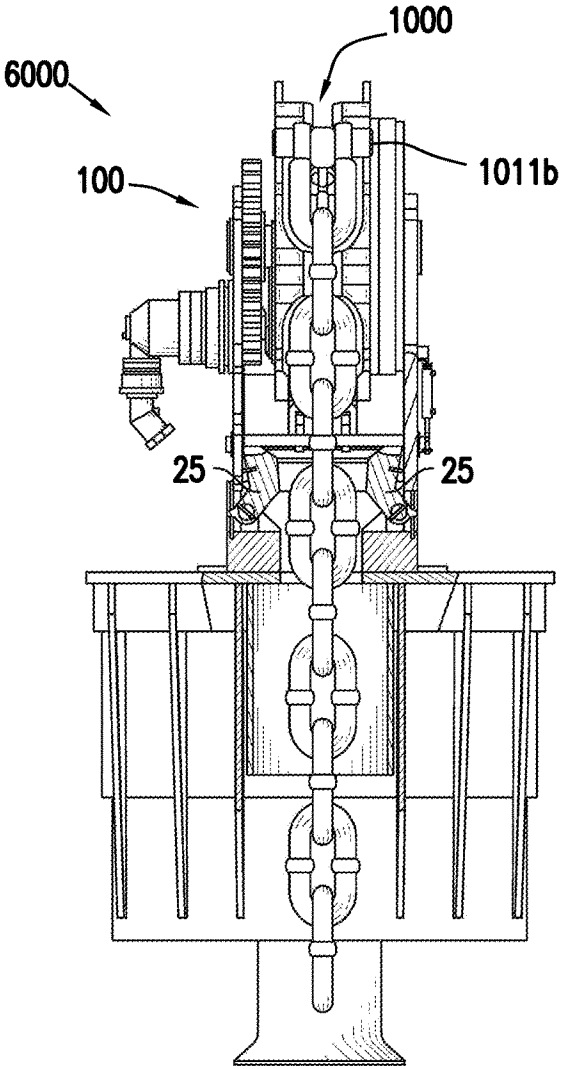
FIG. 10 is a sectional, front view of a dual chain mooring windlass during transition from hauling in a messenger chain to hauling in a mooring chain, including a link coupler engaged with a chainwheel thereof.

FIGS. 10 and 11 depict assembly 6000 during transition from hauling-in messenger chain 10 to hauling-in anchor chain 15. During transition, link coupler 1000 engages outer tip whelp 1194 of dual chainwheel 1108*b*. Outer tip whelp 1194 is shaped to receive link coupler 1000. Also shown in FIGS. 10 and 11 are latches 25, adapted to selectively engage with links of messenger chain 10 and anchor chain 15, and latch cylinder 39 configured to ratchetedly engage with dual chainwheel 1108*b*, the operation of each of which is described in more detail in incorporated U.S. patent application Ser. No. 15/603,068.

One skilled in the art would understand that assemblies 2000, 5000, and 6000, as shown and described herein, are exemplary, and that the link coupler disclosed herein may be incorporated into assemblies of different structure and arrangement.

Method of Coupling and Moving Chains

Certain aspects of the preset disclosure include methods for coupling two lengths of different sized chain together and moving the two lengths of different sized chain together. The method may be implemented using the link couplers, dual chainwheels, and assemblies disclosed herein, such as are shown in FIGS. 1A-11.

The method includes providing a link coupler. The link coupler may be in accordance with those shown and described herein, including a body, a small-chain link coupler coupled with the body at a first end of the body, and a large-chain link coupler coupled with the body at a second end of the body.

The method includes coupling a small chain with the small-chain link coupler. For example, the small-chain link coupler may be disengaged from the body by removing the pin. After disengagement from the body, the small-chain link coupler may be engaged through a coil of a chain link of a small chain, and then re-engaged with the body via the pin.

The method may include coupling a large chain with the large-chain link coupler. For example, the large-chain link coupler may be disengaged from the body by removing the pin. After disengagement from the body, the large-chain link coupler may be engaged through a coil of a chain link of a large chain, and then re-engaged with the body via the pin. The link coupler coupled with the small chain and the large chain forms a chain assembly.

The method may include engaging the chain assembly with a dual chainwheel. The dual chain wheel may include a small wildcat profile and a large wildcat profile.

The method may include hauling-in or paying-out the chain assembly, such as by pulling the messenger chain or releasing the messenger chain.

In some aspects, after coupling the small chain with the small-chain link coupler and before coupling the large chain with the large-chain link coupler, the method includes lowering the small chain with the link coupler coupled therewith into seawater, towards a seabed. In some such aspects, the large chain is an anchor chain coupled with an anchor at the seabed. Once lowered in proximity to the anchor chain, the method may include coupling the anchor chain with the large-chain link coupler, which may be performed underwater.

Hauling-in the chain assembly may include hauling-in the small chain along a path defined by the small wildcat profile until the link coupler engages the large wildcat profile. Engagement of the link coupler with the large wildcat profile results in the delivery of the large chain to the large wildcat profile. Hauling-in then includes hauling-in the large chain along a path defined by the large wildcat profile.

Paying-out the chain assembly may include paying-out the large chain along a path defined by the large wildcat profile until the link coupler engages the large wildcat profile. After engagement of the link coupler with the large wildcat profile, the paying-out includes continuing to pay-out the large chain along the path defined by the large wildcat profile until the link coupler disengages from the large wildcat profile. The disengagement of the link coupler from the large wildcat profile results in the delivery of the small chain to the small wildcat profile. The paying-out continues by paying-out the small chain along a path defined by the small wildcat profile.

Assembly Operation Sequence

The link couplers disclosed herein may be configured into customized sizes, lengths, and shapes, such that the link coupler is capable of smoothly transiting chain mooring lines around a chain wheel, including transitioning from transiting smaller chain link sections to larger chain link sections or transitioning from transiting larger chain link sections to smaller chain link sections.

The link couplers disclosed herein may be used in a variety of loading applications including, but not limited to: (1) applications where a chain wheel is driven by a chain link line, such as in fairlead assemblies; and (2) applications wherein a chain wheel is driving a chain link line, such as in a windlass pulling system. Some exemplary fairlead assemblies and loading applications with which the link couplers disclosed herein by be used include those shown and described in U.S. Pat. Nos. 5,845,893; 8,915,205; 9,126,659; and U.S. Patent Publication No. 2018/0086421, the entireties of each of which is incorporated herein by reference.

Chain Wheel—Driven Mode

Figure 12:
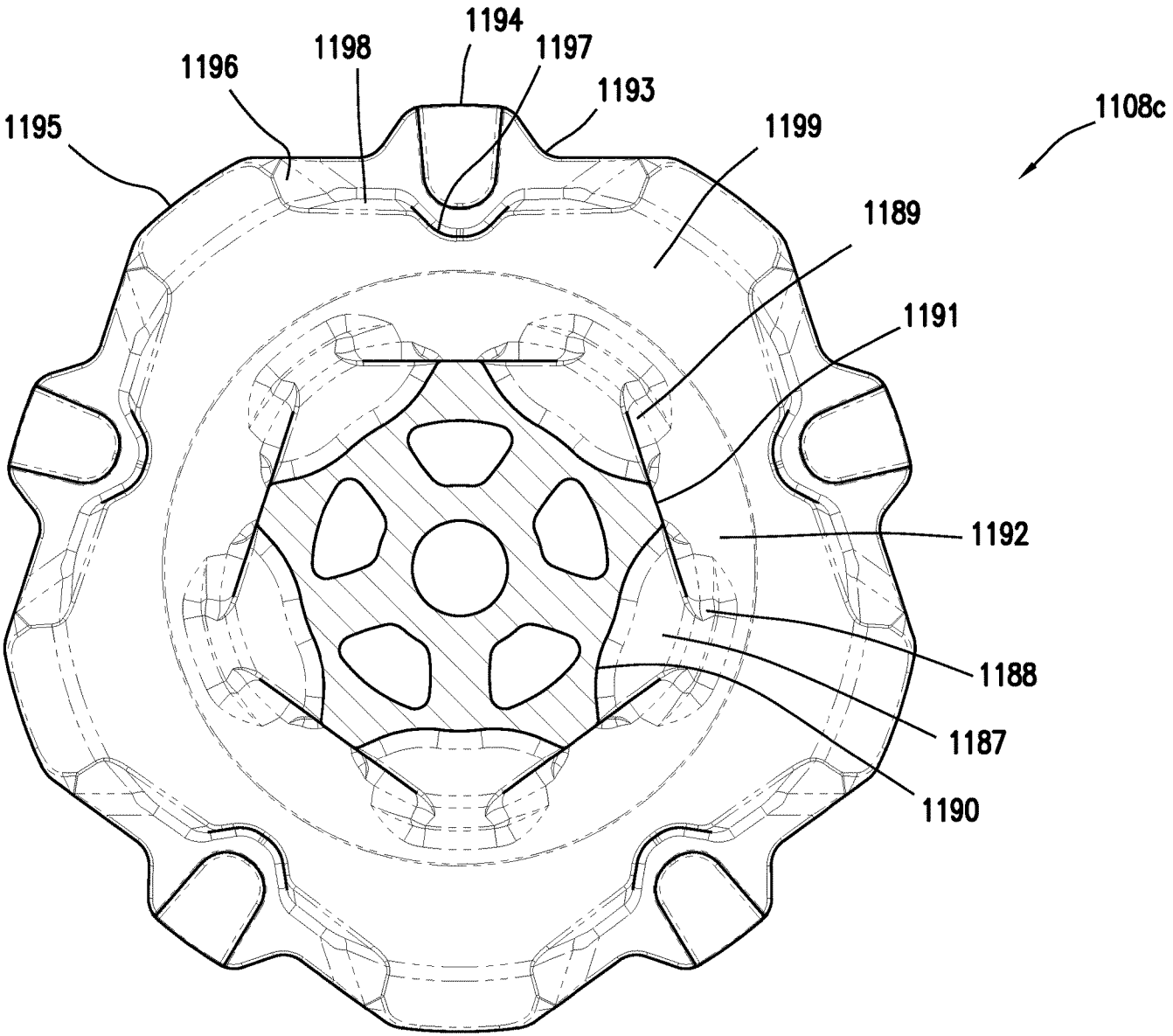
FIG. 12 depicts a driven mode chain wheel.

FIG. 12 depicts a chain wheel suitable for use in driven mode. With reference to FIG. 12, certain features of chain wheel 1108*c* will be described; however, the function of such features, including the interaction of the features with the link coupler will be described in further detain with reference to FIGS. 13A-31B.

Chain wheel 1108*c* includes outer interior wall 1199, outer link pocket flat bed 1198, outer pocket pit 1197, outer link pocket trap end 1196, outer teeth 1195, outer whelp tip 1194, and outer whelp base 1193. Thus, the large wildcat profile of chain wheel 1108*c* is at least partially defined by outer interior wall 1199, outer link pocket flat bed 1198, outer pocket pit 1197, outer link pocket trap end 1196, outer teeth 1195, outer whelp tip 1194, and outer whelp base 1193.

Chain wheel 1108*c* includes middle interior wall 1192, inner interior wall 1187, inner pocket flat bed 1191, and inner bottom groove 1190. Chain wheel 1108*c* also includes inner pocket trap end 1189. Thus, the middle interior wall 1192, inner interior wall 1187, inner pocket flat bed 1191, inner bottom groove 1190, and inner pocket trap end 1189 at least partially define the small wildcat profile of chain wheel 1108*c*.

Figure 13A:
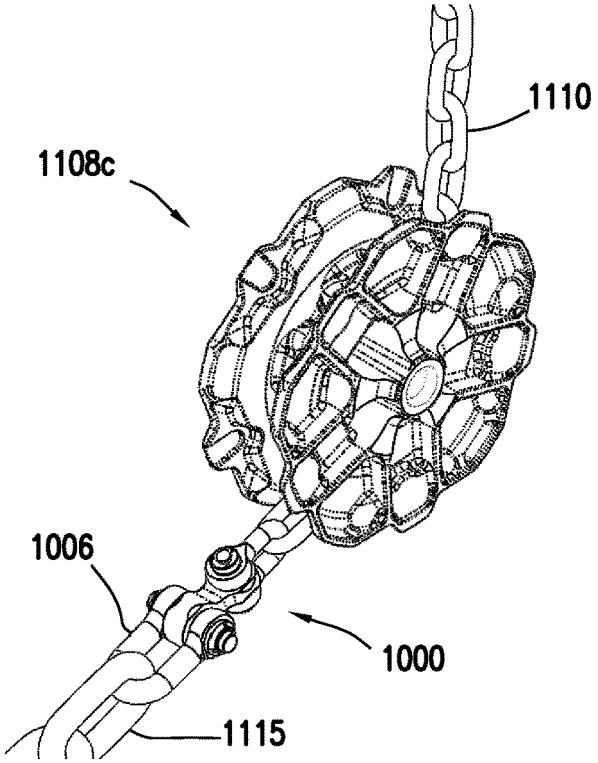
FIGS. 13A and 13B depict an assembly of a link coupler coupled with a small and large chain, with the assembly engaged with a chain wheel in a perpendicular orientation.
Figure 13B:
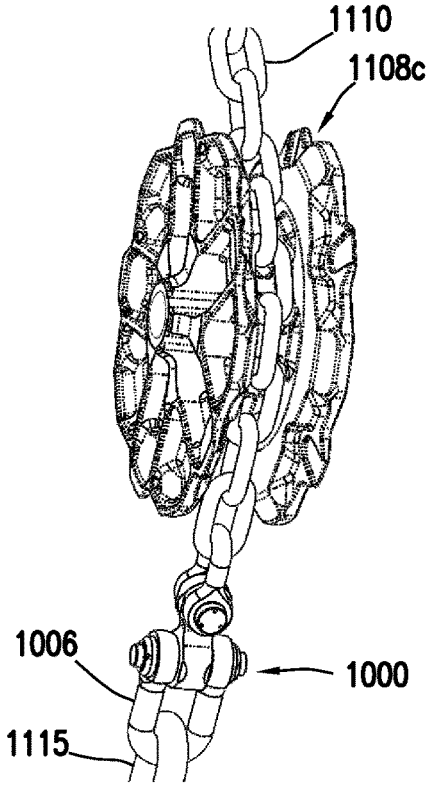
Figure 14A:
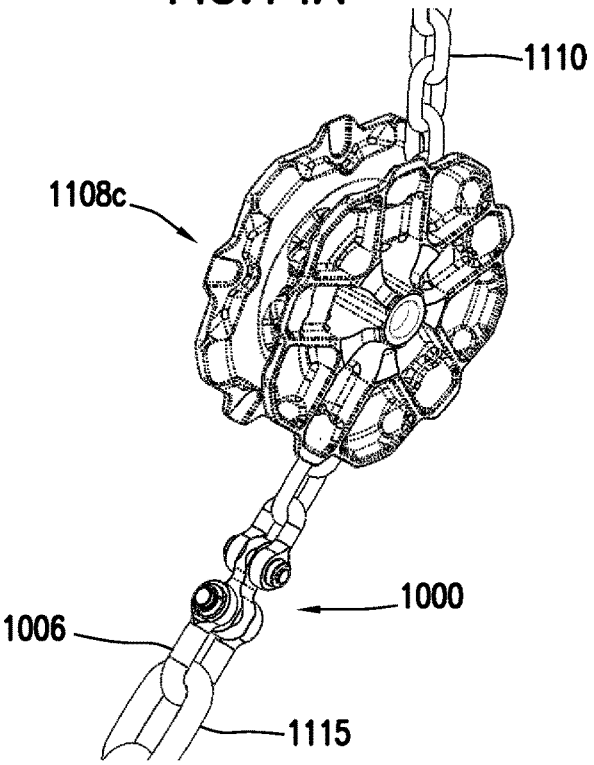
FIGS. 14A and 14B depict an assembly of a link coupler coupled with a small and large chain, with the assembly engaged with a chain wheel in a parallel orientation.
Figure 14B:
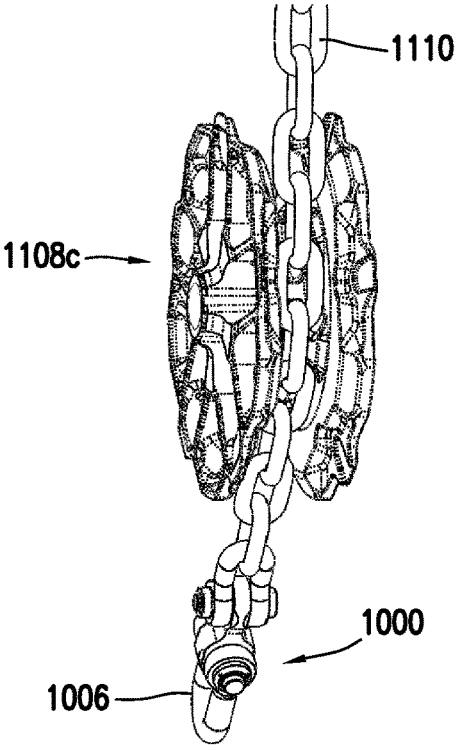

Chain wheel 1108*c* may be operated in driven mode, and the link coupler may be used in any orientation, which allows for use of larger D-links interfacing with the chain wheel 1108*c* either perpendicular (horizontal link) to, or parallel (vertical link) with the chain wheel plane. As used herein, "perpendicular" and "parallel" are denoted with respect to the larger D-link plane relative to the orientation of the chain wheel plane. FIGS. 13A and 13B depict chain wheel 1108*c* in driven mode, engaged with small chain 1110 and large chain 1115, which are coupled with link coupler 1000. In FIGS. 13A and 13B, large-chain link coupler 1006 is a large D-link oriented perpendicular to the plane within which the chain wheel 1108*c* rotates. FIGS. 14A and 14B depict chain wheel 1108*c* in driven mode, engaged with small chain 1110 and large chain 1115, which are coupled with link coupler 1000. In FIGS. 14A and 14B, large-chain link coupler 1006 is a large D-link oriented parallel to the plane within which the chain wheel 1108*c* rotates.

Operation Sequence—Chain Wheel in Driven Mode with Perpendicular D-Link

FIGS. 15A-23B illustrate the steps of interfacing between small chain 1110, link coupler 1000, large chain 1115, and chain wheel 1108*c*, with large-chain link coupler 1006 in the perpendicular orientation, and with engagement transitioning from engagement with small chain 1110 to engagement with large chain 1115.

Figure 15A:
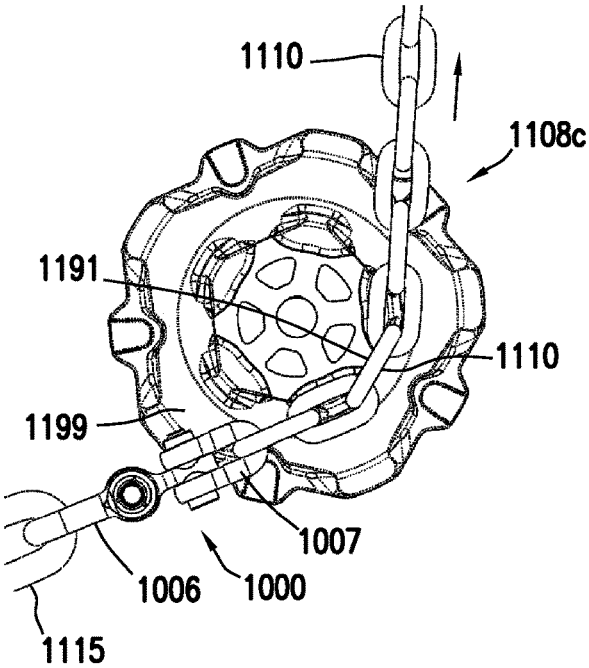
FIGS. 15A-23B depict an assembly of a link coupler coupled with a small and large chain, with the assembly engaged with a chain wheel in a perpendicular orientation as the assembly moves through the chain wheel in driven mode.
Figure 15B:
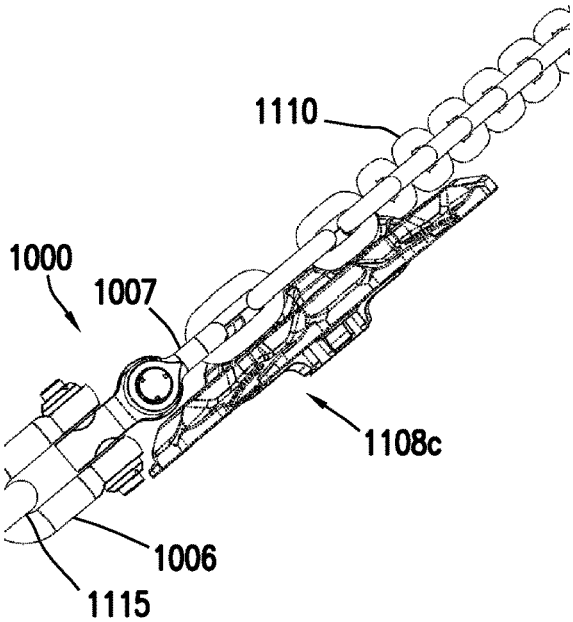

With reference to FIGS. 15A and 15B, before link coupler 1000 enters into engagement with chain wheel 1108*c*, small chain link 1110 seats on inner pocket flat bed 1191, with small chain coupler 1007 clear of outer interior wall 1199.

Figure 16A:
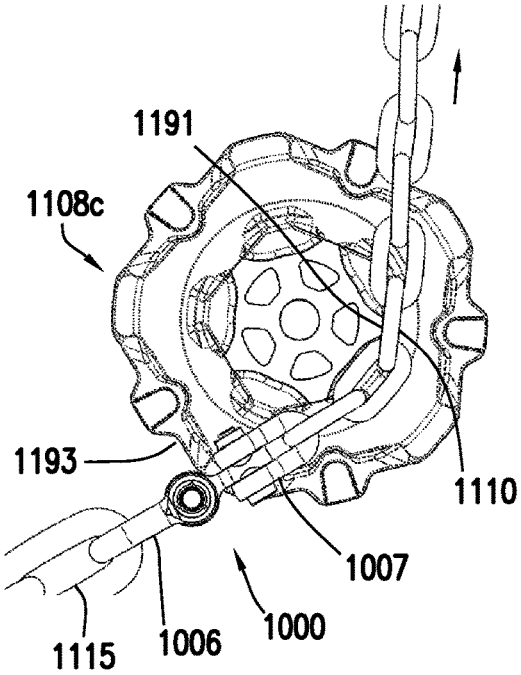
Figure 16B:
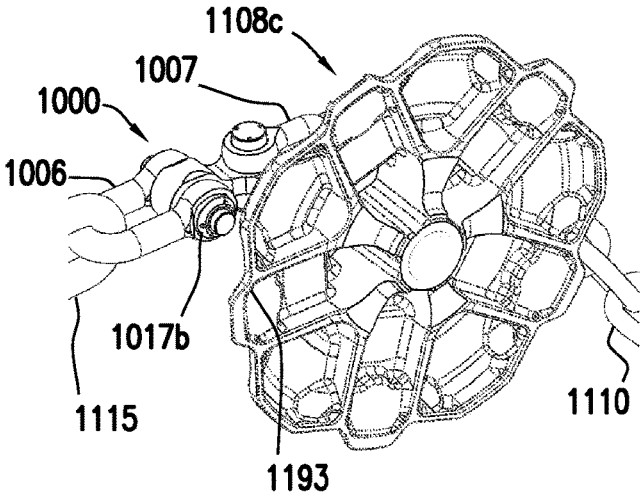

With reference to FIGS. 16A and 16B, as chain wheel 1108*c* rotates, small chain 1110 continues to interface with inner pocket flat bed 1191, while pin head 1017*b* (or nut 1019*b* or other portion of pin 1011*b*) of large chain coupler 1006 approaches towards outer whelp base 1193.

Figure 17A:
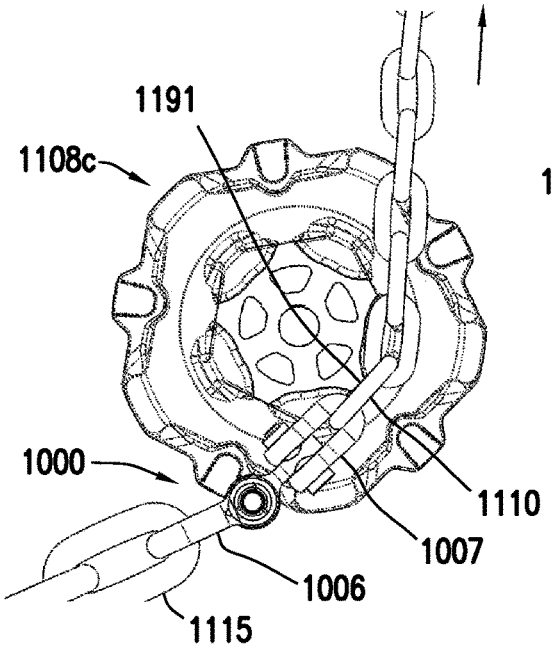
Figure 17B:
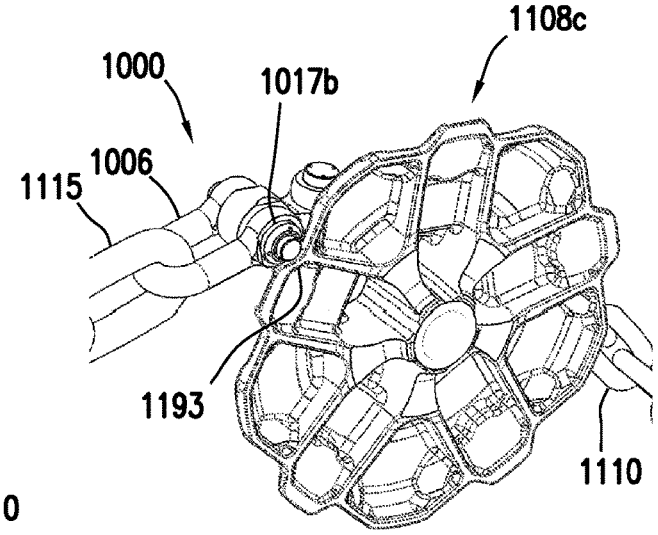

With reference to FIGS. 17A and 17B, pin head 1017*b* (or nut 1019*b* or another portion of pin 1011*b*) engages with outer whelp base 1193, while small chain 1110 is still seated inner pocket flat bed 1191.

Figure 18A:
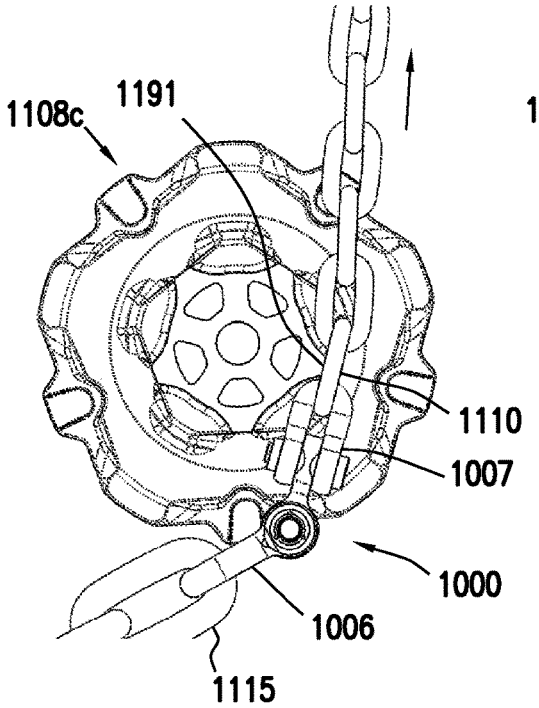
Figure 18B:
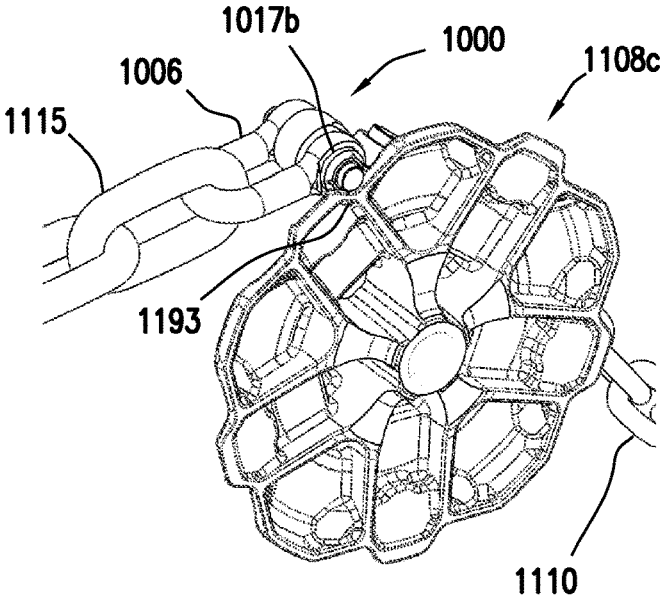

With reference to FIGS. 18A and 18B, the assembly stays in substantially the same configuration as in FIGS. 17A and 17B while the chain wheel 1108*c* continues to rotate.

Figure 19A:
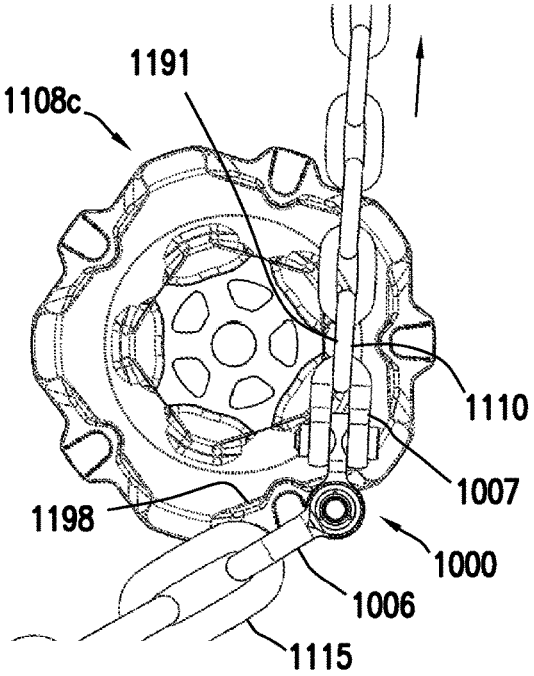
Figure 19B:
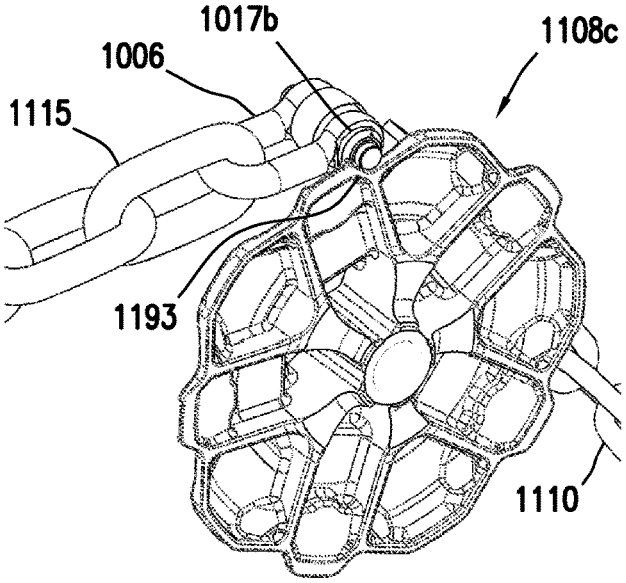

With reference to FIGS. 19A and 19B, pin head 1017*b* (or nut 1019*b* or another portion of pin 1011*b*) engages with outer whelp base 1193, while small chain 1110 is departing from inner pocket flat bed 1191, and large-chain link coupler 1006 is approaching towards outer link pocket flat bed 1198.

Figure 20A:
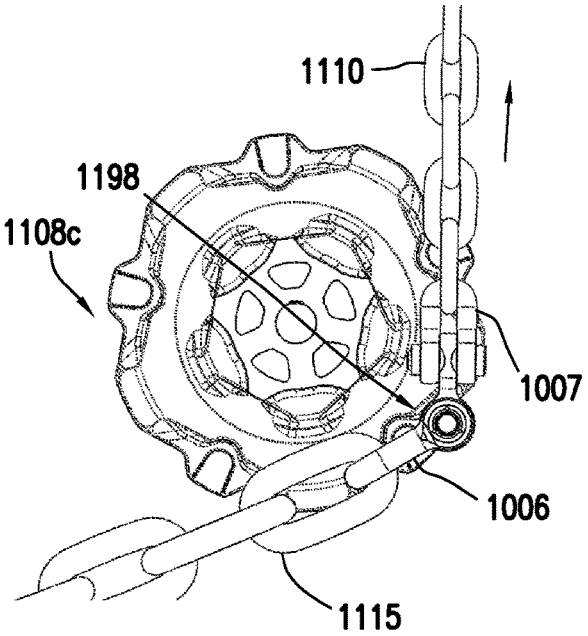
Figure 20B:
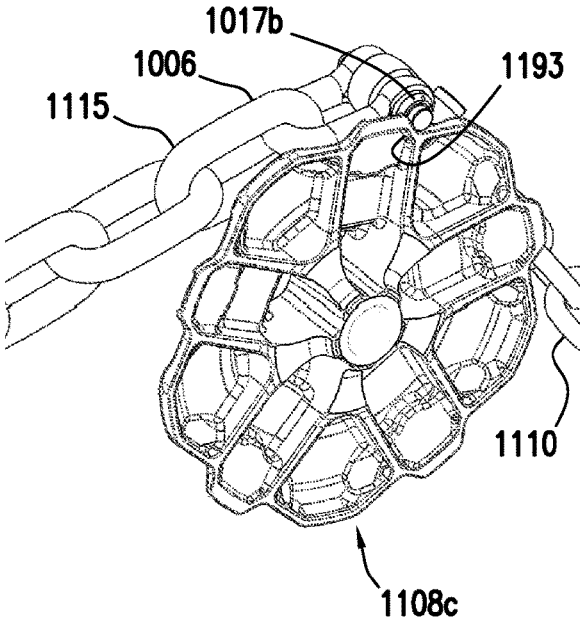

With reference to FIGS. 20A and 20B, large-chain link coupler 1006 engages outer link pocket flat bed 1198, while pin head 1017*b* (or nut 1019*b* or another portion of pin 1011*b*) is still engaged with outer whelp base 1193.

Figure 21A:
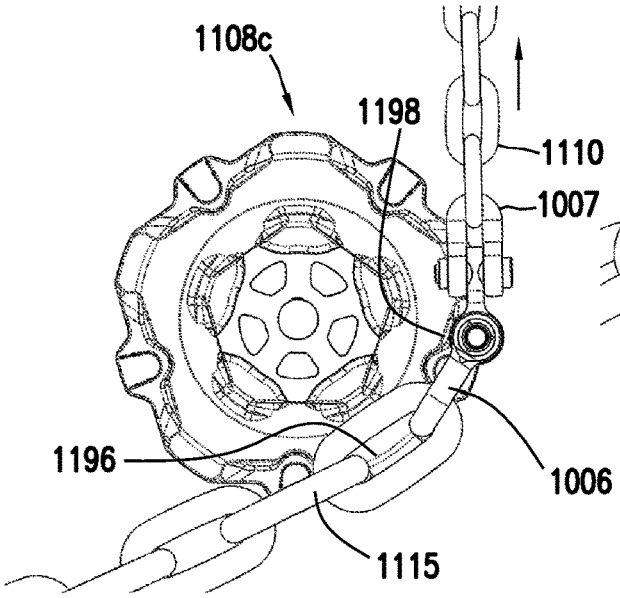
Figure 21B:
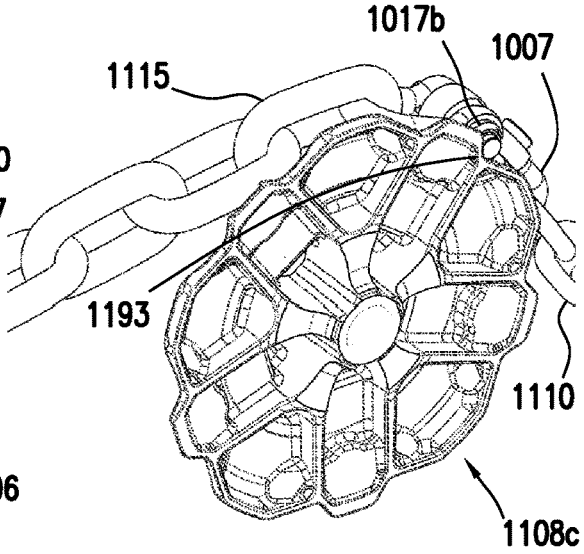

With reference to FIGS. 21A and 21B, chain wheel 1108*c* rotates further, while large chain link 1115 approaches towards outer link pocket trap end 1196.

Figure 22A:
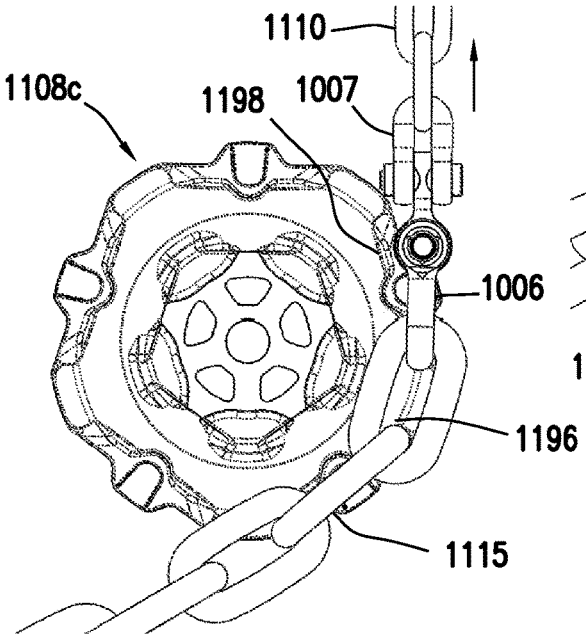
Figure 22B:
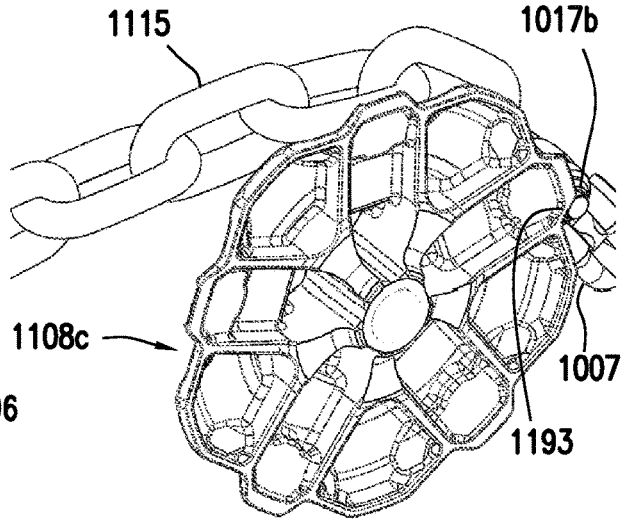

With reference to FIGS. 22A and 22B, large chain 1115 engages outer link pocket trap end 1196, while large-chain link coupler 1006 is still engaged with outer link pocket flat bed 1198. Also, pin head 1017*b* (or nut 1019*b* or another portion of pin 1011*b*) departs from engagement with outer whelp base 1193.

Figure 23A:
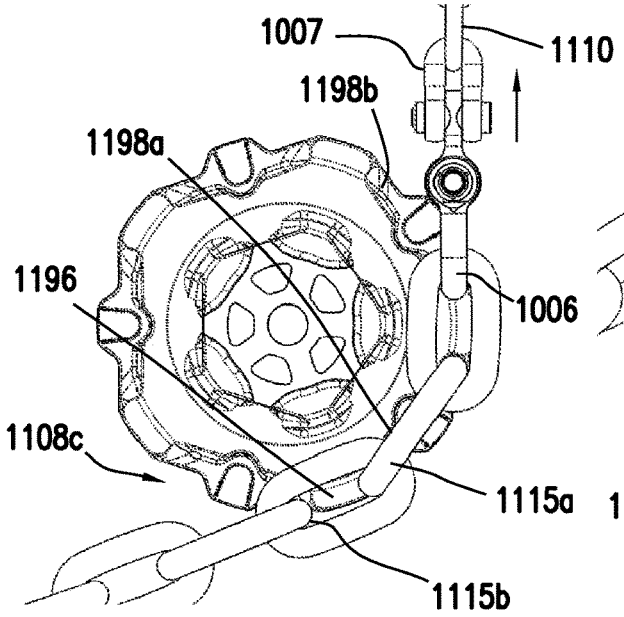
Figure 23B:
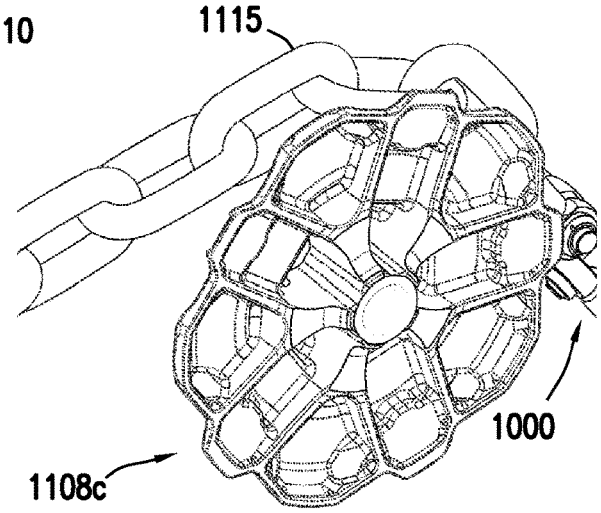

With reference to FIGS. 23A and 23B, large chain link 1115*a* fully seats on outer link pocket flat bed 1198, while large-chain link coupler 1006 departs away from outer link pocket flat bed 1198. In operation, the next large chain link 1115*b* approaches to the next outer link pocket flat bed 1198 of chain wheel 1108*c*.

Operation Sequence—Chain Wheel in Driven Mode with Parallel D-Link

FIGS. 24A-31B illustrate the steps of interfacing between small chain 1110, link coupler 1000, large chain 1115, and chain wheel 1108*c*, with large-chain link coupler 1006 in the parallel orientation, and with engagement transitioning from engagement with small chain 1110 to engagement with large chain 1115.

Figure 24A:
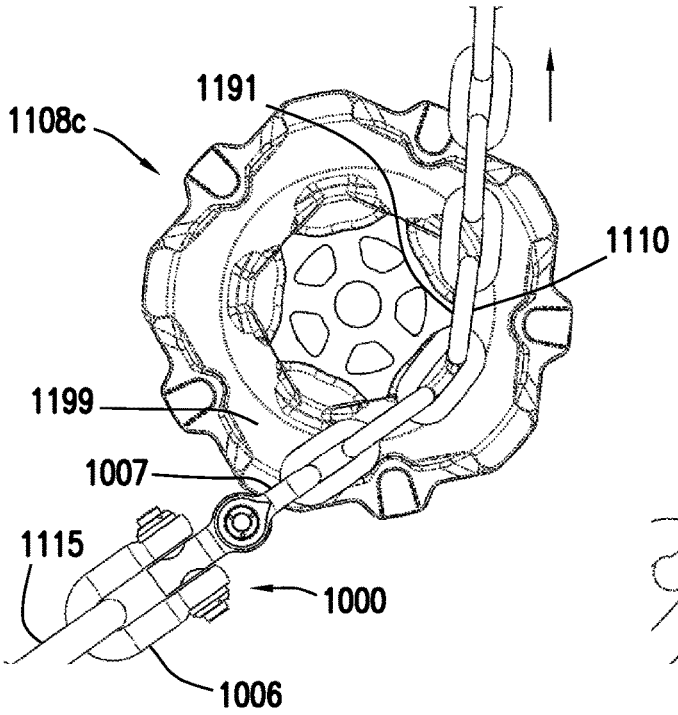
FIGS. 24A-31B depict an assembly of a link coupler coupled with a small and large chain, with the assembly engaged with a chain wheel in a parallel orientation as the assembly moves through the chain wheel in driven mode.
Figure 24B:
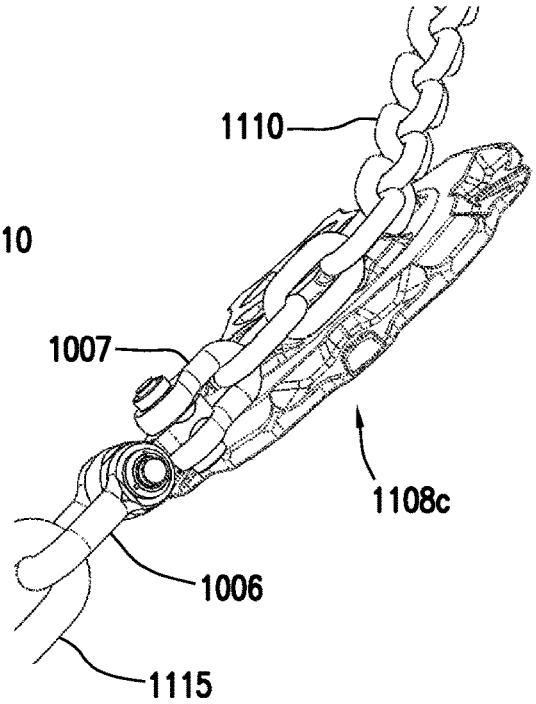

With reference to FIGS. 24A and 24B, as link coupler 1000 begins to enter chain wheel 1108*c*, smaller chain link 1110 seats on inner pocket flat bed 1191, and small-chain link coupler 1006 clears outer interior wall 1199.

Figure 25A:
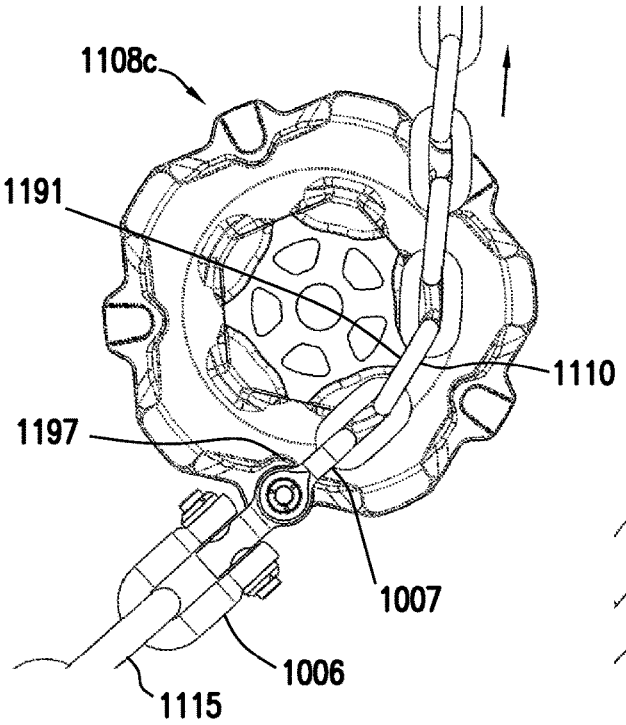
Figure 25B:
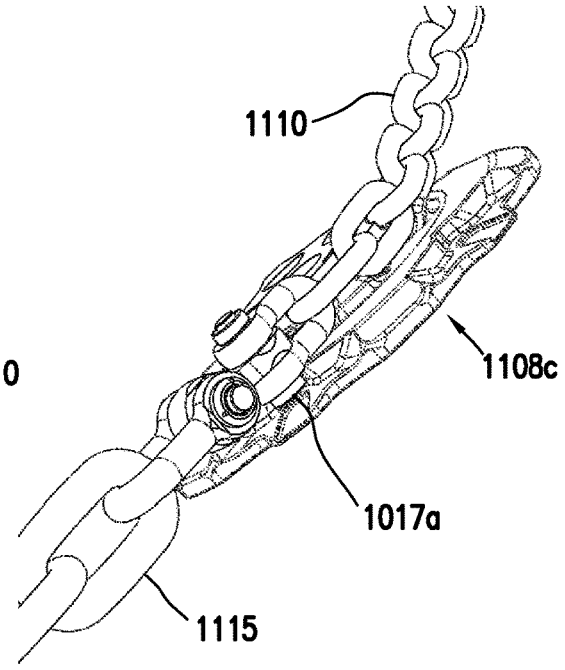

With reference to FIGS. 25A and 25B, as chain wheel 1108*c* rotates, small chain link 1110 interfaces with inner pocket flat bed 1191, and pin head 1017*a* (or nut 1019*a* or another portion of pin 1011*a*) approaches towards outer pocket pit 1197.

Figure 26A:
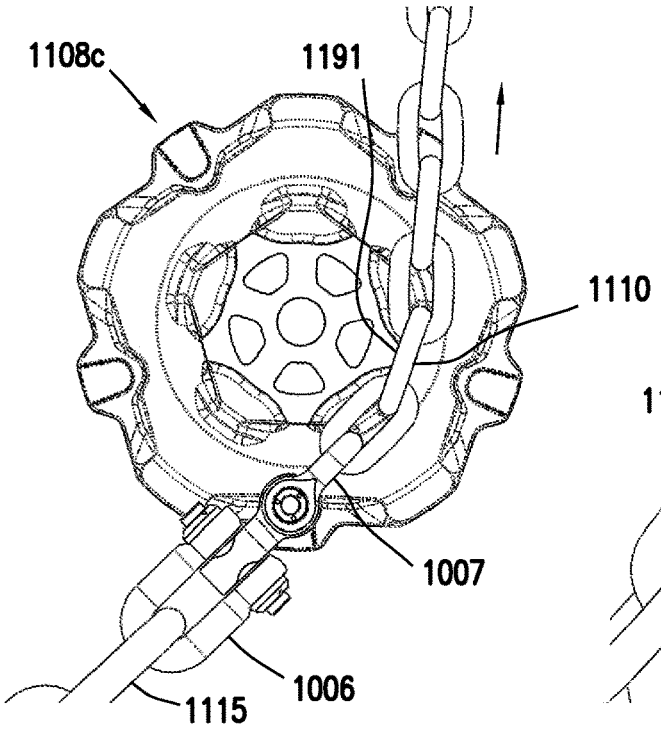
Figure 26B:
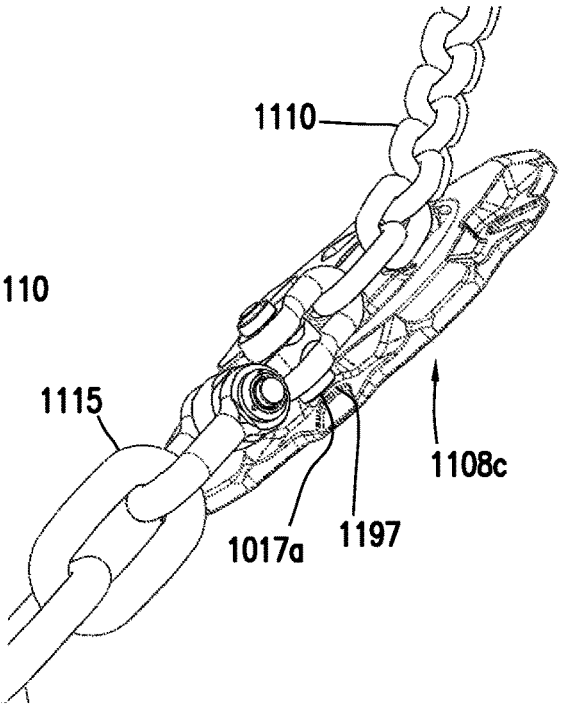

With reference to FIGS. 26A and 26B, pin head 1017*a* (or nut 1019*a* or another portion of pin 1011*a*) engages with outer pocket pit 1197, while small chain link 1110 remains seated on inner pocket flat bed 1191.

Figure 27A:
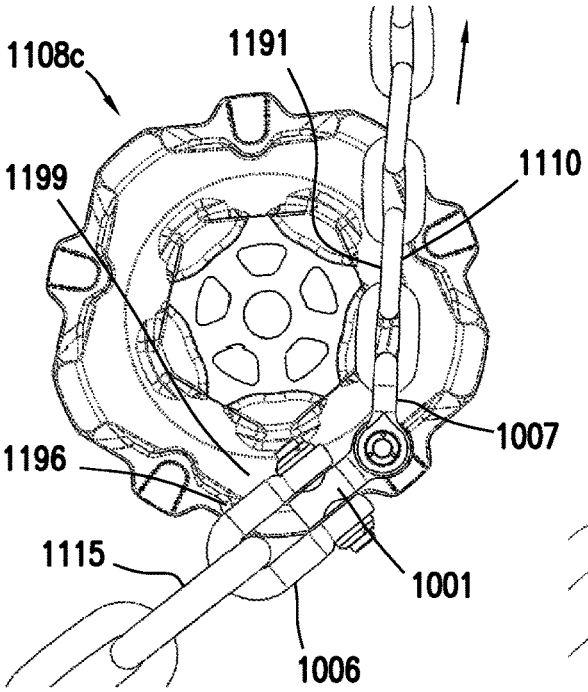
Figure 27B:
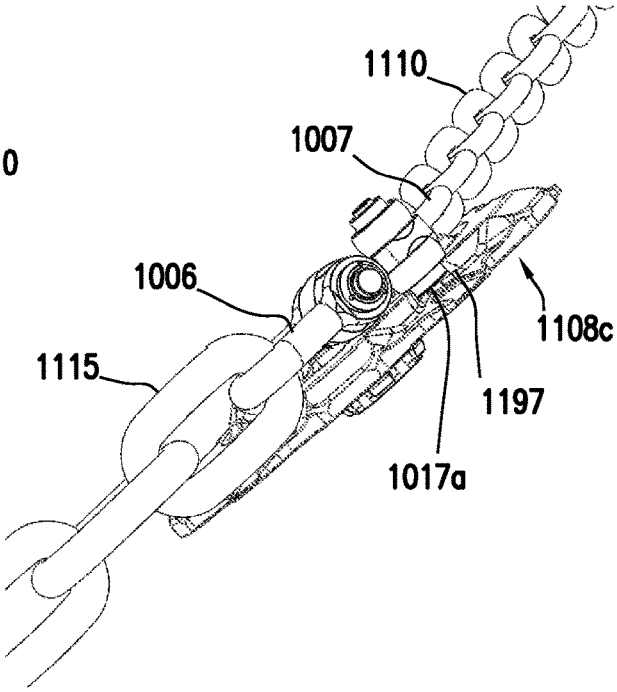

With reference to FIGS. 27A and 27B, with pin head 1017*a* (or nut 1019*a* or another portion of pin 1011*a*) engaged with outer pocket pit 1197, small chain link 1110 departs from inner pocket flat bed 1191, and large chain links 1115 approach towards outer link pocket trap end 1196.

Figure 28A:
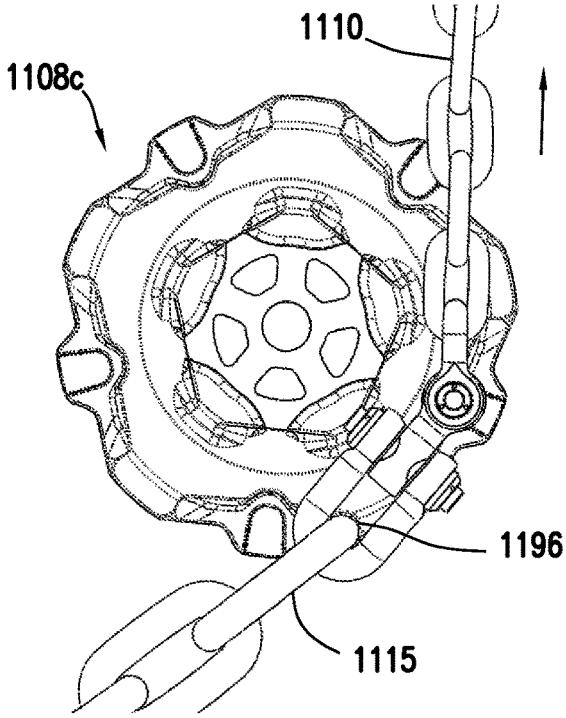
Figure 28B:
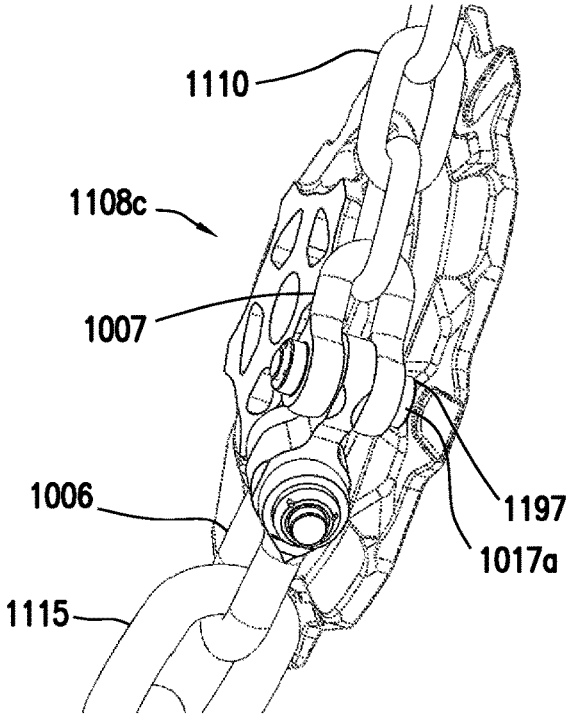

With reference to FIGS. 28A and 28B, large chain link 1115 engages outer link pocket trap end 1196, while pin head 1017*a* (or nut 1019*a* or another portion of pin 1011*a*) is engaged with outer pocket pit 1197.

Figure 29A:
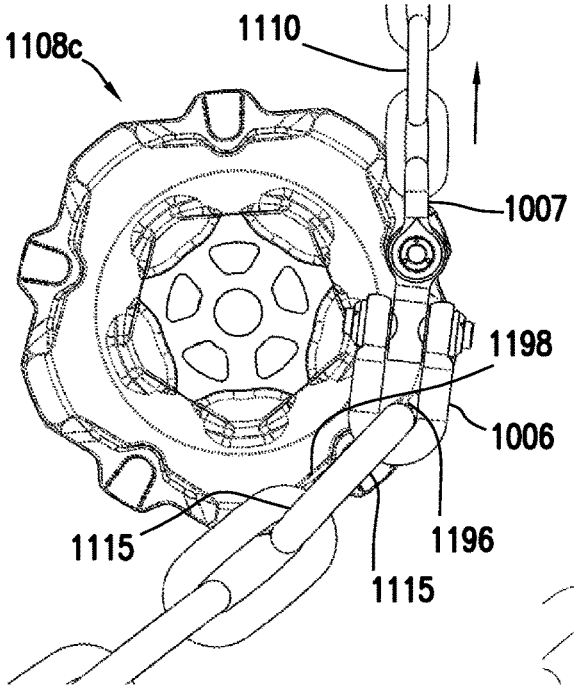
Figure 29B:
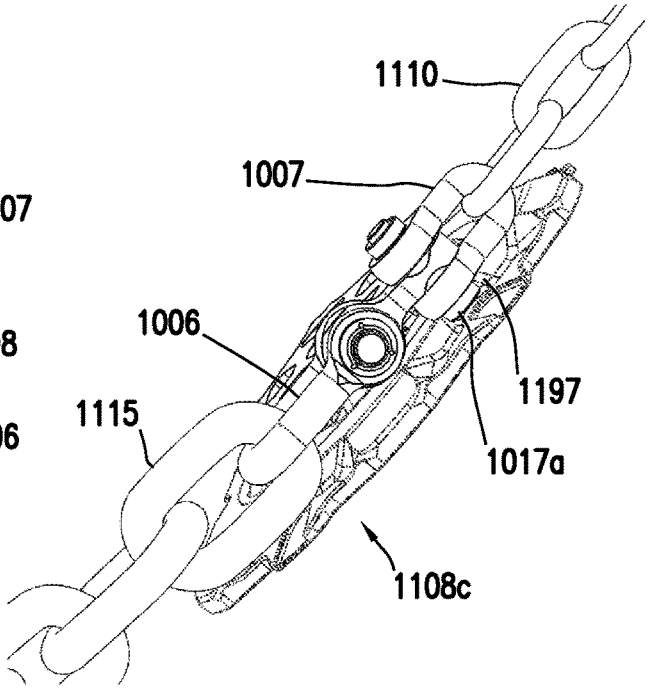

With reference to FIGS. 29A and 29B, while large chain link 1115 interfaces with outer link pocket trap end 1196, pin head 1017*a* (or nut 1019*a* or another portion of pin 1011*a*) depart away from pocket pit 1197 and larger chain link 1115 approaches towards outer link pocket flat bed 1198.

Figure 30A:
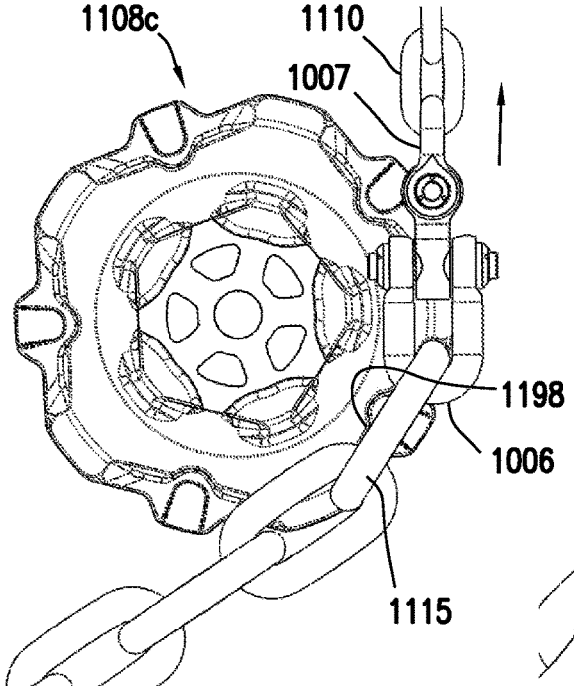
Figure 30B:
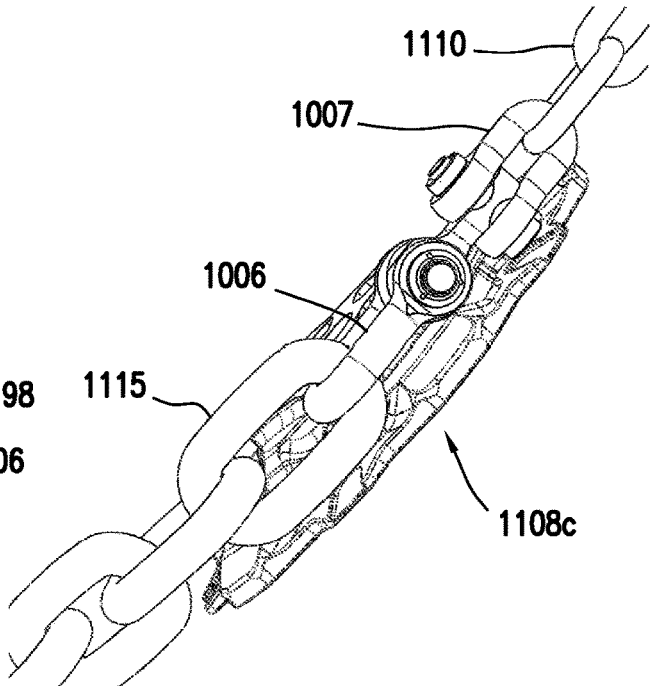

With reference to FIGS. 30A and 30B, large chain link 1115 engages with outer link pocket flat bed 1198.

Figure 31B:
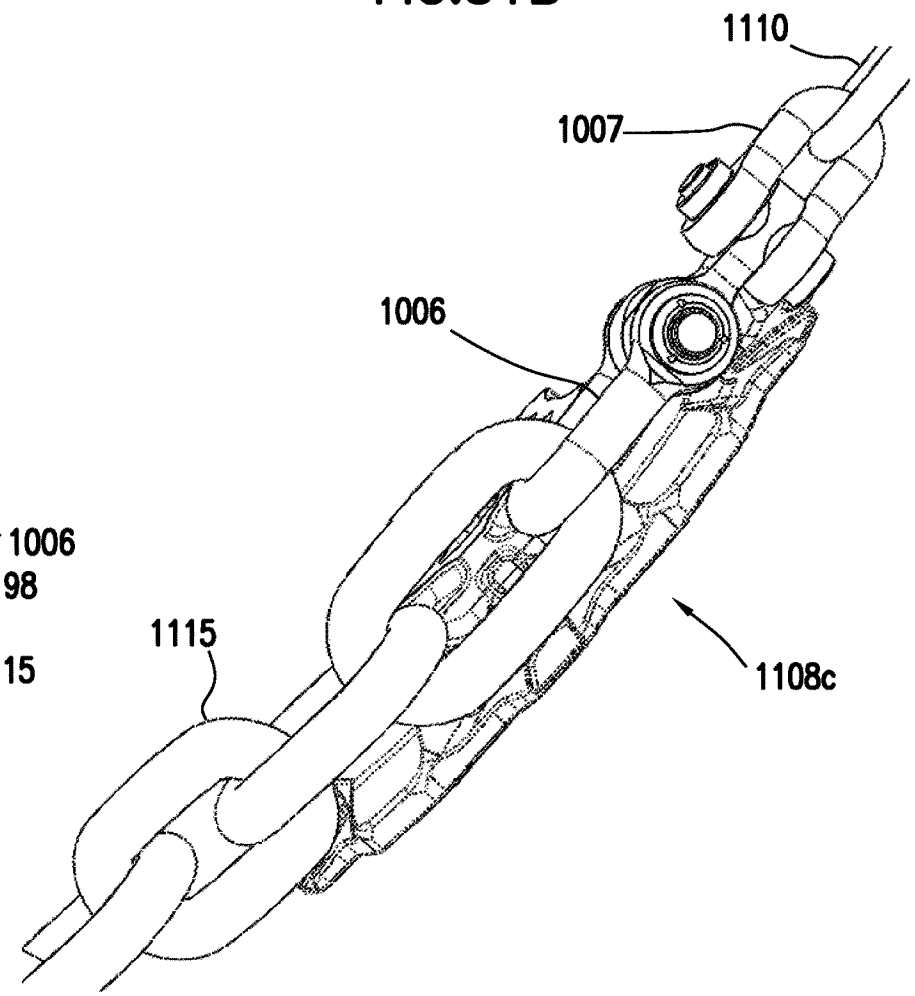
Figure 31A:
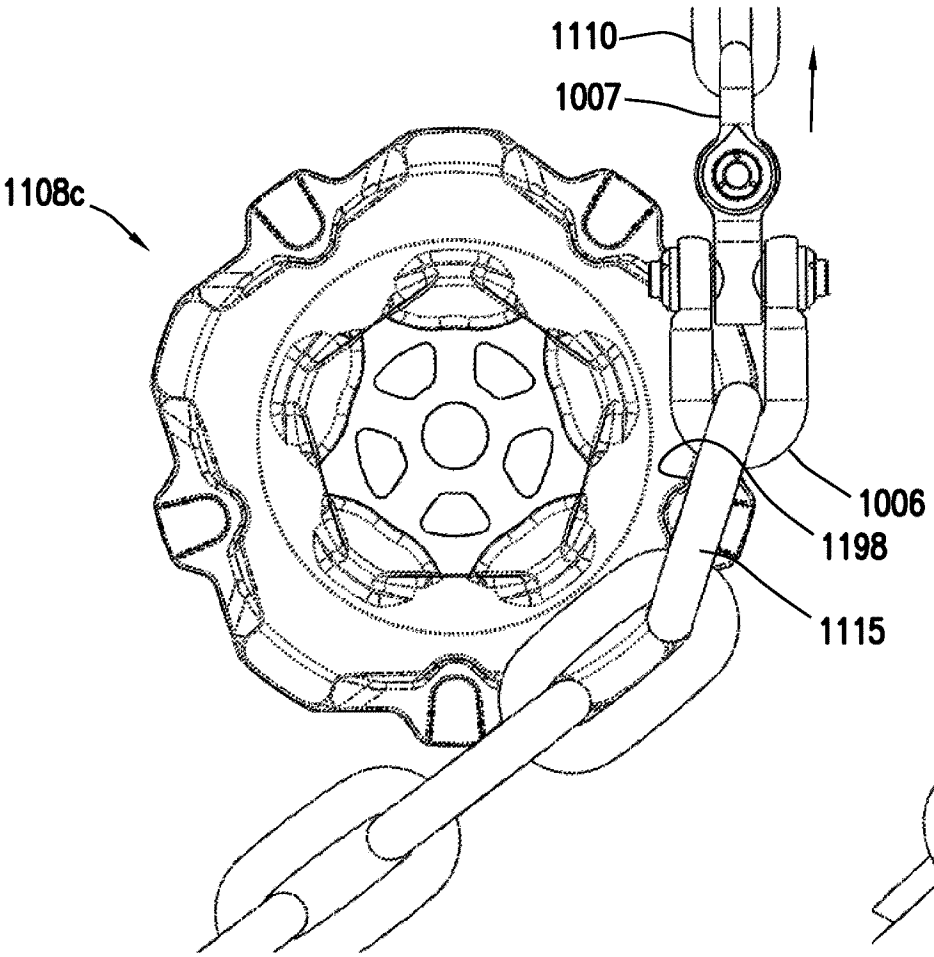

With reference to FIGS. 31A and 31B, the assembly of chain wheel 1108*c*, small chain 1110, large chain 1115, and link coupler 1000 is in the same continuation of in FIGS. 30A and 30B, with chain wheel 1108*c* further rotated, and link coupler 1000 exiting engaging with chain wheel 1108*c*.

In operation, within driven mode, loads are transferred (e.g., always or substantially always transferred) from chain links (1110 and 1115) to chain wheel 1108*c*. In the perpendicular orientation of the driven mode, as shown in FIGS. 15A-23B, the sequence of interfacing features is essentially as follows: (1) the small chain links 1110 interfaces with the inner pocket flat bed 1191; (2) the pin head 1017*b* (or nut 1019*b* or another portion of pin 1011*b*) interfaces with the outer whelp base 1193; (3) the large-chain link coupler 1006 interfaces with the outer link pocket flat bed 1198; (4) a large chain link 1115 interfaces with the outer link pocket trap end 1196; and (5) the large chain link 1115 interfaces with the outer link pocket flat bed 1198. In the parallel orientation of the driven mode, as shown in FIGS. 24A-31B, the sequence of interfacing features is essentially as follows: (1) the small chain links 1110 interfaces with the inner pocket flat bed 1191; (2) the pin head 1017*a* (or nut 1019*a* or another portion of pin 1011*a*) interfaces with the outer pocket pit 1197; (3) a large chain link 1115 interfaces with the outer link pocket trap end 1196; (4) the large chain link 1115 interfaces with the outer link pocket trap end 1196; and (5) the large chain link 1115 interfaces with the outer link pocket flat bed 1198.

Chain Wheel—Driving Mode

Figure 32:
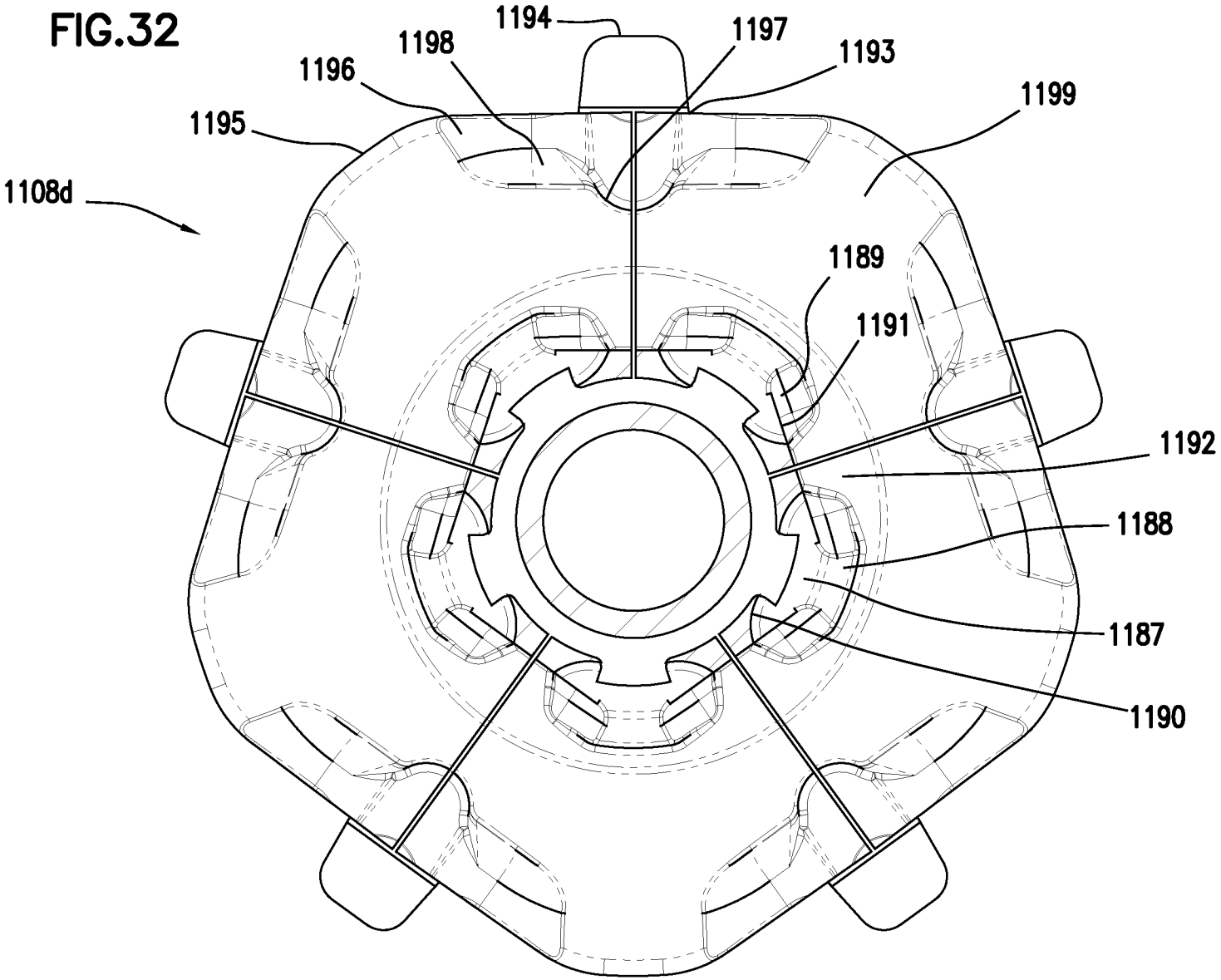
FIG. 32 depicts a driving mode chain wheel.

FIG. 32 depicts a chain wheel in driving mode. With reference to FIG. 32, certain features of chain wheel 1108*d* will be described; however, the function of such features, including the interaction of the features with the link coupler will be described in further detain with reference to FIGS. 33A-51B.

Chain wheel 1108*d* includes outer interior wall 1199, outer link pocket flat bed 1198, outer pocket pit 1197, outer link pocket trap end 1196, outer teeth 1195, outer whelp tip 1194, and outer whelp base 1193. Thus, the large wildcat profile of chain wheel 1108*d* is at least partially defined by outer interior wall 1199, outer link pocket flat bed 1198, outer pocket pit 1197, outer link pocket trap end 1196, outer teeth 1195, outer whelp tip 1194, and outer whelp base 1193.

Chain wheel 1108*d* includes middle interior wall 1192, inner interior wall 1187, inner pocket flat bed 1191, and inner bottom groove 1190. Chain wheel 1108*d* also includes inner pocket trap end 1189. Thus, the middle interior wall 1192, inner interior wall 1187, inner pocket flat bed 1191, inner bottom groove 1190, and inner pocket trap end 1189 at least partially define the small wildcat profile of chain wheel 1108*d*.

Chain wheel 1108*d* may be operated in driven mode, and the link coupler may be used in any orientation, which allows for use of larger D-links interfacing with the chain wheel 1108*d* either perpendicular (horizontal link) to, or parallel (vertical link) with the chain wheel plane. As used herein, "perpendicular" and "parallel" are denoted with respect to the larger D-link plane relative to the orientation of the chain wheel plane. FIGS. 13A and 13B depict chain wheel 1108*d* in driven mode, engaged with small chain 1110 and large chain 1115, which are coupled with link coupler 1000. In FIGS. 13A and 13B, large-chain link coupler 1006 is a large D-link oriented perpendicular to the plane within which the chain wheel 1108*d* rotates. FIGS. 14A and 14B depict chain wheel 1108*d* in driven mode, engaged with small chain 1110 and large chain 1115, which are coupled with link coupler 1000. In FIGS. 14A and 14B, large-chain link coupler 1006 is a large D-link oriented parallel to the plane within which the chain wheel 1108*d* rotates.

Operation Sequence—Chain Wheel in Driving Mode

Chain wheel 1108*d*, when operating in driving mode, works (or only works) with perpendicular interfacing, with the higher, outer whelp tip 1194 on the chain wheel 1108*d*, which are reinforced to accommodate larger torsional loads. The raised outer whelp tips 1194 may be integrated into the chain wheel 1108*d* casting, or may be standalone parts that are assembled onto the chain wheel 1108*c* (as is shown in FIG. 32). The chain line wrap angle of the chain wheel 1108*d* may be greater or equal to 135° in order to prevent chain links from "jumping" off from the chain wheel 1108*d*. In operation, within the driving mode, loads are transferred (e.g., always or substantially always transferred) from the chain wheel 1108*d* to chain links (1110 and 1115).

Figure 33A:
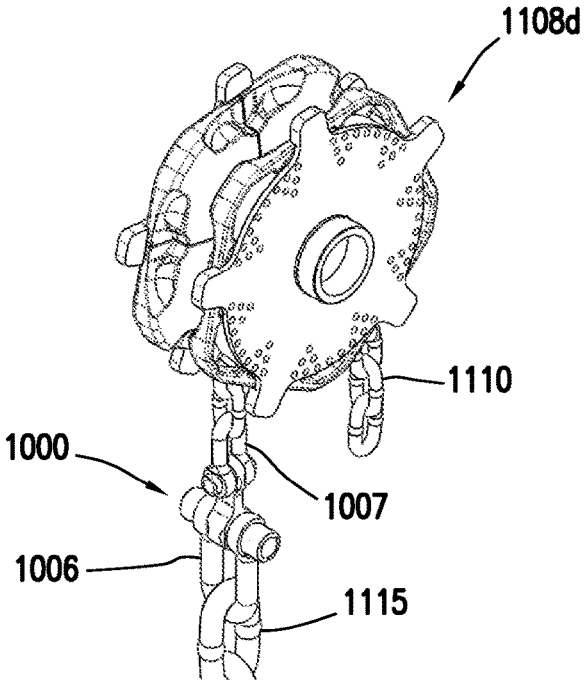
FIGS. 33A-51B depict an assembly of a link coupler coupled with a small and large chain, with the assembly engaged with a chain wheel in a perpendicular orientation as the assembly moves through the chain wheel in driving mode.
Figure 33B:
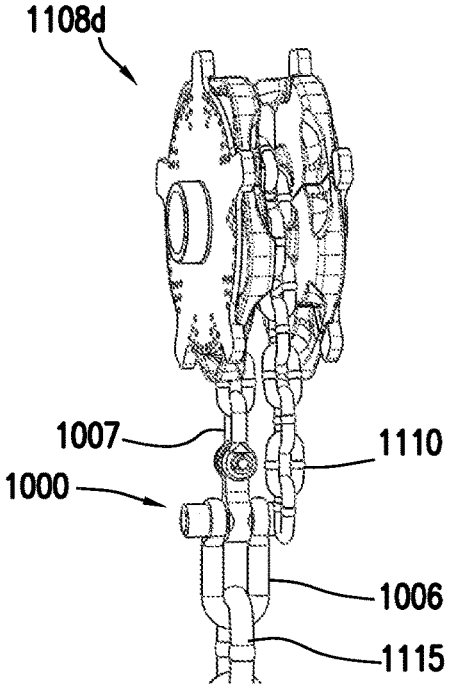
Figure 34A:
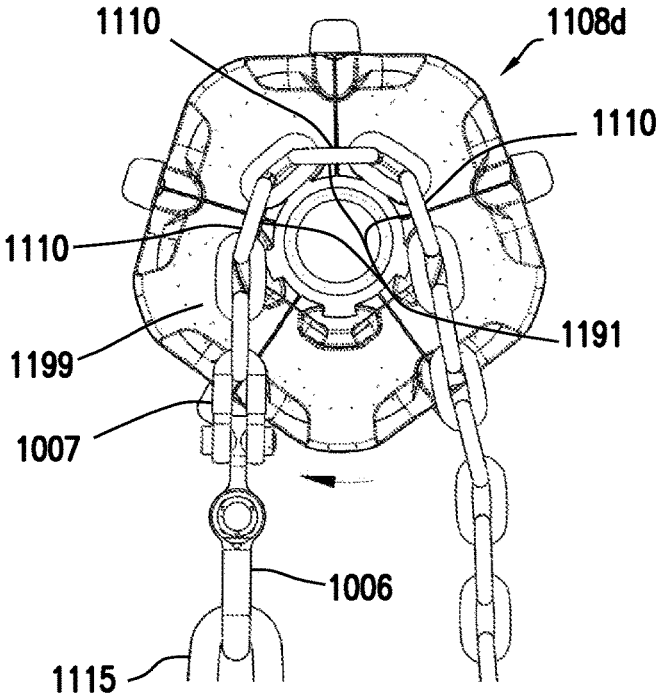
Figure 34B:
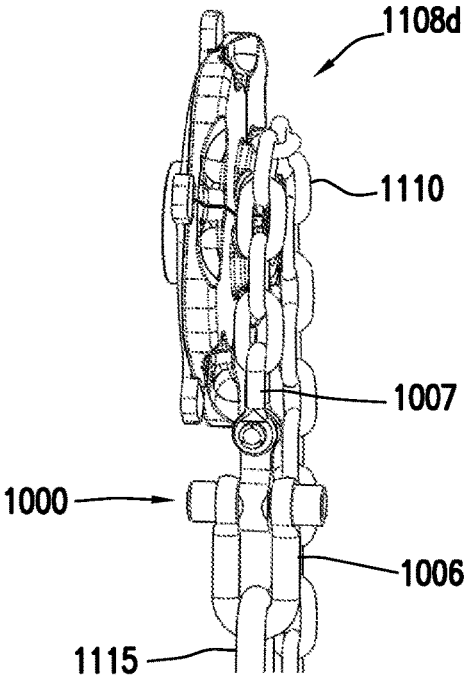
Figure 35A:
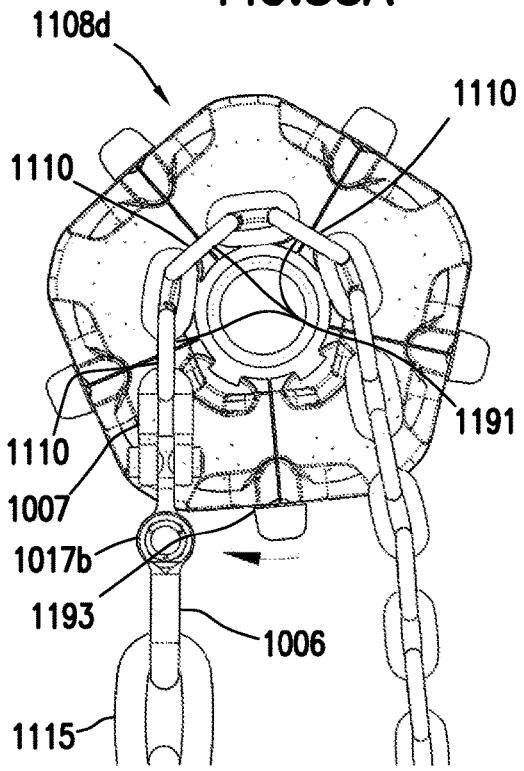
Figure 35B:
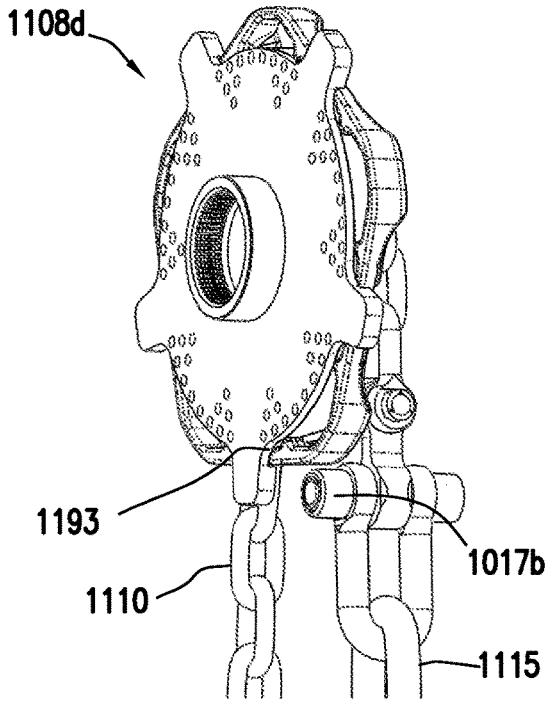
Figure 36A:
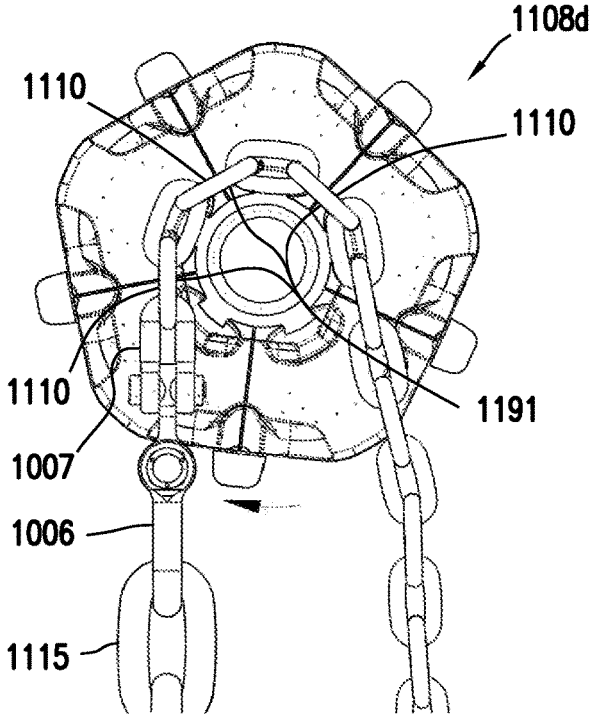
Figure 36B:
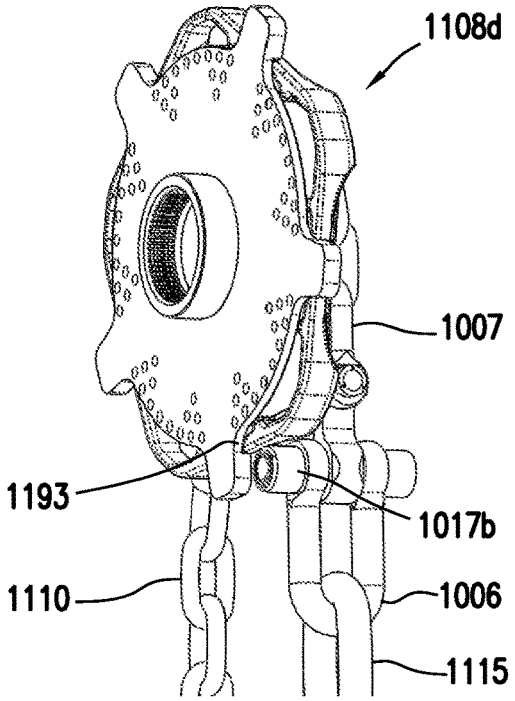
Figure 37A:
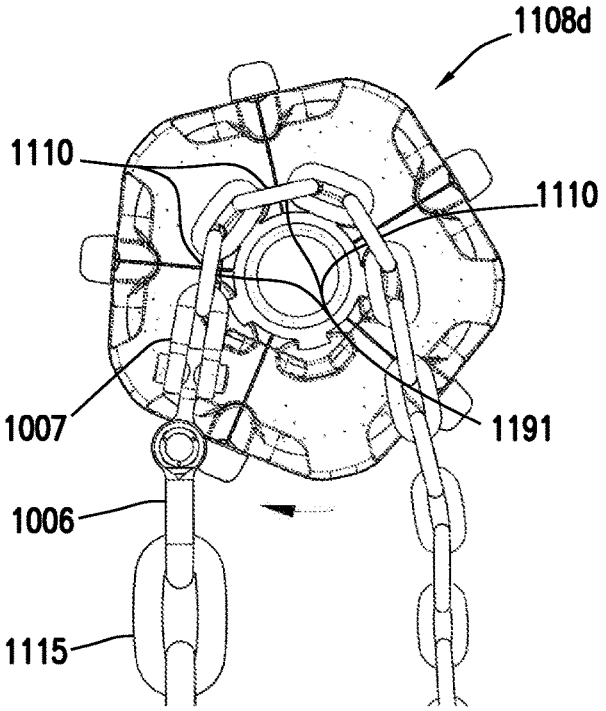
Figure 37B:
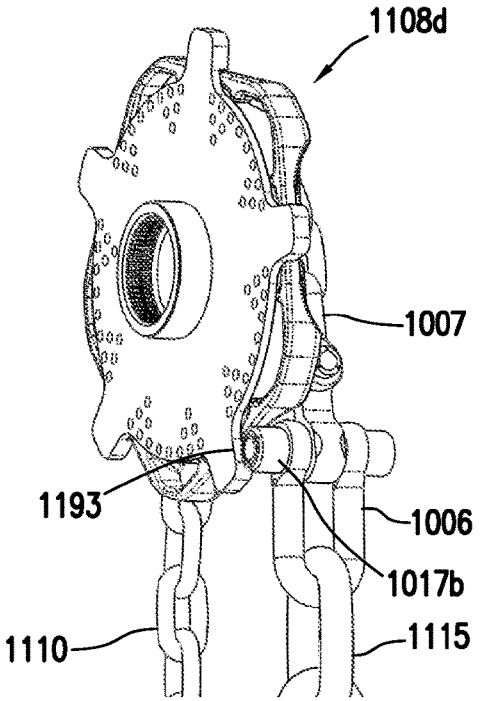
Figure 38A:
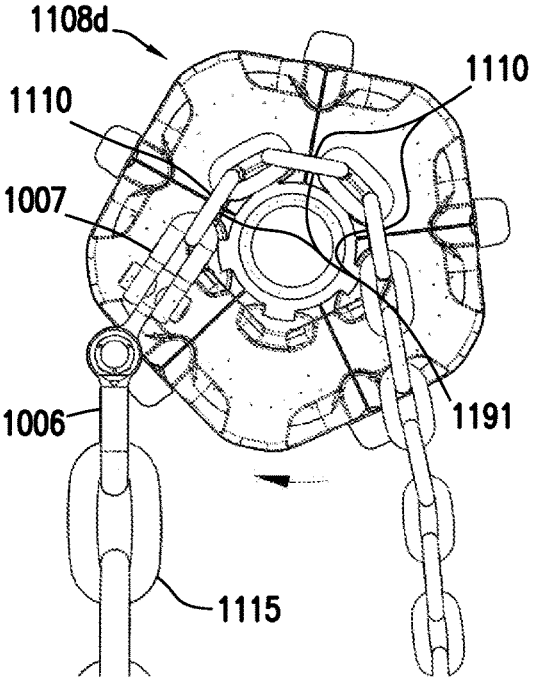
Figure 38B:
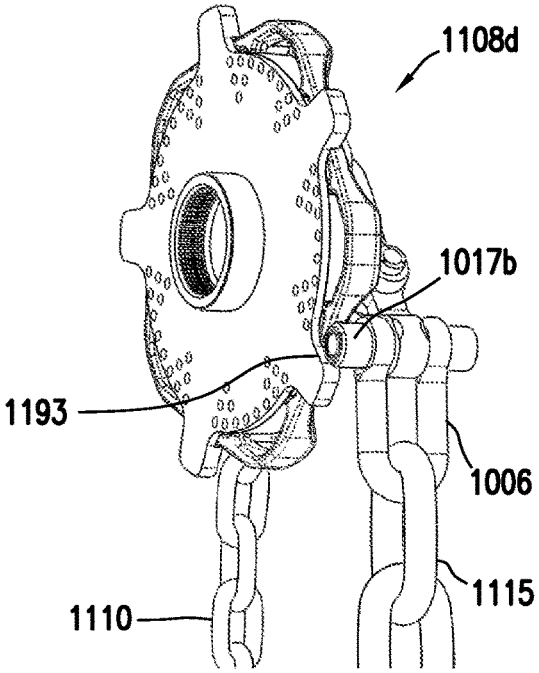
Figure 39A:
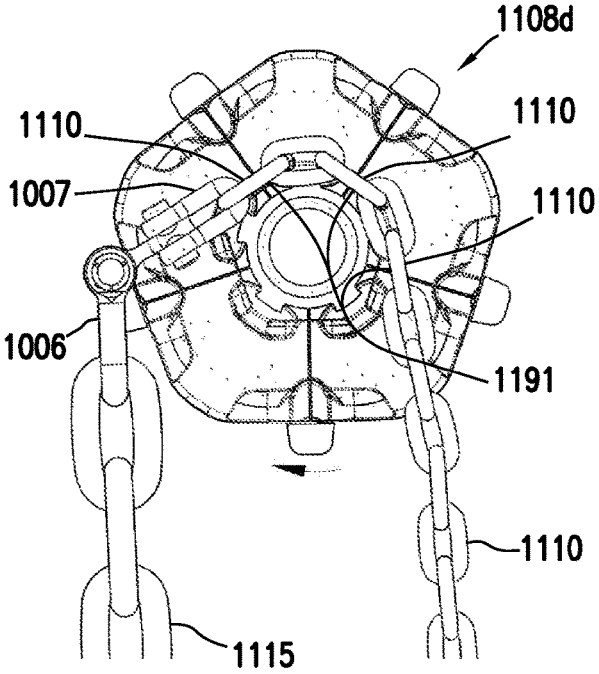
Figure 39B:
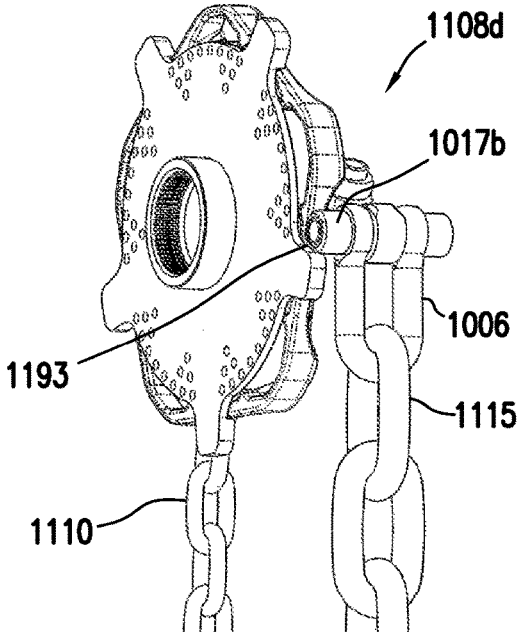
Figure 40A:
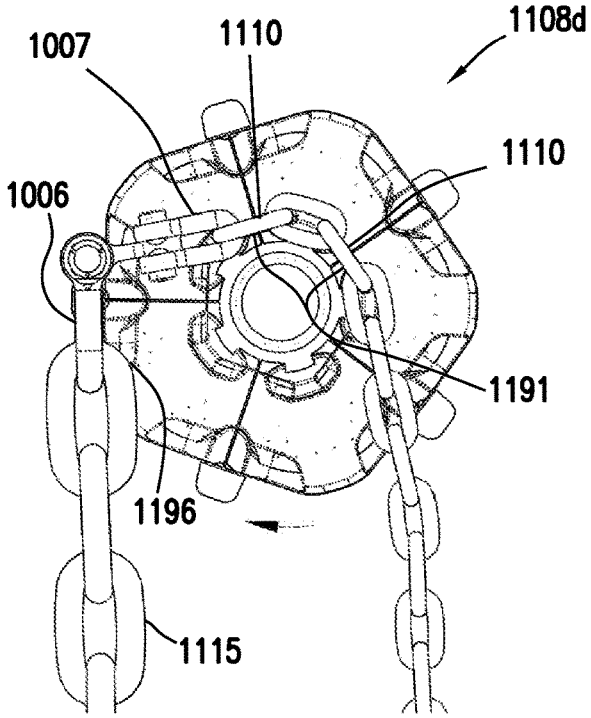
Figure 40B:
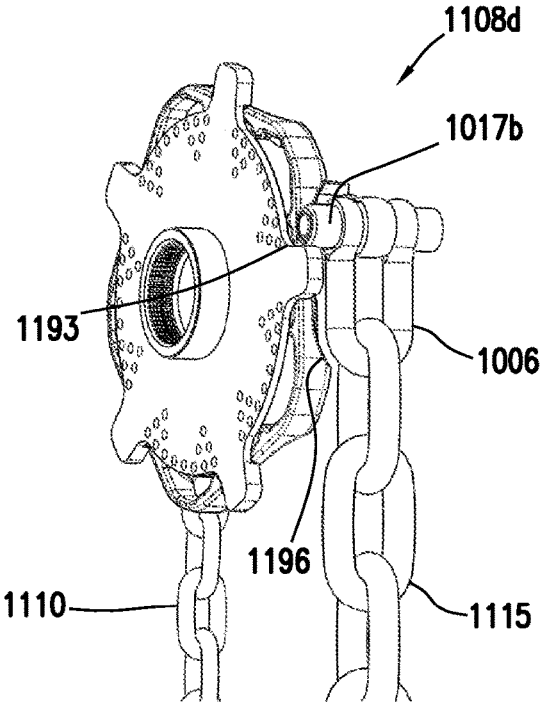
Figure 41A:
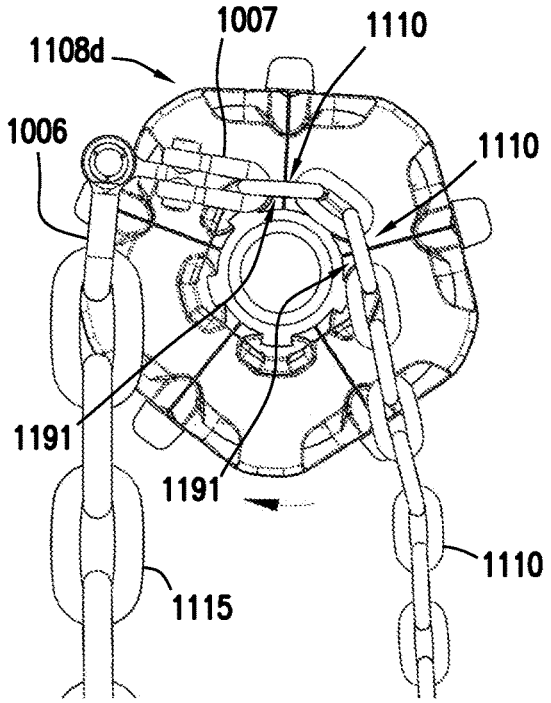
Figure 41B:
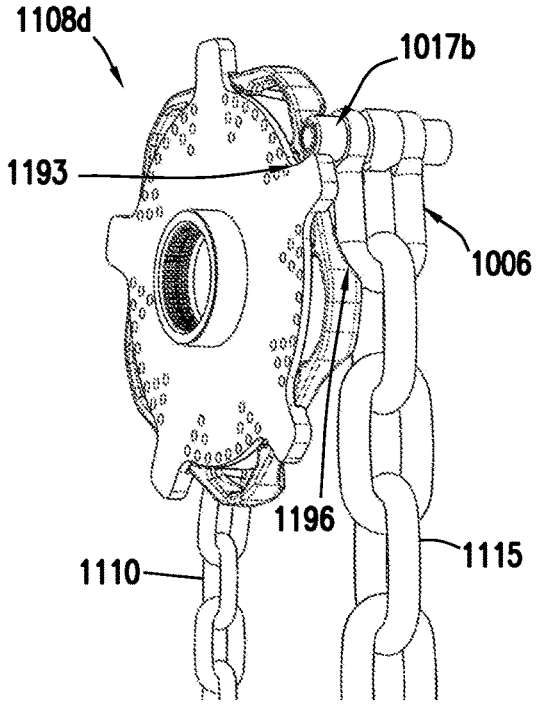
Figure 42A:
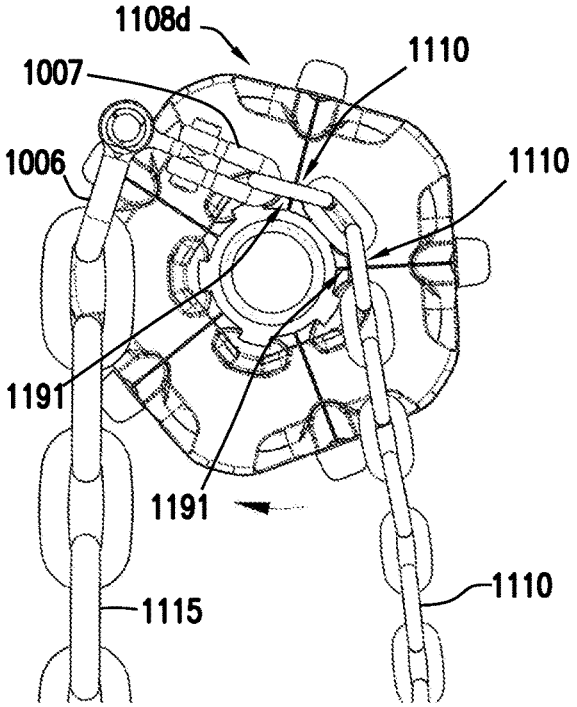
Figure 42B:
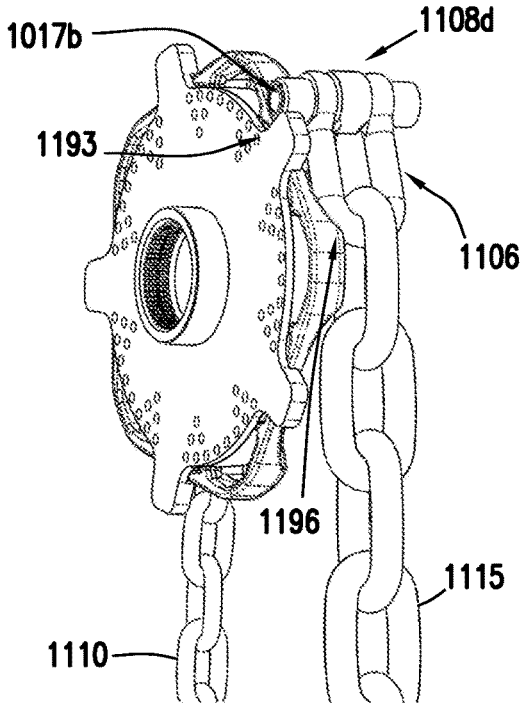
Figure 43A:
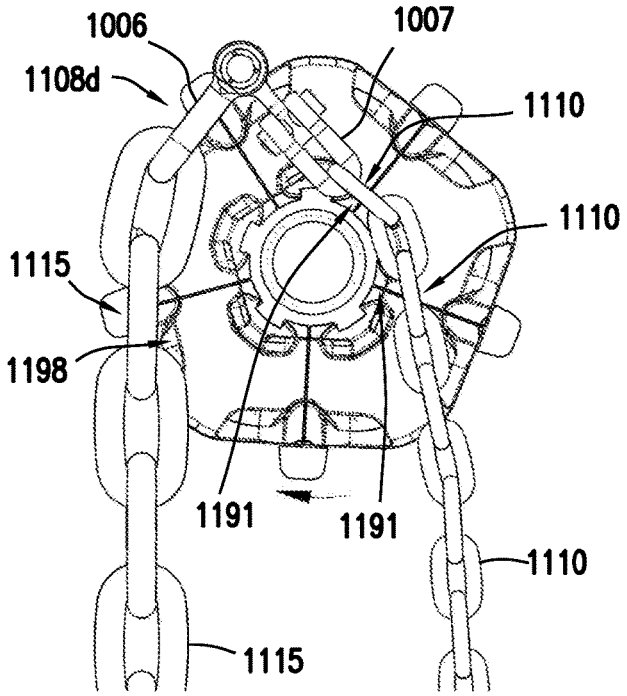
Figure 43B:
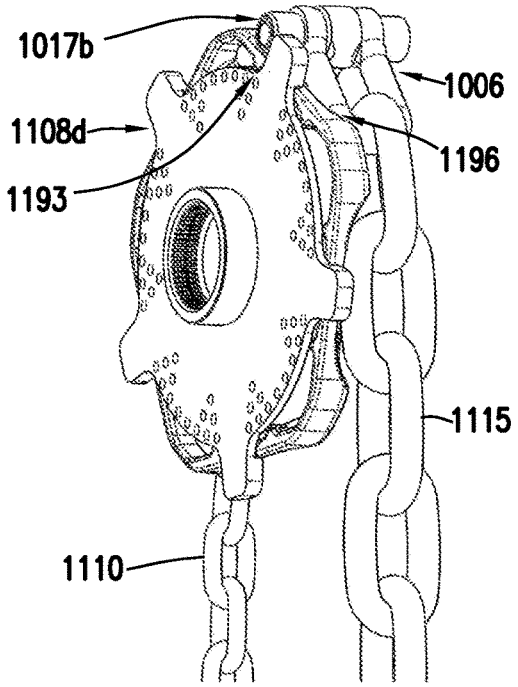
Figure 44A:
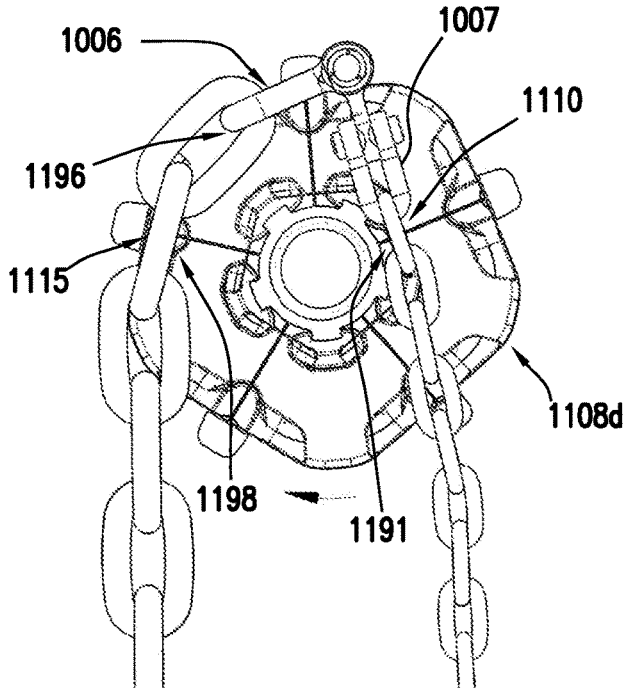
Figure 44B:
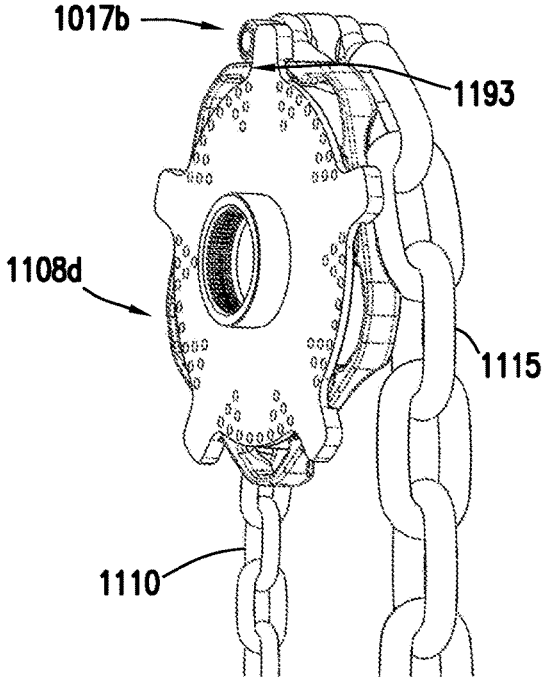
Figure 45A:
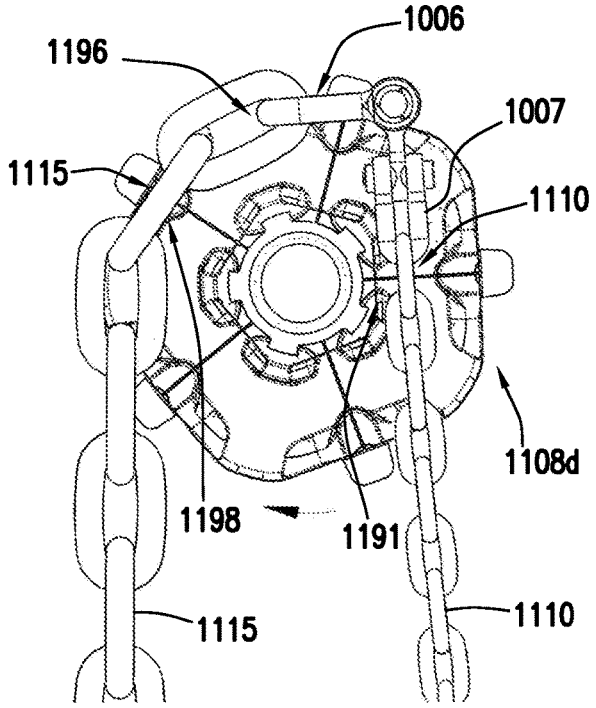
Figure 45B:
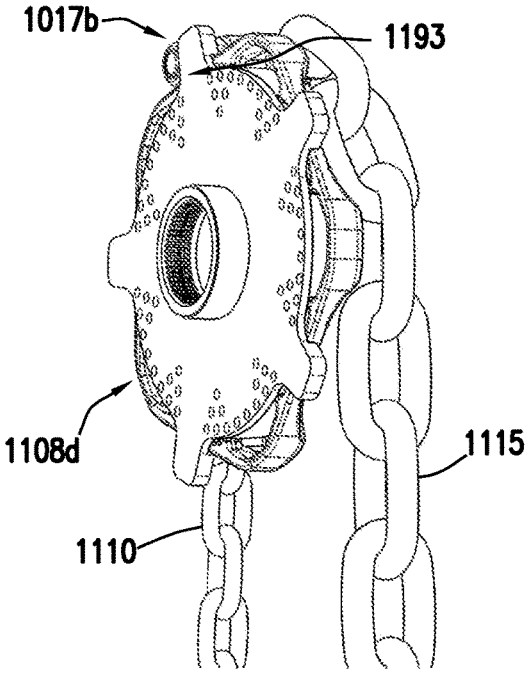
Figure 46A:
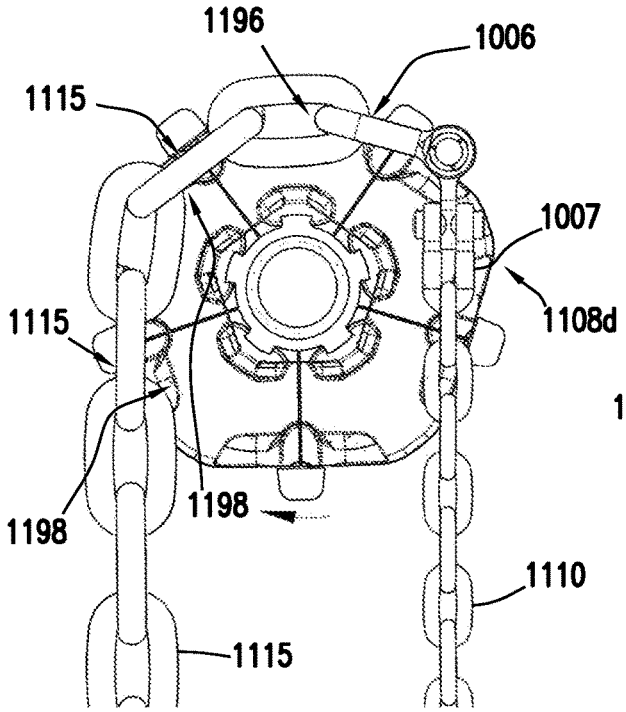
Figure 46B:
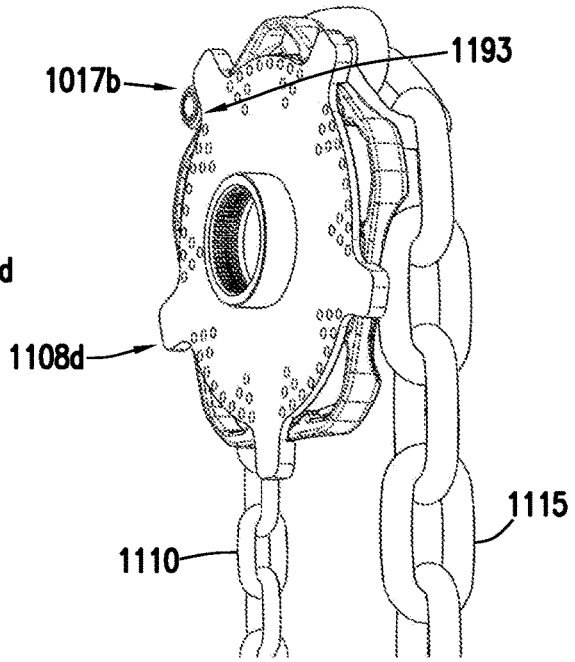
Figure 47A:
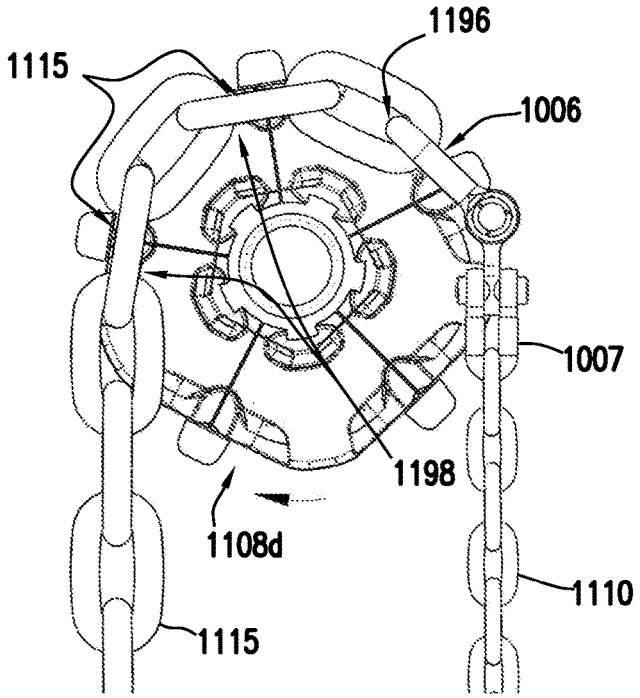
Figure 47B:
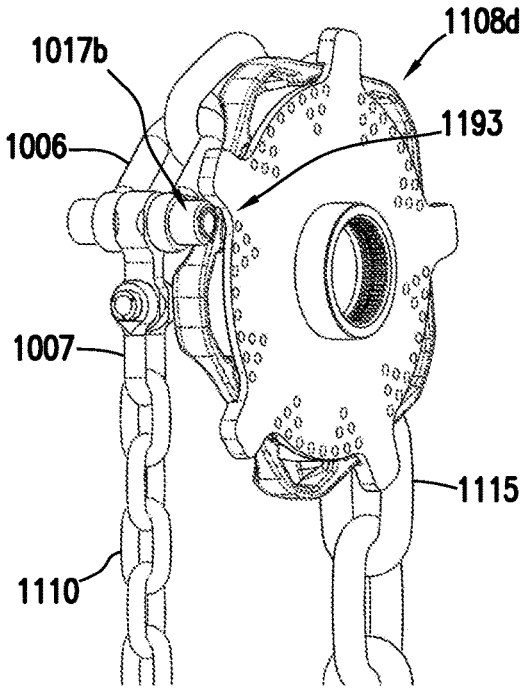
Figure 48A:
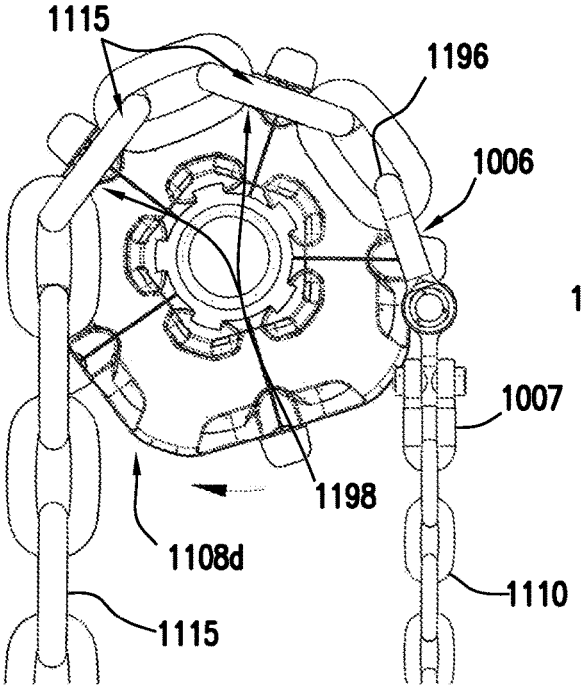
Figure 48B:
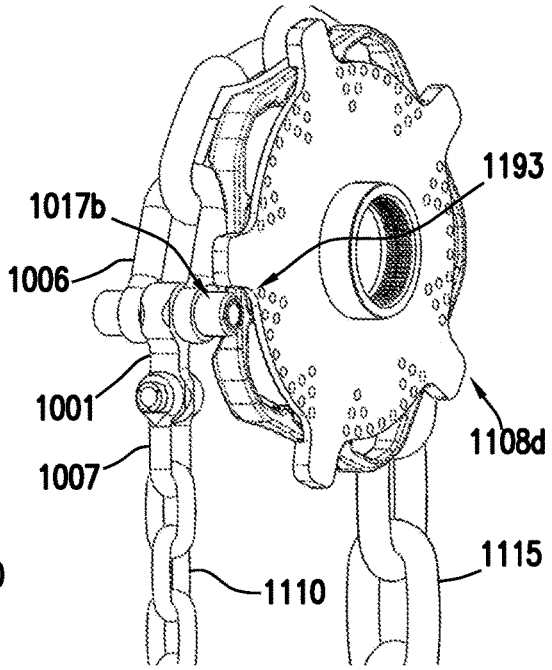
Figure 49A:
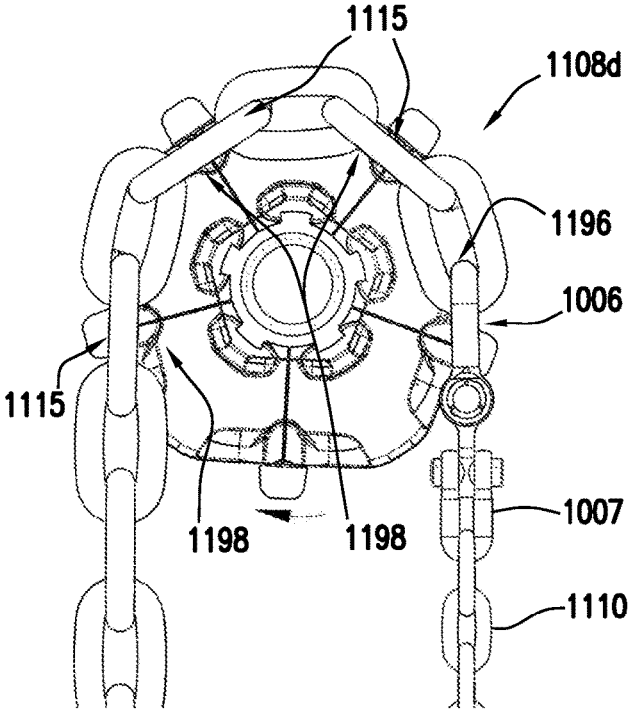
Figure 49B:
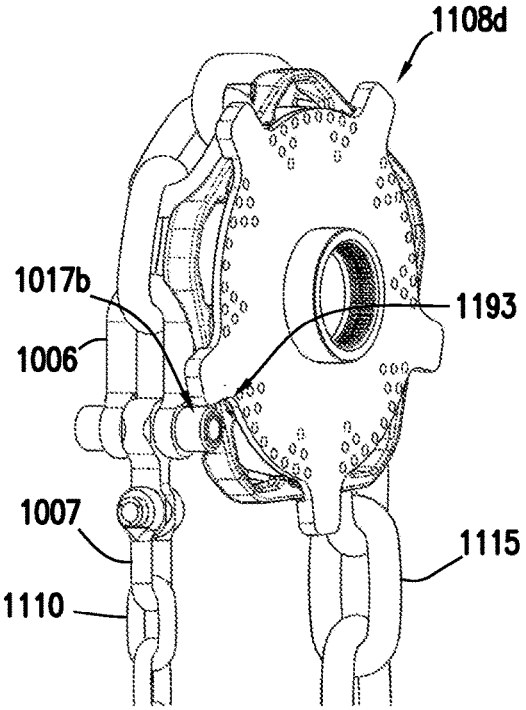
Figure 50A:
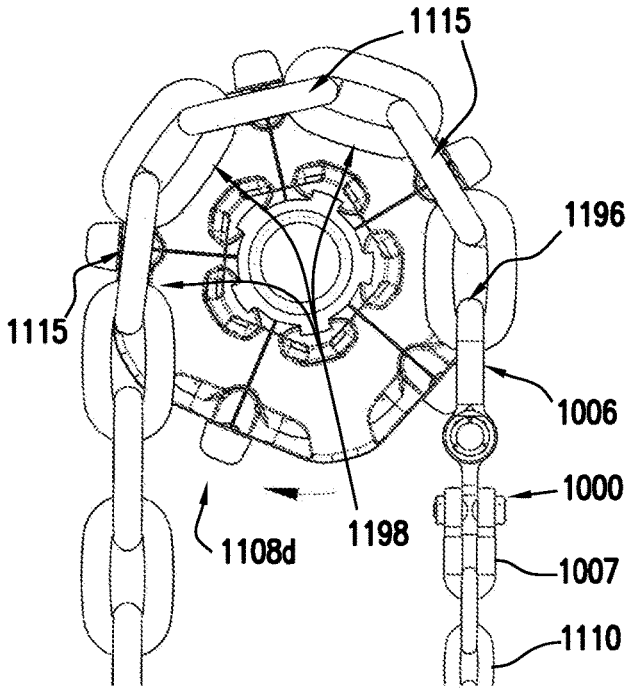
Figure 50B:
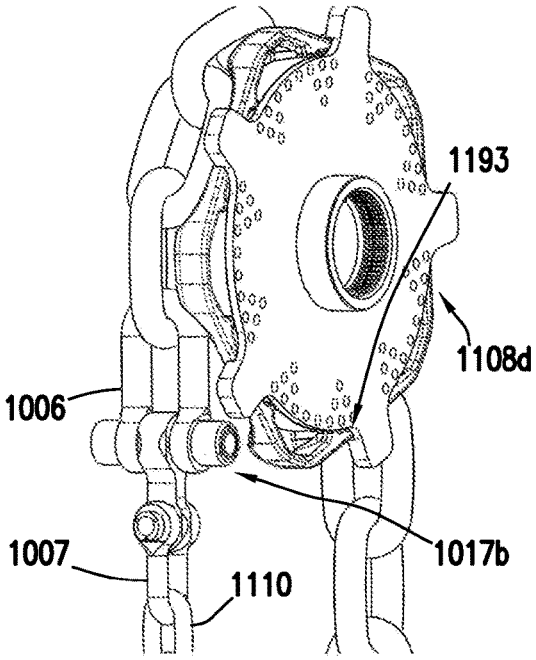
Figure 51B:
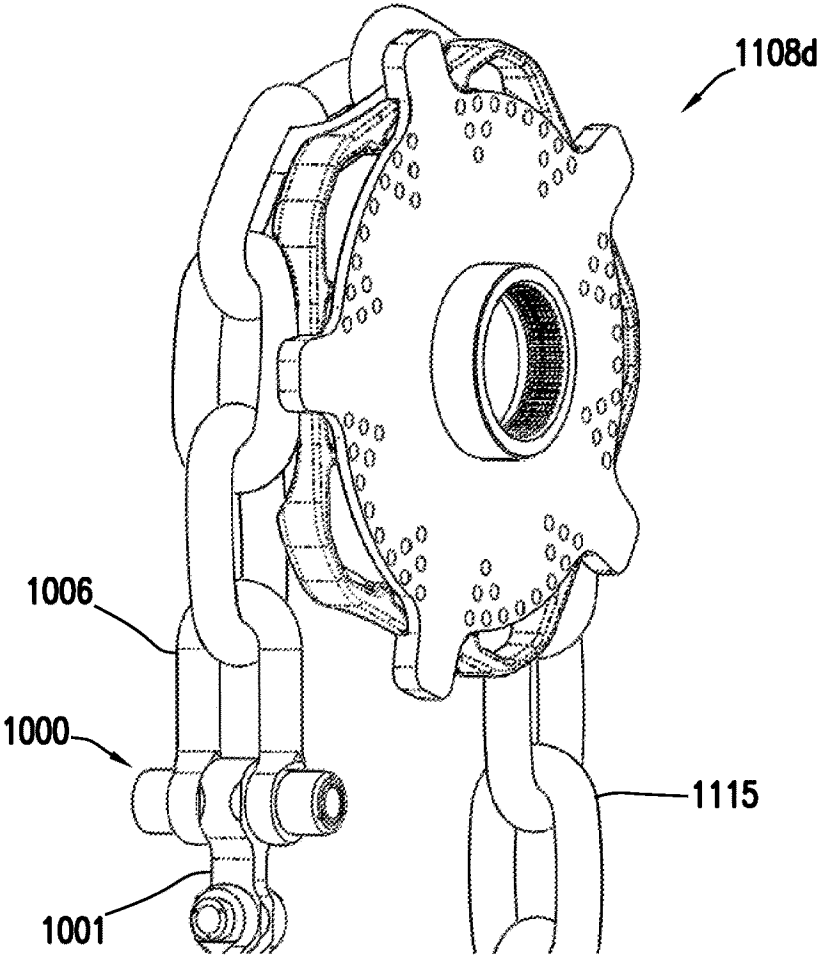
Figure 51A:
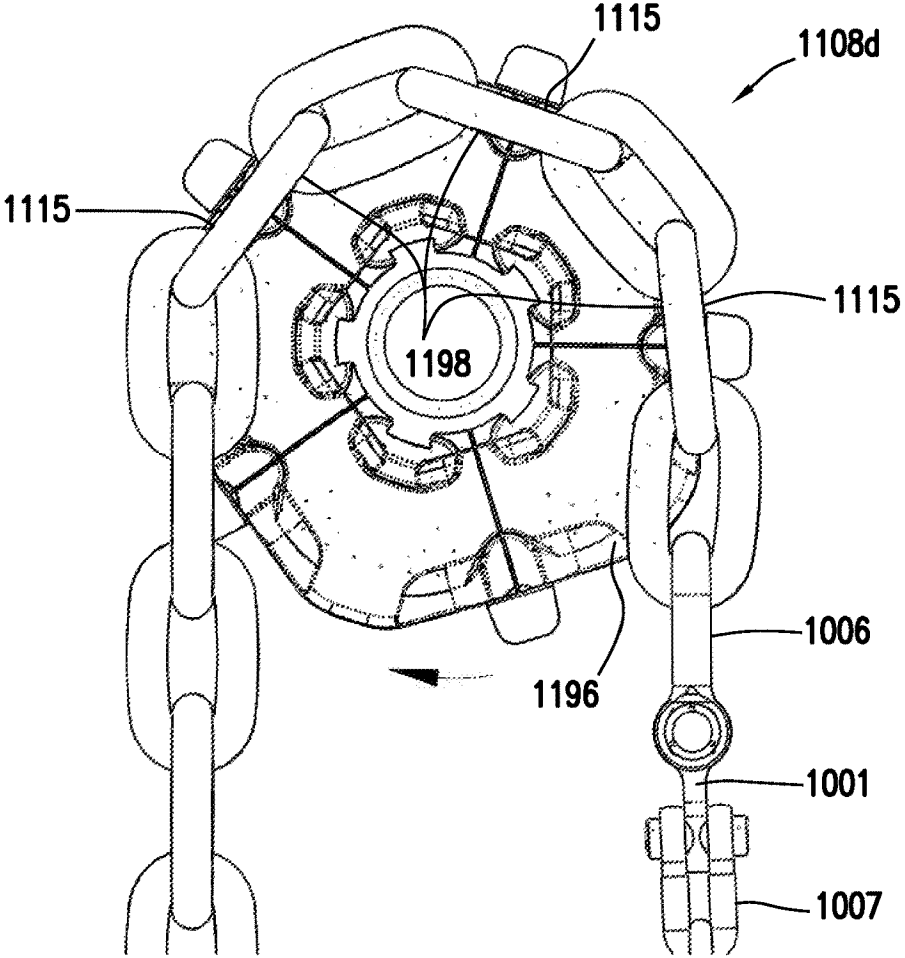

The interfacing sequences of the chain wheel 1108*d* with small chain 1110, link coupler 1000 and large chain 1115 may be the same as described with reference to the chain wheel 1108*c* operated in driven mode and with a perpendicular orientation (i.e., the sequence shown and described with reference to FIGS. 15A-23B). As such, the details of the interfacing will not be repeated. Link coupler 1000 orientation is illustrated in FIGS. 33A and 33B, and the sequences of transition for the link coupler around the chain wheel 1108*d* are illustrated, sequentially, in FIGS. 34A-51B. Briefly, in the driving mode, as shown in FIGS. 33A-51B, the sequence of interfacing features is essentially as follows: (1) the small chain links 1110 interfaces with the inner pocket flat bed 1191; (2) the pin head 1017*b* (or nut 1019*b* or another portion of pin 1011*b*) interfaces with the outer whelp base 1193; (3) the large-chain link coupler 1006 interfaces with the outer link pocket flat bed 1198; (4) a large chain link 1115 interfaces with the outer link pocket trap end 1196; and (5) the large chain link 1115 interfaces with the outer link pocket flat bed 1198.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An assembly coupling two lengths of different sized chain together and for moving the two lengths of different sized chain together, the assembly comprising:
- a chain assembly including:
  - a link coupler, the link coupler including a body, a small-chain link coupler coupled with the body, and a large-chain link coupler coupled with the body;
  - a small chain coupled with the small-chain link coupler; and
  - a large chain coupled with the large-chain link coupler; and
- a dual chainwheel including a small wildcat profile and a large wildcat profile, wherein the chain assembly is engaged with the dual chainwheel, and wherein engagement of the link coupler with the large wildcat profile positions the large chain along a path defined by the large wildcat profile.

2. The assembly of claim 1, wherein, during haul-in or pay-out, the link coupler positions the large chain along the path defined by the large wildcat profile and positions the small chain along a path defined by the small wildcat profile.

3. The assembly of claim 1, wherein the small-chain link coupler and the large-chain link coupler are each pivotably coupled with the body, and wherein the small-chain link coupler pivots about an axis that is perpendicular to an axis about which the large-chain link coupler pivots.

4. The assembly of claim 3, wherein each of the small chain link coupler and the large chain link coupler are coupled with the body via a pin, and wherein, during haul-in or pay out, one of the pins engages with a surface feature of the large wildcat profile, and wherein engagement of the pin with the surface feature positions the large chain along the path defined by the large wildcat profile.

5. The assembly of claim 4, wherein the surface feature includes a series of peaks and valleys formed on the surface of the large wildcat profile.

6. The assembly of claim 1, wherein, during haul-in or pay-out, the large wildcat profile receives, engages, and facilitates movement of the large chain, and the small wildcat profile receives, engages, and facilitates movement of the small chain.

7. The assembly of claim 1, wherein the small wildcat profile includes a series of peaks and valleys that form pockets, and wherein, during haul-in or pay-out: the pockets of the small wildcat profile receive and engage successive vertical links of the small chain, facilitating movement of the small chain; and the peaks of the small wildcat profile engage within successive coils of horizontal links of the small chain, facilitating movement of the smalls chain.

8. The assembly of claim 1, wherein the link coupler has a shape and dimensions sufficient to: engage with the small wildcat profile at the first end thereof and to engage with the large wildcat profile at the second end thereof, and to maintain engagement between the small wildcat profile and links of the small chain and to deliver links of the large chain to the large wildcat profile during haul-in or pay-out.

9. The assembly of claim 1, wherein:

the large wildcat profile includes a series of pockets positioned between a series of outer teeth formed on the chain wheel, and a series of outer whelp tips on the chain wheel adjacent the pockets, wherein the pockets include a bed having a pit formed therein, and wherein a trap end of the bed is formed adjacent the outer teeth; and wherein the small wildcat profile includes a series of pockets positioned between a series of inner teeth, wherein the pockets include beds with trap ends formed adjacent the inner teeth, and wherein a series of grooves are positioned between the beds.

10. The assembly of claim 9, wherein, in the driven mode or the driving mode, with the large-chain link coupler in the perpendicular orientation relative to the plane within which the chain wheel rotates, perpendicular links of the small chain are positioned to seat on the bed of the small wildcat profile, an engagement portion of the large-chain link coupler is positioned to seat against one of the outer whelp tips, the large-chain link coupler is positioned to seat on the bed of the large wildcat profile, and parallel links of the large chain are positioned to engage one of the trap ends of the large wildcat profile and seat on one of the beds of the large wildcat profile.

11. The assembly of claim 1, wherein the chain wheel is operable in driven mode or driving mode, wherein, in the driven mode, loads are transferred from links of the small and large chains to the chain wheel, and wherein, in the driving mode, loads are transferred from the chain wheel to links of the small chain and large chain.

12. The assembly of claim 1, wherein the large-chain link coupler is oriented perpendicular or parallel to a plane in which the chain wheel rotates.

13. A method for coupling two lengths of different sized chain together and moving the two lengths of different sized chain together, the method comprising:

providing a link coupler, the link coupler including a body, a small-chain link coupler coupled with the body, and a large-chain link coupler coupled with the body;

coupling a small chain with the small-chain link coupler;

coupling a large chain with the large-chain link coupler, wherein the link coupler coupled with the small chain and the large chain forms a chain assembly;

engaging the chain assembly with a dual chainwheel, the dual chain wheel including a small wildcat profile and a large wildcat profile; and hauling-in or paying-out the chain assembly.

14. The method of claim 13, wherein the method comprises hauling-in the chain assembly or paying-out the chain assembly, and:

wherein hauling-in the chain assembly includes: hauling-in the small chain along a path defined by the small wildcat profile until the link coupler engages the large wildcat profile, wherein engagement of the link coupler with the large wildcat profile delivers the large chain to the large wildcat profile; and hauling-in the large chain along a path defined by the large wildcat profile; and wherein paying-out the chain assembly includes: paying-out the large chain along a path defined by the large wildcat profile until the link coupler engages the large wildcat profile; after engagement of the link coupler with the large wildcat profile, continuing to pay-out the large chain along the path defined by the large wildcat profile until the link coupler disengages from the large wildcat profile, wherein disengagement of the link coupler from the large wildcat profile delivers the small chain to the small wildcat profile; and paying-out the small chain along a path defined by the small wildcat profile.

15. The method of claim 14, wherein hauling-in or paying-out the chain assembly includes operating the chain wheel in a driven mode or driving mode, and wherein the large-chain link coupler is oriented perpendicular relative to the orientation of the plane within which the chain wheel rotates.

16. The method of claim 15, wherein, with a link of the small chain is seated on a bed of the small wildcat profile, the hauling-in or paying-out the chain assembly includes:

rotating the chain wheel until an engagement portion of the large-chain link coupler engages with one of the outer whelp tips and the small chain exits the chain wheel;

rotating the chain wheel until the large-chain link coupler engages one of the beds of the large wildcat profile and a link of the large chain engages with one of the trap ends of the large wildcat profile; and rotating the chain wheel until the engagement portion of the large-chain link coupler exits the chain wheel and the link of the large chain seats on one of the beds of the large wildcat profile.

17. The method of claim 14, wherein hauling-in or paying-out the chain assembly includes operating the chain wheel in a driven mode, and wherein the large-chain link coupler is oriented parallel relative to the orientation of the plane within which the chain wheel rotates.

18. The method of claim 17, wherein, with a link of the small chain is seated on a bed of the small wildcat profile, the hauling-in or paying-out the chain assembly includes:

rotating the chain wheel until an engagement portion of the small-chain link coupler seats within one of the pits of the large wildcat profile;

rotating the chain wheel until the links of the small chain exit the chain wheel and a link of the large chain engages one of the trap ends of the large wildcat profile and the engagement portion of the small-chain link coupler disengages from the pit;

rotating the chain wheel until the link of the large chain seats in one of the beds of the large wildcat profile and the link coupler exits the chain wheel.

19. The method of claim 13, further comprising transferring loads from links of the small and large chain to the chain wheel.

20. The method of claim 13, further comprising transferring loads from the chain wheel to links of the small and large chains.

21. A link coupler for coupling two lengths of different sized chain together and facilitating movement of the two lengths of different sized chain, the link coupler comprising:

a body;

a small-chain link coupler movably coupled with the body; and a large-chain link coupler movably coupled with the body, wherein the small-chain link coupler is sized to couple with a small chain and the large-chain link coupler is sized to couple with a large chain;

wherein the small-chain link coupler and the large-chain link coupler are each pivotably coupled with the body; and wherein the small-chain link coupler pivots about an axis that is perpendicular to an axis about which the large-chain link coupler pivots.

22. A link coupler for coupling two lengths of different sized chain together and facilitating movement of the two lengths of different sized chain, the link coupler comprising:

a body;

a small-chain link coupler movably coupled with the body; and a large-chain link coupler movably coupled with the body, wherein the small-chain link coupler is sized to couple with a small chain and the large-chain link coupler is sized to couple with a large chain;

wherein the link coupler includes an engagement portion formed thereon, wherein the engagement portion is positioned to engage a portion of a dual chain wheel and facilitate positioning of a small chain along a small wildcat profile of the dual chain wheel and facilitate positioning of a large chain along a large wildcat profile of the dual chain wheel.

23. A link coupler for coupling two lengths of different sized chain together and facilitating movement of the two lengths of different sized chain, the link coupler comprising:

a body;

a small-chain link coupler movably coupled with the body; and a large-chain link coupler movably coupled with the body, wherein the small-chain link coupler is sized to couple with a small chain and the large-chain link coupler is sized to couple with a large chain;

wherein movement of the large-chain link coupler relative to the body is independent movement of the small-chain link coupler relative to the body, and wherein movement of the small-chain link coupler relative to the body is independent movement of the large-chain link coupler relative to the body.

24. A link coupler for coupling two lengths of different sized chain together and facilitating movement of the two lengths of different sized chain, the link coupler comprising:

a body;

a small-chain link coupler movably coupled with the body; and a large-chain link coupler movably coupled with the body, wherein the small-chain link coupler is sized to couple with a small chain and the large-chain link coupler is sized to couple with a large chain;

wherein the body has a first end and a second end, the second end opposite the first end, and wherein the small-chain link coupler is movably coupled with the body at the first end and the large-chain link coupler is movably coupled with the body at the second end.

25. The assembly of claim 1, wherein a chain line wrap angle of the chain wheel is greater or equal to 135°.

26. The assembly of claim 1, wherein the large wildcat profile includes a series of peaks and valleys that form pockets, and wherein, during haul-in or pay-out: a pocket of the large wildcat profile receives and engages an engagement portion of the link coupler to facilitate delivery of the large chain to the large wildcat profile; and the large chain is hauled-in or paid-out along the path defined by the large wildcat profile.

27. The assembly of claim 9, wherein, in the driven mode with the large-chain link coupler in the parallel orientation relative to the plane within which the chain wheel rotates, perpendicular links of the small chain are positioned to seat on the bed of the small wildcat profile, an engagement portion of the small-chain link coupler is positioned to seat within one of the pits of the large wildcat profile, and perpendicular links of the large chain are positioned to engage one of the trap ends of the large wildcat profile and seat on one of the beds of the large wildcat profile.

* * * * *